US007594830B2

(12) United States Patent
Murakami et al.

(10) Patent No.: US 7,594,830 B2
(45) Date of Patent: Sep. 29, 2009

(54) JOINT CONNECTOR

(75) Inventors: Masakazu Murakami, Tokyo (JP); Takahiro Imai, Tokyo (JP); Tamaki Takabayashi, Tokyo (JP); Takenobu Yabu, Tokyo (JP); Syougo Tomita, Tokyo (JP); Seiichi Ueno, Tokyo (JP); Katsunori Takeda, Tokyo (JP)

(73) Assignee: The Furukawa Electric Co., Ltd. (JP)

( * ) Notice: Subject to any disclaimer, the term of this patent is extended or adjusted under 35 U.S.C. 154(b) by 0 days.

(21) Appl. No.: 12/335,385

(22) Filed: Dec. 15, 2008

(65) Prior Publication Data

US 2009/0098778 A1 Apr. 16, 2009

Related U.S. Application Data

(62) Division of application No. 12/026,644, filed on Feb. 6, 2008, now Pat. No. 7,481,682, which is a division of application No. 10/665,833, filed on Sep. 18, 2003, now Pat. No. 7,354,318.

(30) Foreign Application Priority Data

| | | |
|---|---|---|
| Sep. 19, 2002 | (JP) | 2002-273842 |
| Feb. 4, 2003 | (JP) | 2003-027650 |
| Feb. 10, 2003 | (JP) | 2003-032805 |
| Feb. 13, 2003 | (JP) | 2003-035346 |
| May 8, 2003 | (JP) | 2003-130386 |

(51) Int. Cl.
*H01R 13/502* (2006.01)

(52) U.S. Cl. ..... 439/701

(58) Field of Classification Search ..... 439/701, 439/717, 695

See application file for complete search history.

(56) References Cited

U.S. PATENT DOCUMENTS

| | | | |
|---|---|---|---|
| 5,204,805 | A | 4/1993 | Takahashi et al. |
| 5,447,452 | A | 9/1995 | Takano |
| 6,093,061 | A | 7/2000 | Varsik et al. |
| 6,129,593 | A | 10/2000 | Aoyama et al. |
| 6,231,398 | B1 | 5/2001 | Furutani et al. |

(Continued)

FOREIGN PATENT DOCUMENTS

| | | |
|---|---|---|
| JP | 5-65073 | 8/1993 |

(Continued)

OTHER PUBLICATIONS

Japanese Utility Model Unexamined Publication JP, U, S 56-117481 with English Translation of the Specification and the Claim.

*Primary Examiner*—Briggitte R Hammond
(74) *Attorney, Agent, or Firm*—Cantor Colburn LLP

(57) ABSTRACT

A joint connector according to the present invention is provided with a circuit board, a male connector having male terminals provided on the circuit board at a predetermined interval and standing in one direction and a direction that crosses the one direction, the male terminals being selectively connected by a copper foil circuit, and a female connector in which female connector elements each having female terminals inserted and interlocked in female terminal holders are stacked, wherein the male connector and the female connector are fit to each other. This achieves cost reduction and improvement in work efficiency in electric wire connection by attaining easy electric wire connection and branching.

4 Claims, 43 Drawing Sheets

U.S. PATENT DOCUMENTS

| | | | | |
|---|---|---|---|---|
| 6,343,960 | B1 | 2/2002 | Sato | |
| 6,402,568 | B1 | 6/2002 | Nagai | |
| 6,443,782 | B1 * | 9/2002 | Mitani | 439/701 |
| 6,537,080 | B2 | 3/2003 | Sato | |
| 6,551,119 | B1 | 4/2003 | Sakamoto et al. | |
| 6,573,453 | B2 | 6/2003 | Takada et al. | |
| 6,830,489 | B2 | 12/2004 | Aoyama | |
| 6,878,017 | B2 | 4/2005 | Sakurai et al. | |
| 7,077,708 | B1 | 7/2006 | Johnson et al. | |
| 7,125,285 | B2 | 10/2006 | Maejima et al. | |
| 2002/0025731 | A1 | 2/2002 | Sato | |
| 2002/0123272 | A1 | 9/2002 | Yoshida et al. | |
| 2003/0236032 | A1 * | 12/2003 | Sakatani | 439/677 |

FOREIGN PATENT DOCUMENTS

| | | | |
|---|---|---|---|
| JP | 2001-39239 | A | 2/2001 |
| JP | 2001-229989 | A | 8/2001 |
| JP | 2001-291548 | A | 10/2001 |
| JP | 2001-291567 | A | 10/2001 |
| JP | 2001-307816 | A | 11/2001 |

* cited by examiner

FIG. 20A
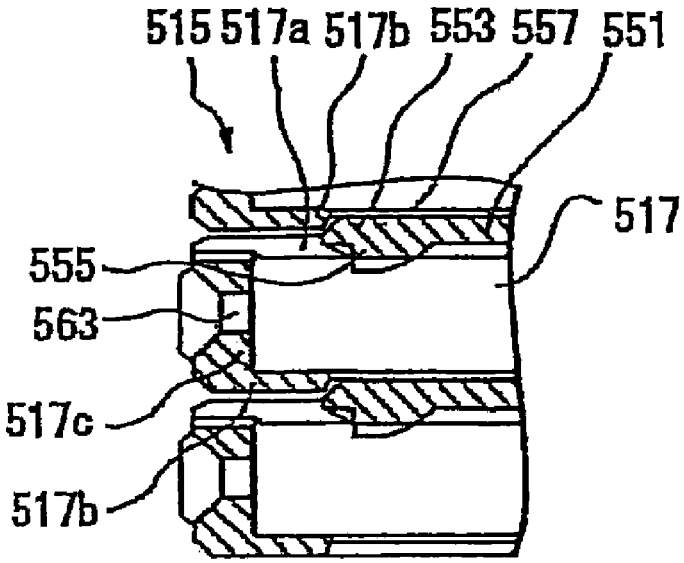
FIG. 20B
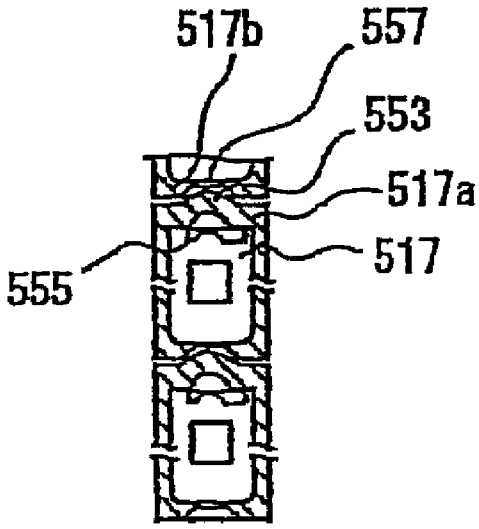
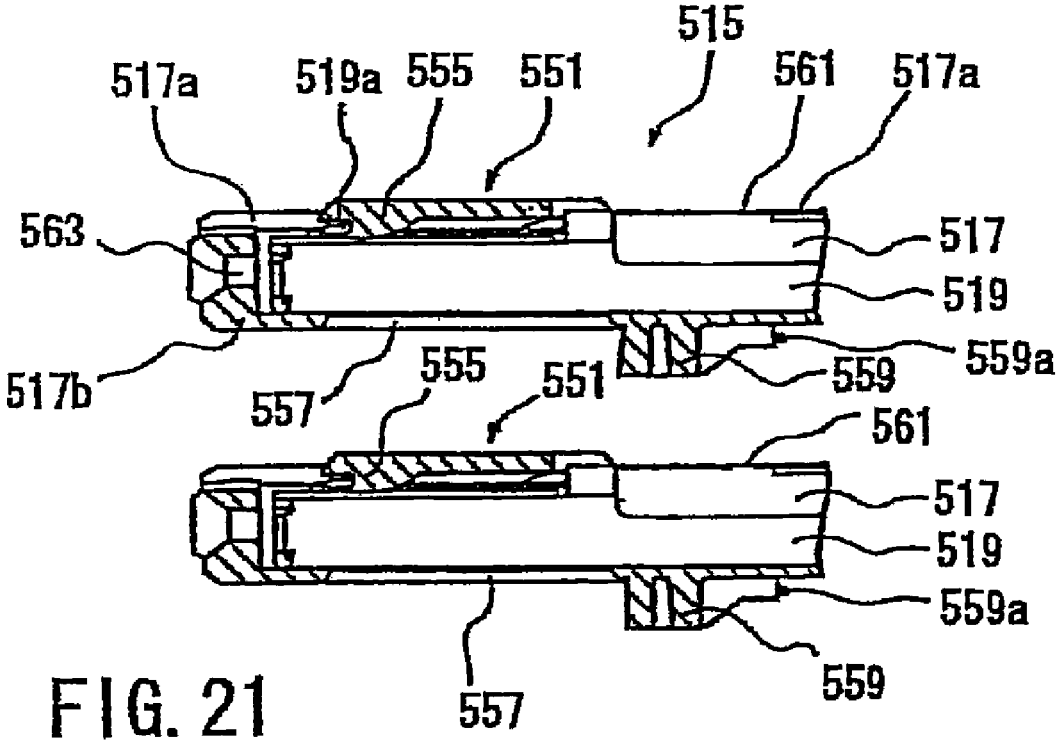
FIG. 21

JOINT CONNECTOR

CROSS REFERENCE TO RELATED APPLICATION

The present application is a divisional application of U.S. patent application Ser. No. 12/026,644, filed Feb. 6, 2008, the entire contents of which are incorporated by reference. The Ser. No. 12/026,644 application is a divisional application of the earlier filed U.S. patent application Ser. No. 10/665,833, filed on Sep. 18, 2003, priority to which is claimed herein and the contents of which are incorporated herein by reference. The 10/665,833 application claimed the benefit of the dates of the earlier filed Japanese Patent Application Nos. JP2002-273842, filed Sep. 19, 2002; JP2003-027650, filed Feb. 4, 2003; JP2003-032805, filed Feb. 10, 2003; JP2003-035346, filed Feb. 13, 2003; and JP-2003-130386, filed May 8, 2003; the entire contents of each of which are incorporated herein by reference, and priority to each of which is hereby claimed.

BACKGROUND OF THE INVENTION

1. Field of the Invention

The present invention relates to joint connectors used for, for example, branching a wire harness (electric wires) wired in an automobile, and particularly to a joint connector that can achieve cost reduction and exhibit excellent workability in connecting electric wires.

2. Description of the Prior Art

Hereinbelow, a first prior art and its problems to be solved are discussed.

In recent years, electrical components incorporated in, for example, automobiles have increasingly been diversified. This has created the necessity of branching wire harnesses in complex manners, and accordingly, there has been a greater use of joint connectors.

Here, an example of prior-art joint connectors is described. One example of the terminal in a first prior-art joint connector of this kind has a male terminal portion and a female terminal portion provided in one piece of terminal and an electric wire press-fit portion partially provided so as to be connected with an electric wire by press-fitting. In a stacking direction of one-stage parallel-line-shaped connectors, that is, in a vertical direction, the male terminal portions are extended from a housing so as to straddle the housings to make connection. By stacking the press-fit joint connectors, the male terminal portions are inserted into female terminal portions of another joint connector terminal to be connected, which has the same shape. In addition, a terminal-linking portion is used to make connection in the terminals' juxtaposed direction (lateral direction) within a single one-stage parallel-line-shaped connector using terminal-linking portions.

This structure is described with reference to the drawings. As shown in FIG. 1, joint connector terminals 110 have male terminal portions 111 protruding upwardly, female terminal portions (not shown), and electric wire press-fit portions 112. By stacking one-stage parallel-line-shaped press-fit joint connectors 100 in which a plurality of joint connector terminals 110 are juxtaposed, a lower stage male terminal portion 111 is fitted and connected with an upper stage female terminal portion, and electrical connection is achieved between the upper and lower one-stage parallel-line-shaped press-fit joint connector terminals.

The continuity in the terminal's lateral direction (terminal's juxtaposed direction) is made through a terminal-linking portion, which is not shown in the figure, so that electrical connection is made in the one-stage parallel-line-shaped press-fit joint connector (see, for example, Japanese Unexamined Patent Publication No. 2001-291567).

In another prior-art joint connector, which is a second prior-art joint connector, a terminal 210 itself has, as shown in FIGS. 2 and 3, a female terminal portion 211 (see FIG. 3) and a male terminal portion 212, as the above-described first prior-art joint connector 100. Specifically, the female terminal portion 211 is formed at a front portion of one terminal, and a portion thereof that extends further forward from the female terminal portion 211 is bent back to form the male terminal portion (joint portion) 212. In addition, a plurality of the terminals 210 are arranged in a juxtaposed condition, these terminals 210 are formed in a shape such that they are linked through a carrier 201 in a lateral direction, and the male terminal portions 212 formed to be bent backward are inserted into the female terminal portions 211 that are stacked thereon and have the same configuration (see, for example, Japanese Unexamined Patent Publication No. 2001-307816).

The male terminal portions 212 are bent 180 degrees in the front of the press-fit joint connector having a one-stage parallel shape, and, as shown in FIG. 2B, a joint connector 200 is stacked on another joint connector 200 while being slid on the other joint connector 200, which lies underneath, whereby the terminals in the joint connector 200 having a vertically one-stage parallel shape are electrically connected. Although connector differing in their terminal configurations, this connector basically has a similar connection principle to that of the first prior-art joint connector 100, which was introduced first.

It should be noted that this case requires an operation in which the terminal joint portions (male terminal portions) are bent with two manufacturing steps after the terminals connected to electric wires are inserted into a housing.

Another prior-art joint connector, which is a third joint connector is provided with, as shown in FIGS. 4 and 5, a terminal 310 having on one end an electric wire-crimped portion 311, and on the other end a press-fit blade 312 in both the terminals' juxtaposed direction and the terminal housings' stacking direction. Then, the terminals 310 are inserted into a joint connector housing 300 having a one-stage parallel-shape, and after the connector housing 300 is stacked on another one and electric wires are wired in desired paths passing through the terminal press-fit portions, an electric wire supporting member is assembled with the connector housing 300. This produces a configuration in which predetermined press-fit terminals are conductively connected to each other through electric wires 320, 330, . . . etc. (see, for example, Japanese Unexamined Patent Publication No. 2001-229989).

In this case, connection can be made with a certain freedom with respect to the housings' stacking direction or the juxtaposed direction, but the electric wires 320, 330, . . . etc. need to be wired correspondingly.

The problems to be solved in the above-described first prior art are as follows.

The first prior-art joint connector 100, which was described first, has a special connection structure between its terminals, and therefore, the terminals that are necessary to be connected in the stacking direction (vertical direction) require a step of standing the male terminal portion 111 upwardly after inserting the terminals. In addition, because a terminal-linking portion is provided to make a connection in the direction of terminals' juxtaposed (lateral direction), it is necessary to cut off the terminal-linking portion for each wiring pattern by specifying the cut-off position. For this reason, in the use of the joint connector 100, cumbersome manufacturing steps such as bending-back of the terminals and cutting-off of the linking portion are required, which reduce efficiency in electric wire connecting operation by the joint connector.

In the case of the second prior-art joint connector 200, which was described next, as well as the case of the first prior-art joint connector 100, connection between the terminals is achieved by bending back portions of the terminals, and therefore, efficiency improvement in electric wire connecting operation cannot be made by the joint connector 200, as with the first prior-art joint connector 100.

Also, the third prior-art joint connector 300, which was described last, has a drawback in that it is provided with a press-fit blade for the stacking direction and a press-fit blade for the juxtaposed direction within one terminal and therefore the size of the terminal itself becomes large to a certain extent, accordingly increasing the size of the joint connector itself. Moreover, after the terminals 310 are inserted and the one-stage parallel-line-shaped connectors 300 are stacked, electric wires need to be wired and fixed into a desired circuit, which reduces efficiency in the connection operation for the joint connector 300.

Apart from these problems, the first prior-art joint connector 100 and the second prior-art joint connector 200 in particular have a drawback in that, because they have a structure in which one terminal has both a female terminal portion and a male terminal portion, the terminal itself has a complex configuration, which requires a complex molding in manufacturing the terminal, and quality control for the terminals becomes difficult.

Furthermore, since both of the male terminal portion and the female terminal portion are manufactured from one sheet of metal plate, the electrical resistance is high in the male-female contacts or the like and accordingly heat generation becomes great due to the requirement for types of material and thickness that matches the spring characteristics of the female terminal portion (for example, brass having a thickness of 0.25 mm) Therefore, a limitation in use arises in that a sufficiently large current cannot pass.

Next, a second prior art and its problems to be solved are discussed below.

A fourth prior-art joint connector, which relates to the second prior art, comprises an inserting-side connector portion and a receiving-side connector portion in which the inserting-side connector portion is inserted, and the inserting-side connector portion is guided by the receiving-side connector portion while being inserted so that the inserting-side connector portion and the receiving-side connector portion are fitted and connected with each other. The inserting-side connector portion is provided with a plurality of connector housings in which a plurality of terminal-accommodating compartments are juxtaposed in a lateral direction for accommodating connecting terminals, and a connector housing-locking means having an interlocking recess portion provided on the connector housing and an interlocking protrusion portion interlocked therewith, for stacking and combining the connector housings into a plurality of stages. The receiving-side connector portion is provided with a connector case having an inserting-side connector portion-receiving compartment for receiving and holding the inserting-side connector portion, and a circuit-forming unit mounted to the connector case and having a plurality of connection pins protruding in the inserting-side connector receiving compartment so as to be connected to the connecting terminals of the inserting-side connector portion (see Japanese Unexamined Patent Publication No. 2001-39239).

The problems to be solved in the above-described second prior art are as follows.

In the fourth prior-art joint connector, the inserting-side connector portion is normally configured by stacking a plurality of connector housings into a plurality of stages, and thereafter tightly inserting the interlocking protrusion portion into the interlocking recess portion of the connector housing-locking means by way of press-fitting after to combine them. Thus, it has a rigid structure such that the connector housings do not shift relatively to each other even when an external force is applied to the inserting-side connector portion.

Accordingly, in fitting and connecting such an inserting-side connector portion into the inserting-side connector portion-receiving compartment of the receiving-side connector portion, it is desirable to insert and fit the inserting-side connector portion into the inserting-side connector portion-receiving compartment of the receiving-side connector portion in a proper posture such that the axis of the inserting-side connector portion and the axis of the receiving-side connector portion are aligned to be parallel to each other. However, in the work of fitting and connecting the connector, the inserting-side connector portion is often inserted into the receiving-side connector portion in an inclined state, and it is difficult to insert the inserting-side connector portion in a proper posture. Since the inserting-side connector portion has a rigid structure, its insertion accordingly requires a great force. In addition to this, there is a risk of causing poor electrical connection in the connector because the insertion might become impossible halfway or the connector housings or the connecting terminals might be deformed by an excessive force applied thereto.

Moreover, in many cases, the thickness of each of the connector housings does not become a uniform dimension since there is a dimensional tolerance. In particular, in case of the minimum value within the dimensional tolerance, pitch between the connecting terminals when the connector housings which are stacked sometimes becomes smaller than a predetermined pitch, and thus does not match the pitch of the connection pins of the circuit-forming unit in the mating receiving-side connector portion. Thus, there is also a risk of causing poor electrical connection in the connector since the connection pins of the receiving-side connector portion cannot be properly inserted into the connecting terminals of the inserting-side connector portion when inserting the inserting-side connector portion into the receiving-side connector portion.

Next, a third prior art and its problems to be solved are discussed below.

A fifth prior-art joint connector, which relates to the third prior art, is provided with: an inserting-side connector portion (stacked connector) in which connector housings, each having a plurality of terminal-accommodating compartments juxtaposed in a single layer for accommodating female terminals, are stacked into a plurality of stages and are combined by a connector-coupling means; and a receiving-side connector portion (electrical connection box) having a connector case (upper case) for accommodating the inserting-side connector portion inserted from one opening thereof, and a plurality of male terminals protruding in the connector case and connected to the female terminals of the connector housing in the inserting-side connector portion (see Japanese Unexamined Patent Publication No. 2001-39239).

Meanwhile, FIG. 6 shows an inserting-side connector portion 601 provided with connector housings 603, each having a plurality of terminal-accommodating compartments 602 juxtaposed in a single layer for accommodating female terminals (not shown), are stacked into three stages (see FIG. 6

(A)), and these connector housings 603 are each combined by engaging an engagement recess portion 605 with an engaging protruding portion 606 of a connector-coupling means 604 (see FIG. 6 (B)). In addition, an upper face of a cover 607 attached above the connector housing 603 stacked in the uppermost stage of the inserting-side connector portion 601 is provided with a locking arm 609 of a connector-locking means 608 for locking the inserting-side connector portion 601 and the receiving-side connector portion with each other when the inserting-side connector portion 601 is inserted into the receiving-side connector portion (not shown) On the upper face of the locking arm, an engaging protrusion 610 is protruded so that it engages with the engagement recess portion (not shown) provided on the upper wall of the connector case in the receiving-side connector portion. Reference character W denotes electric wires constituting a wire harness, and their terminals are connected to the female terminals accommodated in the terminal-accommodating compartments 602 of the connector housings 603 (see Japanese Unexamined Utility Model Publication No. 5-65073).

The problems to be solved in the above-described third prior art are as follows.

In the fifth prior-art joint connector, the connector-locking means 608 for locking the inserting-side connector portion 601 and the receiving-side connector portion with each other is provided at a location in the uppermost end side so that it locks the uppermost portion of the inserting-side connector portion and the uppermost portion of the connector case in the receiving-side connector portion.

Meanwhile, in the connector-coupling means 604 used for combining the connector housings 603, backlash (play gap or clearance) is not easily caused between the engagement recess portion 605 and the engaging protruding portion 606 since the engaging force in the direction of stacking the connector housings 603 is large; however, backlash is easily caused between the engagement recess portion 605 and the engaging protruding portion 606 since the engaging force in the direction along the surfaces of the connector housings 603, that is, in the direction in which the connector housings 603 are pulled out of the receiving-side connector portion is smaller than that in the stacking direction.

Accordingly, if a tensile force is applied to the electric wires W in such a manner as to pull out the connector housings 603 from the mating receiving-side connector portion, the backlash is accumulated more as the number of stacked stages of the connector housings 603 increases, and the connector housing 603 located in the lower shifts in the direction in which it is pulled out of the receiving-side connector portion. As a result, the connector housings 603 may be lifted and loosened, and the fitting between the female terminals of the inserting-side connector portion-side and the male terminals of the receiving-side connector portion-side can become insufficient. This degrades the connection state between both connector portions, and thus, there is a risk of degrading performance and reliability of the joint connector.

Next, a fourth prior art and its problems to be solved are discussed below.

A sixth prior-art joint connector in this prior art is generally provided with: a connection case in which an external connector for accommodating a plurality of female terminals is inserted; and a circuit-forming unit mounted to a base wall of the connection case and having a plurality of male terminals protruding in the connection case through a plurality of male terminal piercing holes formed in the base wall and a holder composed of a circuit board for supporting the male terminals. The male terminals of the circuit-forming unit are inserted into the female terminals of the external connector inserted in the connection case, whereby the joint connector is connected to the external connector (see Japanese Unexamined Patent Publication No. 2001-39239).

The problems to be solved in the above-described fourth prior art are as follows.

The joint connector of this type, used for wire harnesses, has had an increasing number of terminals in recent years, and the number of male terminals in the circuit-forming unit also tends to increase. As the number of male terminals increases, variations occur in dimensions and assembling accuracy of male terminals in the circuit-forming unit. This causes difficulty in smoothly passing these male terminals through male terminal piercing holes formed in the base wall of the connection case, making troubles in manufacturing (assembling) of the joint connector. In addition to this, there is a risk of degrading performance and quality of the joint connector when passing male terminals through male terminal piercing holes, as the male terminals may be deformed or damaged. For these reasons, the male terminal piercing holes formed in the base wall of the connection case are usually formed to have a bore diameter larger than the outer diameter of the male terminals with some margin so that the male terminals of the circuit-forming unit smoothly pass through the male terminal piercing holes.

When the bore diameter of the male terminal piercing holes is thus allowed to have some margin, it becomes easy to mount the circuit-forming unit to the base wall of the connection case. Nevertheless, this increases the clearance (gap) between the male terminals and the male terminal piercing holes, making it difficult to accurately position the circuit-forming unit against the base wall of the connection case. As a result, when mounting the circuit-forming unit to the base wall, the male terminals protruding in the connection case easily dislocate from predetermined locations, causing difficulty in aligning the male terminals and the female terminals when inserting the external connector into the joint connector; this may produce contact failures between both terminals.

In order to solve such a problem, a joint connector as shown in FIG. 7 is suggested and used. This joint connector is, as in the above-described connection box, provided with: a connection case 702 in which an external connector 701 for accommodating a plurality of female terminals is inserted; and a circuit-forming unit 705 mounted to a base wall 703 of the connection case 702, and having a plurality of male terminals 706 protruding in the connection case 702 through a plurality of male terminal piercing holes 704 formed in the base wall 703 and a holder 707 composed of a circuit board for supporting the male terminals. The male terminals 706 of the circuit-forming unit 705 are inserted into the female terminals of the external connector 701 inserted in the connection case 702, whereby the joint connector is connected to the external connector 701. In this configuration, a positioning protrusion 708 is protruded in the central area of the base wall 703 of the connection case 702, and in the holder 707 of the circuit-forming unit 705, a positioning hole 709 is formed, into which the positioning protrusion 708 is inserted with a small clearance so as to be attached and fitted thereto. Thus, when mounting the circuit-forming unit 705 to the base wall 703 of the connection case 702, the positioning protrusion 708 of the base wall 703 side is attached and fitted to the positioning hole 709 of the circuit-forming unit 705 side, whereby the circuit-forming unit is positioned so that the male terminals 706 protruding in the connection case 702 are held in predetermined locations without being dislocated.

In the seventh prior-art joint connector of this type, the positioning protrusion 708 is attached and fitted to the positioning hole 709 with no clearance, and therefore, when mounting the circuit-forming unit 705 to the base wall 703 of the connection case 702, the circuit-forming unit can be accurately positioned. However, it is necessary to provide a space for providing the positioning protrusion 708 on the base wall 703 of the connection case 702 in a protruding manner, and a space for forming the positioning hole 709 in the holder 707 of the circuit-forming unit 705 exclusively. In addition, the shape of the circuit pattern of the holder 707 needs to be wired in such a manner that it extends outwardly to get around the positioning hole 709. As a result, a problem arises in that the shapes of the connection case 702 and the circuit-forming unit 705 become large, increasing the size of the joint connector; moreover, since the shapes of the connection case 702 and the circuit-forming unit 705 becomes large and the positioning protrusion 708 is provided in a protruding manner, the material cost increases, and accordingly the cost of the connector increases.

Next, a fifth prior art and its problems to be solved are discussed below.

An eighth prior-art joint connector is discussed as a joint connector related to a fifth prior art. The eighth prior-art joint connector is provided with: a plurality of connector housings each having a plurality of terminal-accommodating compartments juxtaposed therein for accommodating connecting terminals connected to electric wires constituting a wire harness or the like by crimping or the like; a connector housing-locking means composed of an interlocking recess portion and an interlocking protrusion portion for stacking and combining the connector housings into a plurality of stages, provided respectively at a front and a back of each of the connector housings on both side portions thereof, so that an interlocking recess portion or an interlocking protrusion portion provided on one of the connector housings is engaged with an interlocking protrusion portion or an interlocking recess portion provided on another one of the connector housings that is stacked thereon; and an interlocking protrusion protruding on the other stacked connector housing so as to engage with the connecting terminal accommodated in the terminal-accommodating compartment of the one of the connector housings, for preventing disengagement of the connecting terminal and detecting an incomplete insertion.

In the connector housing-locking means that is provided at the front of the connector housing on both side portions thereof, its interlocking recess portion is formed of a recessed groove opened upwardly above the connector housing, and having an extended-diameter stepped portion in its lower inner bottom portion, whereas its interlocking protrusion portion is a linear interlocking piece protruding downwardly below the connector housing and having a claw for engaging with the extended-diameter stepped portion at its fore-end.

In the connector housing-locking means that is provided at the rear of the connector housing on both side portions thereof, as opposed to the connector housing-locking means provided at the front, the interlocking recess portion formed of a recessed groove opened downwardly below the connector housing and having an extended-diameter stepped portion having its upper inner bottom portion, whereas the interlocking protrusion portion is formed of a linear interlocking piece protruding upwardly above the connector housing and having a claw for engaging with the extended-diameter stepped portion of the interlocking recess portion at its fore-end (see Japanese Unexamined Patent Publication No. 2002-246127).

The problems to be solved in the above-described fifth prior art are as follows.

The eighth prior-art joint connector is generally configured to be assembled by stacking the connector housings into a plurality of stages and combing them by the connector housing-locking means in a state where the connecting terminals are accommodated in the terminal-accommodating compartments of the connector housings. Also, when the connector housings are stacked, by the configuration of the connector housing-locking means, the connector housings are stacked by shifting and overlaying them in a direction perpendicular to the inserting direction of the connecting terminals. If the connecting terminals are accommodated in the terminal-accommodating compartments of the connector housings in an incompletely inserted state, the interlocking protrusion protruding on a connector housing to be stacked hits the wall or the like of the connecting terminal and does not engage with the engaging portion. This can be utilized to detect an incompletely inserted state of the connecting terminals.

The connector housings are generally formed by plastic molding and therefore have the advantages of being lightweight, inexpensive, and easy to manufacture; however, their strength is not sufficient, so they can be easily deformed by an applied external force. For this reason, even if such inconvenience arises that the connecting terminals are accommodated in the terminal-accommodating compartments in an incompletely inserted state and the interlocking protrusion does not engage with the connecting terminals, the interlocking protrusion tends to slide aside by the partial deformation of the terminal-accommodating compartments, which is the same condition as if the interlocking protrusion engages with the connecting terminals. Thus, a proper detection for the incomplete insertion of the connecting terminals becomes impracticable, and there is a risk of combining the stacked connector housings in the condition where the connecting terminals are accommodated in terminal-accommodating compartments in an incompletely inserted state. This causes a problem of degrading performance and reliability of the connector.

In order to resolve such a problem, it is conceivable that by increasing the wall thickness of the terminal-accommodating compartment in the connector housing and thereby increasing its mechanical strength, deformation of the connector housings in stacking the connector housings is prevented and an incompletely inserted state of the connecting terminals is reliably detected to prevent combining a connector housing with a connecting terminal being in an incompletely inserted state. Nevertheless, this causes the connector housing to have a larger outer dimension, and therefore, as the number of stacked stages of connector housings increases, the size of the joint connector accordingly becomes larger, causing inconvenience in assembling it in various equipment or the like, which is another problem.

SUMMARY OF THE INVENTION

It is an object of the present invention to provide a joint connector that is inexpensive and improves working efficiency in electric wire connection.

It is another object of the present invention to provide a joint connector that solves the problem in the second prior art, which makes it possible to fit and connect its inserting-side connector portion and receiving-side connector portion together easily and to prevent poor electrical connection in the connector reliably.

It is further another object of the present invention to provide a joint connector that solves the problem in the third prior art, which makes it possible to maintain good connecting state between its inserting-side connector portion and receiving-side connector portion even with an increased number of stacked stages of the connector housings in its inserting-side connector portion, and to improve performance and reliability of the joint connector.

It is still another object of the present invention to provide a joint connector that solves the problem in the fourth prior art, which makes it possible to position its circuit-forming unit accurately in mounting the circuit-forming unit to the base wall of the connection case without additionally providing a positioning protrusion and a positioning hole so that poor connections can be prevented in the joint connector and its performance and reliability be improved, and to achieve size and weight reduction and cost reduction of the joint connector.

It is yet another object of the present invention to provide a joint connector that solves the problem in the fifth prior art, which makes it possible to straighten connecting terminals in its terminal-accommodating compartment in a desired normal inserted state quickly even if the connecting terminals are accommodated in its terminal-accommodating compartment in an incompletely inserted state when stacking connector housings, thus improving performance and reliability in connection, and to be small-sized and be assembled in various equipment or the like with high efficiency, without causing cumbersome work.

In order to accomplish the foregoing and other objects, the present invention provides, in accordance with a first aspect, a joint connector in which a male connector and a female connector are fit, comprising: a male connector having a circuit board and male terminals provided on the circuit board at a predetermined interval and standing in one direction and in a direction intersecting therewith, the male terminals being conductively connected selectively with each other by a circuit pattern on the circuit board; and a female connector in which connector housings each having a plurality of female terminals are stacked.

Because the male connector is composed of a plurality of male terminals provided on a circuit board and standing in a matrix form and the circuit pattern for selectively connecting the male connectors selectively with each other is formed on the circuit board, branching of electric wires can be freely carried out merely by fitting the male connector to the female connector. Therefore, it is not required to perform such additional and cumbersome operations as bending the terminals and wiring special electric wires for connections in the connector in connecting the connector as were necessary in conventional joint connectors, and the branching operation of wire harnesses can be carried out efficiently.

Moreover, an excellent heat dissipation is attained since a circuit board is used in a portion of the male connector, and consequently, high-density implementation of the terminals and size reduction in the connector itself can be achieved.

In accordance with a second aspect, the present invention also provides a male connector for a joint connector in which a male connector and a female connector are fit, comprising: a circuit board; and male terminals provided on the circuit board at a predetermined interval and standing in one direction and in a direction intersecting therewith; wherein the male terminals are conductively connected selectively with each other by the circuit pattern on the circuit board, and the male terminals are interlockable with female terminals in a female connector in which one-stage parallel-line-shaped connector housings each having female terminals inserted and interlocked therein are stacked.

A joint connector in accordance with a third aspect of the invention is the joint connector as set forth in the first aspect, wherein the circuit pattern on the circuit board is composed of a copper foil circuit, and the copper foil circuit is formed using a rolled material.

By forming the copper foil circuit using a copper plate of a rolled material, it is possible to support a large electric current, and further size reduction of the joint connector itself can be achieved together with the use of the circuit board in a portion of the male connector.

A male connector for a joint connector in accordance with a fourth aspect of the invention is the male connector for a joint connector as set forth in the second aspect, wherein the circuit pattern on the circuit board is composed of a copper foil circuit, and the copper foil circuit is formed using a rolled material.

In accordance with a fifth aspect, the present invention provides a joint connector including an inserting-side connector portion and a receiving-side connector portion in which the inserting-side connector portion is inserted, the inserting-side connector portion and the receiving-side connector portion being fitted and connected to each other, comprising: an inserting-side connector portion including a plurality of connector housings each having a plurality of terminal-accommodating compartments juxtaposed along a lateral direction for accommodating connecting terminals, an interlocking recess portion provided on at least one of the connector housings, an interlocking protrusion portion interlocking therewith, and a connector housing-locking means for combining the connector housings stacked into a plurality of stages; and a receiving-side connector portion including a connector case having an inserting-side connector portion-receiving compartment for receiving and holding the inserting-side connector portion, and a circuit-forming unit being mounted to the connector case and having a plurality of connection pins protruding in the inserting-side connector portion-receiving compartment to be connected with the connecting terminals in the inserting-side connector portion; wherein a clearance is provided between respective interlocking surfaces of an interlocking recess portion and an interlocking protrusion portion constituting the connector housing-locking means so that the interlocking protrusion portion is loosely interlocked with the interlocking recess portion, whereby the plurality of connector housings are loosely combined so as to be shiftable relative to each other.

Thus, the stacked connector housings, which constitute the inserting-side connector portion, are loosely combined to be shiftable relative to each other, forming a flexible structure capable of expansion, contraction, slide, bend, and so forth, like an accordion. For this reason, even when the inserting-side connector portion is inserted into the receiving-side connector portion in an inclined state, the connector housings shift relative to each other quickly, changing their shape, and the inserting-side connector portion is aligned with the receiving-side connector portion to be quickly straightened in a proper posture. Therefore, insertion of the inserting-side connector portion does not require a great force and, in addition, the insertion does not become difficult midway, making the insertion of the inserting-side connector portion easy. Moreover, no excessive force is applied to the connector housings and the connecting terminals, so these are not easily deformed.

Moreover, even if the pitch between the connecting terminals when the connector housings have been stacked deviates from the pitch between the connection pins of the receiving-side connector portion because of the dimensional tolerance of the connector housings, the connector housings expand one another in the stacking direction and it becomes easy to match the pitch between the connecting terminals with the pitch between the connection pins of the receiving-side connector portion. Consequently, the connection pins of the receiving-side connector portion can be inserted smoothly and not forcibly into the connecting terminals of the inserting-side connector portion when the inserting-side connector portion is inserted into the receiving-side connector portion. As a result, fitting and connection between the inserting-side connector portion and the receiving-side connector portion become easy, and the connector's poor electrical connection can be prevented reliably.

A joint connector in accordance with a sixth aspect of the invention is the joint connector as set forth in the fifth aspect, wherein a plurality of protruding guide portions for forming a guide groove in which a side portion of a connector housing in the inserting-side connector portion are juxtaposed on an inner side wall of the inserting-side connector portion-receiving compartment in the receiving-side connector portion, and a width of the protruding guide portions gradually narrows toward an entrance of the inserting-side connector portion-receiving compartments while a width of the guide groove gradually widens.

With this configuration, when inserting the inserting-side connector portion into the receiving-side connector portion, the side portions of the connector housings in the inserting-side connector portion are guided by the guide grooves of the receiving-side connector portion, the entrances of which are widened. Therefore, the inserting-side connector portion is not likely to be inserted in an inclined state against the receiving-side connector portion, and the inserting-side connector portion is easily inserted in a proper posture aligned with the receiving-side connector portion; thus, both of the connector portions and can be more smoothly fitted and connected to each other.

A joint connector in accordance with a seventh aspect of the invention is the joint connector as set forth in the fifth aspect, wherein a lance is provided on one wall of each of the terminal-accommodating compartments in each of the connector housings in the inserting-side connector portion, the lance having a straddle structure in which its base line end is supported by the wall though a pair of slits formed in a longitudinal direction of the terminal-accommodating compartments and being composed of an elastic interlocking piece in which a thick-walled built-up portion is formed on its back side and an interlocking protrusion interlocked with the connecting terminal is formed on its inner side, and a lance-receiving portion is provided at a corresponding location on another wall opposite to the lance, for receiving the built-up portion of the lance provided on a terminal-accommodating compartment in an adjacent connector housing when inserting the connecting terminals into the terminal-accommodating compartments, to permit displacement of the lance bending outwardly.

With this configuration, the elastic interlocking piece constituting the lance can attain strong support since it has a straddle structure even in cases where the wall thickness of the terminal-accommodating compartments in the connector housings of the inserting-side connector portion is reduced. In addition, since the built-up portion is provided and the strength becomes greater with the reinforcement, a retention force for the connecting terminals can be sufficiently ensured. Therefore, it is possible to reduce the wall thickness of the terminal-accommodating compartments and accordingly make the connector housings thin, so the height of the inserting-side connector portion in which the connector housings are stacked becomes small, thus reducing the size of the joint connector. Additionally, the pitch between the connecting terminals along the stacking direction becomes small, minimizing wasted spaces.

A joint connector in accordance with an eighth aspect of the invention is the joint connector as set forth in the seventh aspect, wherein a double interlocking rib for the connecting terminals is protruded on an outer side of the other wall located rearward of the lance provided on each of the terminal-accommodating compartments in each of the connector housing in an inserting-side connector portion, and an interlocking hole is provided at a corresponding location to the double interlocking rib on the one wall, for interlocking with a double interlocking rib protruding on a terminal-accommodating compartment of an adjacent connector housing.

With this configuration, the connecting terminals accommodated in the terminal-accommodating compartments in the connector housings in the inserting-side connector portion are interlocked doubly with the double interlocking rib and the lance. Therefore, disconnection of the connecting terminals from the terminal-accommodating compartments can be prevented more reliably.

When the connecting terminal is not inserted deeply to the predetermined location but is in an unfinished, incompletely inserted state in inserting a connecting terminal into a terminal-accommodating compartment, the fore-end of the double interlocking rib collides with the rear end of a connecting terminal, preventing insertion of the double interlocking rib even if the double interlocking rib protruding on the terminal-accommodating compartment of one of the connector housings is attempted to be inserted into the interlocking hole provided in the terminal-accommodating compartment of an adjacent one of the connector housings when stacking the connector housings to form a plurality of stages. For this reason, the double interlocking rib cannot be inserted into the interlocking hole to a predetermined depth, making the stacking of the connector housings difficult. In view of this, this configuration makes it easy to detect an incompletely inserted state of the connecting terminals in the terminal-accommodating compartments without using complex mechanisms.

In accordance with a ninth aspect, the present invention provides a joint connector in which an inserting-side connector portion and a receiving-side connector portion are locked with each other by a connector-locking means, comprising: an inserting-side connector portion having a plurality of connector housings, in each of which a plurality of terminal-accommodating compartments for accommodating female terminals are juxtaposed in a single layer, the connector housings stacked in a plurality of stages and combined; and a receiving-side connector portion having a connector case in which the inserting-side connector portion is inserted, and a plurality of male terminals protruding in the connector case and being connected to the female terminals of the connector housings in the inserting-side connector portion; wherein the connector-locking means is provided at a lateral side location when viewed from the inserting direction so as to lock a side portion of the connector housing in the inserting-side connector portion and a side wall of the connector case in the receiving-side connector portion.

Since the connector-locking means are provided at side positions of both connector portions, one or a plurality of lock supporting points for locking the connector housings vertically stacked into a plurality of stages shifts/shift from the uppermost end locations of both connector portions to arbitrary midway locations vertically, and the distance from the lock supporting points of the connector-locking means to free ends, such as the uppermost end and lowermost end locations of both connector portions, is shortened.

As a result, the number of connector housings stacked between the lock supporting point of the connector-locking means and the respective free ends becomes less, so that the accumulated amount of backlash caused between the connector housings is reduced, and the connector housings are prevented from shifting and loosening in the direction in which it is removed from the receiving-side connector portion due to the effect of the foregoing tensile force.

Therefore, even when the number of stacked stages of the connector housing is increased in the inserting-side connector portion, a good connecting state between the inserting-side connector portion and the receiving-side connector portion is maintained and the performance and reliability of the joint connector can be improved.

A joint connector in accordance with a tenth aspect of the invention is the joint connector as set forth in the ninth aspect, wherein the connector-locking means is provided at both side locations so as to lock both side portions of at least one of the connector housings in the inserting-side connector portion and both side walls of the connector case in the receiving-side connector portion.

With this configuration, even if a tensile force pulling the connector housings out of the receiving-side connector portion acts on the connector housings of the inserting-side connector portion, the connector housings are firmly held by the connector-locking means at both side ends and are stabilized and the joint connector becomes strong.

A joint connector in accordance with an eleventh aspect of the invention is the joint connector as set forth in the ninth aspect, wherein the connector-locking means comprises an engagement recess portion and an engaging claw portion composed of an elastic piece having at its fore-end a claw for engaging the engagement recess portion, the engagement recess portion being provided on a side portion of at least one of the connector housings in the inserting-side connector portion and the engaging claw portion being provided in a cantilevered fashion on a side wall of the connector case in the receiving-side connector portion.

With this configuration, the engaging operation in the connector-locking means becomes smooth and the engagement failure becomes infrequent, so connection of the inserting-side connector portion with the receiving-side connector portion is made more reliable. In addition, the engagement recess portions having generally a simple shape and structure is provided on the side portions of the connector housings in the inserting-side connector portion and the engaging claw portions having a more complex shape and structure than the engagement recess portion is provided on the connector case side of the receiving-side connector portion. As a consequence, manufacture of the joint connector becomes easier and less expensive, and in addition, size reduction can be achieved.

A joint connector in accordance with a twelfth aspect of the invention is the joint connector as set forth in the ninth aspect, wherein the connector-locking means comprises an engagement recess portion and an engaging claw portion composed of an elastic piece having at its fore-end a claw for engaging with the engagement recess portion and a curved tab diagonally extending outwardly with respect to the claw so as to be in a substantially Y-shape.

With this configuration, the claw of the engaging claw portion can be easily disengaged from the engagement recess portion by pressing the inclined inner side face of the curved tab in the engaging claw portion in the axis direction of the engaging claw portion, releasing the lock by the connector-locking means quickly. Consequently, the inserting-side connector portion can be easily pulled out and separated from the receiving-side connector portion without using complex and expensive jigs, and replacement, repair or the like for the connector can be made conveniently.

In accordance with a thirteenth aspect, the present invention provides a joint connector to be connected to an external connector, in which male terminals of a circuit-forming unit are inserted into female terminals of the external connector inserted in a connection case, comprising: a connection case into which the external connector for accommodating a plurality of female terminals; and a circuit-forming unit mounted to a base wall of the connection case, the circuit-forming unit having a plurality of male terminals protruding in the connection case through a plurality of male terminal piercing holes formed in the base wall, and a holder for supporting the male terminals, wherein among plurality of male terminal piercing holes formed in the base wall of the connection case, a fraction of the male terminal piercing holes is/are reference holes formed to be smaller than the other male terminal piercing holes.

With this configuration, the reference holes and the male terminals passing through the reference holes can be utilized as the conventional positioning hole and the conventional positioning protrusion, respectively. Consequently, when mounting the circuit-forming unit to the base wall of the connection case, the male terminals are passed through the reference holes at small clearances so that the circuit-forming unit can be quickly guided and held in a predetermined location. Thereby, the circuit-forming unit can be accurately positioned without additionally providing the positioning protrusions and the positioning holes that have been required conventionally. As a result, when the circuit-forming unit is mounted to the base wall, the male terminals protruding in the connection case do not deviate from predetermined locations, and when the external connector is inserted into the joint connector, the male terminals and the female terminals are aligned so that poor connections between both terminals can be prevented. Thus, performance and reliability of the joint connector can be improved.

Moreover, it becomes unnecessary to provide a space for providing the positioning protrusion in the base wall of the connection case and a space for forming the positioning hole in the holder of the circuit-forming unit, and in addition, it is unnecessary to form the shape of the circuit pattern on the holder so that the wiring greatly extends outwardly to get around the positioning hole. As a result, the shapes of the connection case and the circuit-forming unit become smaller, thus making the joint connector small and lightweight. Furthermore, since the shapes of the connection case and the circuit-forming unit become smaller and the positioning protrusion is eliminated. As a result, cost of the materials can be reduced and accordingly the cost of the joint connector can be reduced.

A joint connector in accordance with a fourteenth aspect of the invention is the joint connector as set forth in the thirteenth aspect, wherein the reference hole(s) is/are formed to be smaller out of the male terminal piercing holes formed in a central area of the base wall of the connection case.

With this configuration, the reference hole(s) is formed at a location in the vicinity of the center of gravity of the circuit-forming unit. Thus, the circuit-forming unit can be positioned in a well-balanced manner, and the circuit-forming unit can be easily mounted to the base wall of the connection case.

A joint connector in accordance with a fifteenth aspect of the invention is the joint connector as set forth in the thirteenth aspect, wherein the reference holes are formed to be smaller out of the male terminal piercing holes formed at a plurality of positions radially spaced from a central area of the base wall of the connection case.

With this configuration, even when the number of male terminals of the circuit-forming unit is increased, the circuit-forming unit can be positioned in a well-balanced manner and the accuracy in the positioning can be improved.

A joint connector in accordance with a sixteenth aspect of the invention is the joint connector as set forth in the fifteenth aspect, wherein the reference holes are male terminal piercing holes that are formed at a plurality of locations radially spaced from a central area of the base wall of the connection case, and are formed to be small by making an axis diametrical size with respect to a Y-axis of the male terminal piercing holes formed at locations spaced along an X-axis and an axis diametrical size with respect to the X-axis of the male terminal piercing holes formed at locations spaced along the Y-axis shorter than respective axis diametrical sizes with respect to corresponding axes of the male terminal piercing holes other than the reference holes.

With this configuration, the reference holes formed on the X-axis have a smaller clearance with the male terminals with respect to the Y-axis and the reference holes formed on the Y-axis have a smaller clearance with the male terminals with respect to the X-axis; therefore, it is possible to suppress side-to-side rattling (backlash) in the X-axis direction and the Y-axis direction of the male terminals inserted in the reference holes, enabling the circuit-forming unit to be positioned accurately.

In addition, because the axis diametrical size with respect to the X-axis of the reference holes formed on the X-axis and the axis diametrical size with respect to the Y-axis of the reference holes formed on the Y-axis are not different from the corresponding axis diametrical sizes of the foregoing other male terminal piercing holes, some margin is created in the clearance between the reference holes formed on the X-axis and the male terminals with respect to the X-axis and in the clearance between the reference holes formed on the Y-axis and the male terminals along the Y-axis. There are cases where pitch variations with respect to the X and Y axes between the male terminal piercing holes and the male terminals are accumulated as they are spaced farther from the respective central areas of the base wall of the connection case and the circuit-forming unit in the X and Y direction. In such cases, a positional deviation, i.e., a mismatch (misalignment) in their centers, is caused between opposing male terminal piercing holes and male terminals with respect to the X and Y axis directions. Even if this occurs, there is some margin in the clearances with respect to the X and Y directions as described above. For this reason, when mounting the circuit-forming unit to the base wall of the connection case, the male terminals of the circuit-forming unit can be passed through the reference holes not forcibly, and the mounting of the circuit-forming unit becomes easy, improving efficiency in manufacturing (assembling) the joint connector.

In accordance with a seventeenth aspect, the present invention provides a joint connector comprising: a plurality of connector housings each having a plurality of terminal-accommodating compartments juxtaposed therein for accommodating connecting terminals, wherein: each of the connector housing includes a connector housing-locking means composed of an interlocking recess portion and an interlocking protrusion portion provided respectively at a front and a rear of each of the connector housings on both side portions thereof, for stacking and combining the connector housings into a plurality of stages, such that an interlocking recess portion or an interlocking protrusion portion provided on one of the connector housings is respectively engaged with an interlocking protrusion portion or an interlocking recess portion provided on another one of the connector housings that is to be stacked; each of the connector housing further includes an interlocking protrusion protruding on the other connector housing so as to engage with the connecting terminals accommodated in the terminal-accommodating compartments of the one of the connector housings, for preventing disengagement of the connecting terminals and detecting an incomplete insertion; and in the connector housing-locking means provided at the front of each of the connector housings on both side portions thereof, the interlocking recess portion has a recessed groove opened in a lateral direction, and the interlocking protrusion portion has a lateral interlocking piece, extending forward and rearward, for being loosely inserted relatively into the recessed groove of the interlocking recess portion and engaging therewith, and a vertical interlocking piece capable of contacting the interlocking recess portion, the interlocking protrusion portion being formed in a substantially L shape by the lateral interlocking piece and the vertical interlocking piece.

With this configuration, in stacking the connector housings, even when connecting terminals are accommodated in terminal-accommodating compartments in an incompletely inserted state, those connecting terminals can be quickly straightened in a desired normal inserted state to accommodate them in a predetermined location. Thus, connection performance and reliability in the connector can be improved, and in addition, being small-sized, being assembled for various equipments can be carried out efficiently without cumbersome work.

A joint connector in accordance with an eighteenth aspect of the invention is the joint connector as set forth in the seventeenth aspect, wherein a guiding recessed groove and a guide rib fitted thereto, for restricting a relative shift between stacked connector housings, are provided between the connector housing-locking means provided at the front and rear of the connector housing on both side portions thereof, and respective rear portion of the guiding recessed groove and the guide rib are formed into an inclined surface widening toward their bottom.

With this configuration, relative shifting between the stacked and combined connector housings is more reliably constrained by the guide ribs, and in addition, backlash is suppressed by the contact between the inclined surfaces of the guiding recessed groove and the guide rib. Moreover, when stacking a connector housing from an inclined posture, the guide ribs do not hit the inner periphery of the guiding recessed grooves, and they can be smoothly fitted; thus, workability in stacking the connector housings can be improved.

A joint connector in accordance with a nineteenth aspect of the invention is the joint connector as set forth in the seventeenth aspect, wherein a terminal-guiding slope portion projecting downwardly is provided on a lower wall near an terminal insertion hole in the terminal-accommodating compartment in the connector housing, and a corresponding upper portion of both side walls near the terminal insertion hole is provided with an undercut for engaging with the terminal-guiding slope portion.

With this configuration, the connecting terminal can be easily inserted into the terminal-accommodating compartment of the connector housing by being guided by the terminal-guiding slope portion at the terminal insertion hole without causing an electric wire to be compress-buckled or bent-deformed, even when it is connected to such an electric wire easily bent-deformed or compress-buckled due to its small size and diameter.

A joint connector in accordance with a twentieth aspect of the invention is the joint connector as set forth in the seventeenth aspect, wherein a rear portion of the terminal-accommodating compartment of the connector housing is opened upwardly, a stopper member is provided on upper portions of both side walls of the terminal-accommodating compartment above the terminal insertion hole to cover the opening above the terminal insertion hole, and a corresponding lower portion of the terminal-accommodating compartment on both side walls is provided with a cut-out for receiving the stopper member.

With this configuration, the electric wire is not lifted in an upward direction even when a tensile force acts on the electric wire in an upward direction after the connecting terminal are inserted and accommodated in the terminal-accommodating compartment, and the rear side of the lance and the connecting terminal in the connector housing can be prevented from breakage. Furthermore, the stopper member restricts the inserting direction of the connecting terminal from the terminal insertion hole. Therefore, it becomes possible to detect upside-down insertion of the connecting terminal into the terminal-accommodating compartment quickly, and thus the connecting terminal can be prevented from being accommodated in the terminal-accommodating compartment upside down.

BRIEF DESCRIPTION OF THE DRAWINGS

FIG. 16 shows a connector housing constituting an inserting-side connector portion of FIG. 14, wherein

FIG. 17 shows the connector housing of FIG. 16, wherein

FIG. 19 shows a lance portion of a connector housing, wherein

FIG. 20 shows an interlocking protrusion portion of a lance provided in a terminal accommodating compartment of a connector housing, wherein FIG. 20A is a longitudinal sectional view and FIG. 20B is a transverse cross-sectional view;

FIG. 21 a longitudinal sectional view showing a condition before a double interlocking rib is interlocked, which protrudes in a terminal accommodating compartment of a connector housing adjacent to an interlocking hole of a terminal accommodating compartment of a connector housing that accommodates a connecting terminal in a condition before it is interlocked;

FIG. 25 shows an inserting-side connector portion made up of connector housings stacked and combined, wherein

FIG. 27 shows a receiving-side connector portion, wherein

FIG. 29 shows the way in which the inserting-side connector portion is inserted into the receiving-side connector portion, wherein

DETAILED DESCRIPTION OF THE PREFERRED EMBODIMENTS

Hereinbelow, joint connectors according to first through fifth embodiments of the present invention are described with reference to the drawings.

Figure 1:
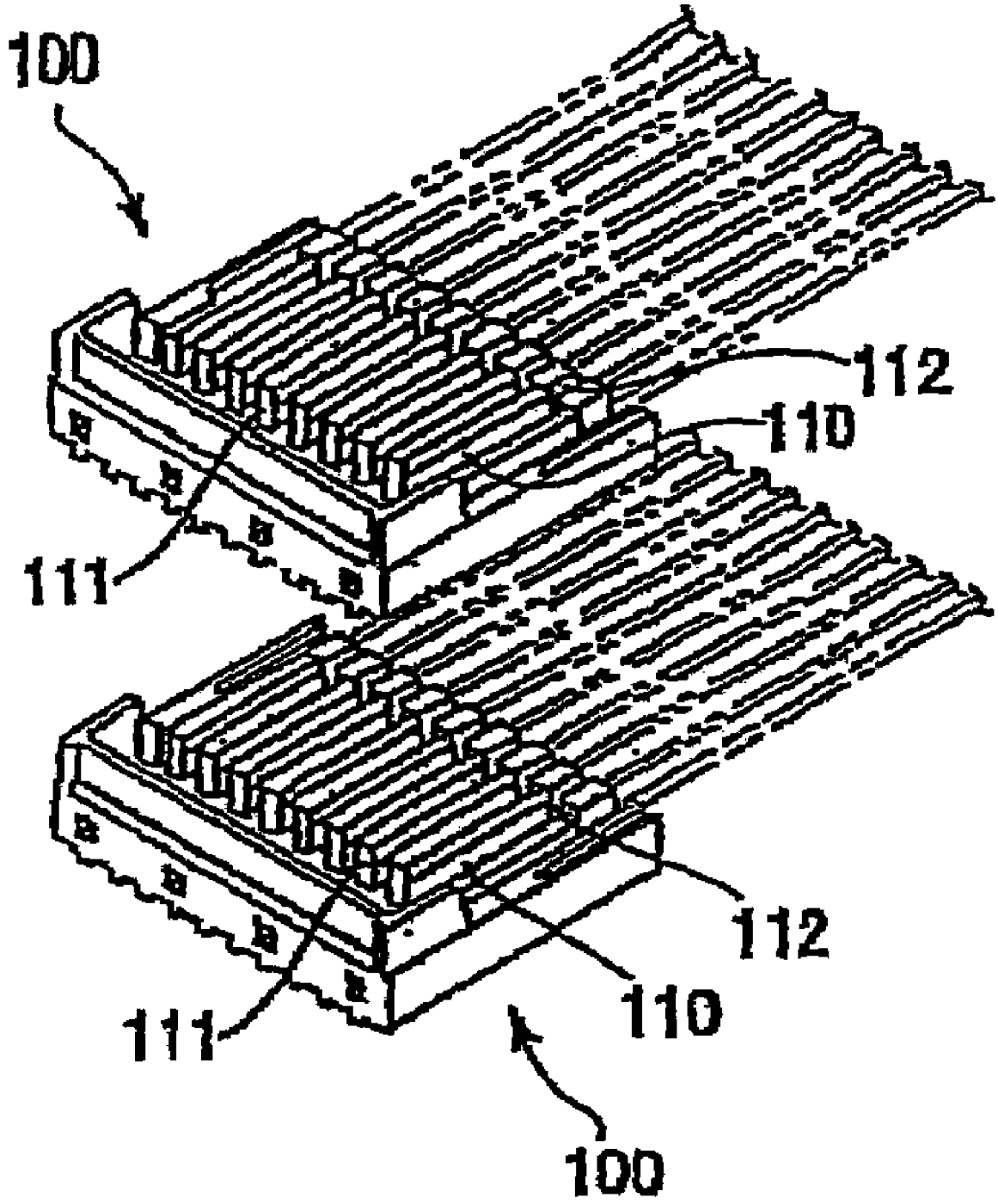
FIG. 1 Prior Art
FIG. 1 is a perspective view showing a first prior-art joint connector concerning the present invention.
Figure 2A:
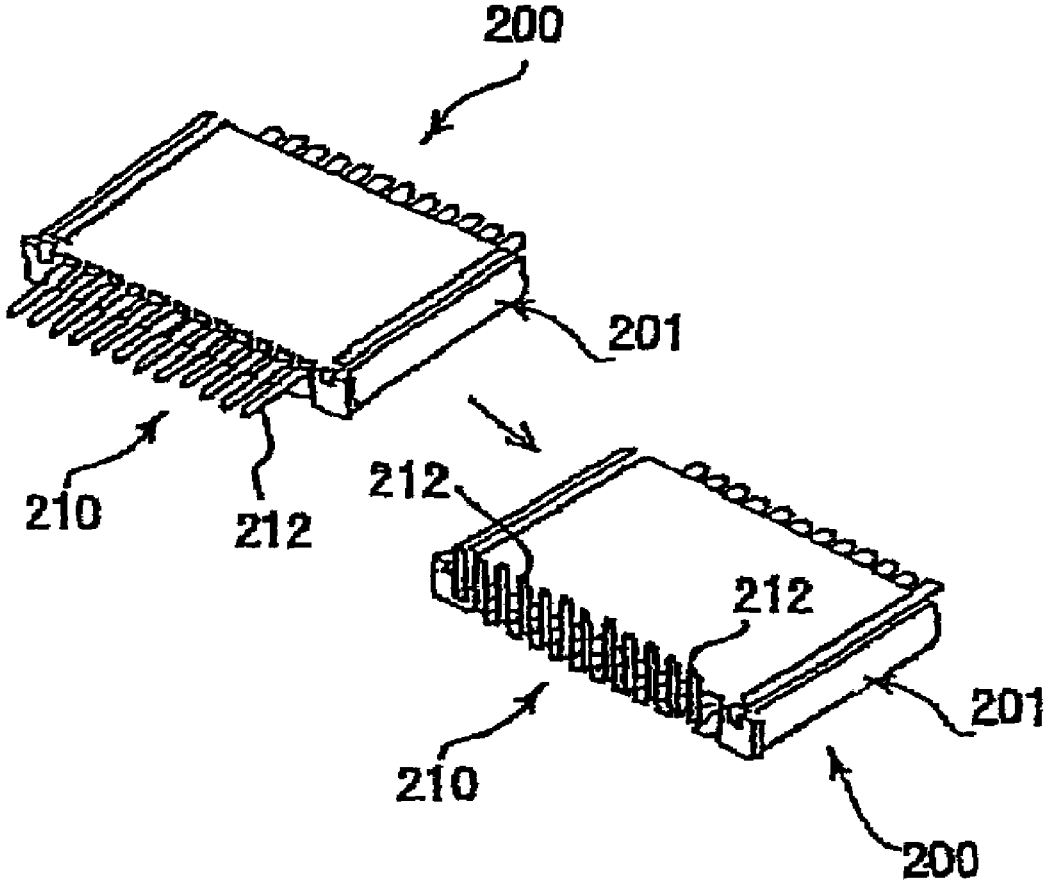
FIG. 2A Prior Art
FIG. 2 shows a perspective view (FIG. 2A) showing a process step for forming a male terminal of a second prior-art joint connector, which is different from the one shown in FIG. 1, and a perspective view (FIG. 2B) showing a step of assembling the joint connector.
Figure 2B:
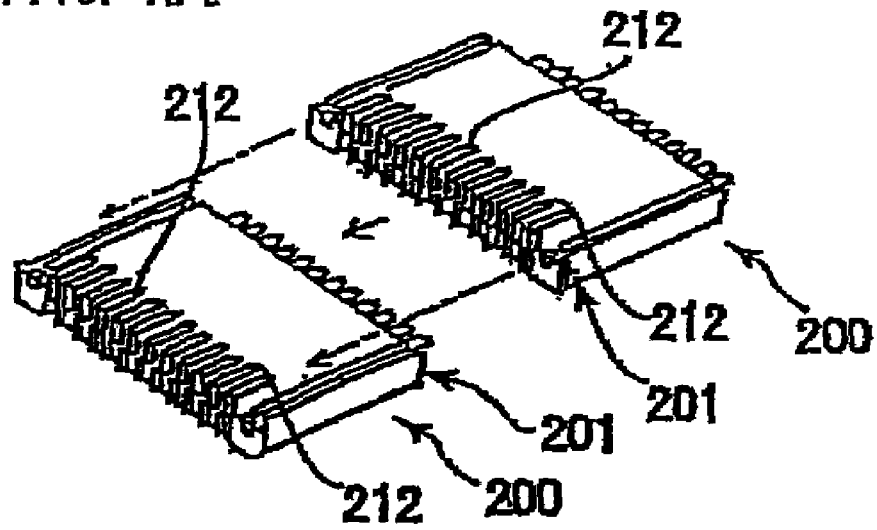
FIG. 2B Prior Art
Figure 3:
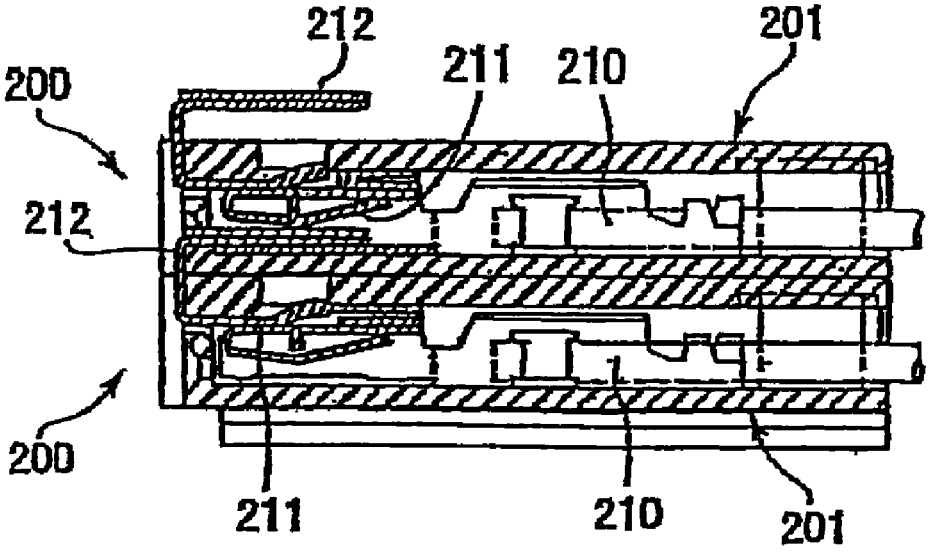
FIG. 3 Prior Art
FIG. 3 is a cross-sectional view showing the conventional joint connector of FIG. 2 in a stacked condition.
Figure 4:
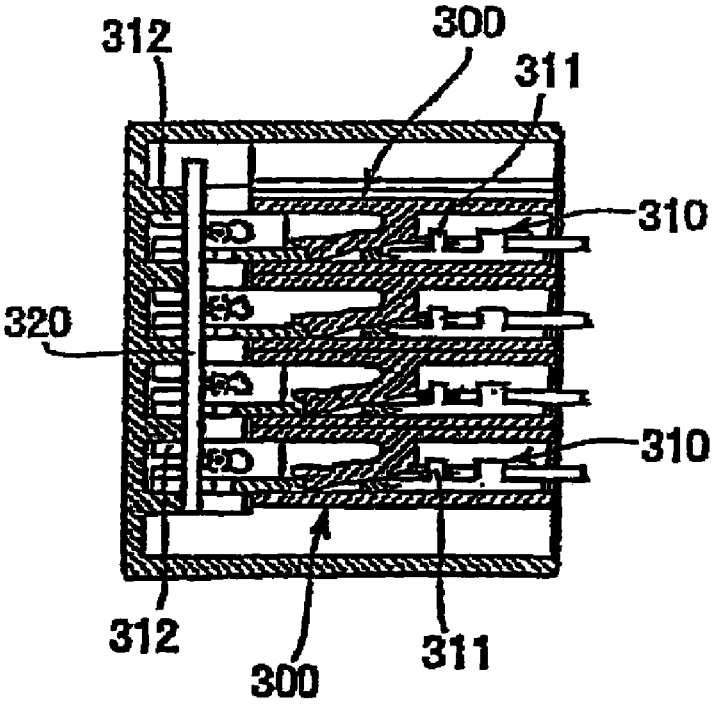
FIG. 4 Prior Art
FIG. 4 is a cross-sectional view taken along a direction of terminals' stacking of a third prior-art joint connector, which is different from those shown in FIGS. 1 and 2.
Figure 5:
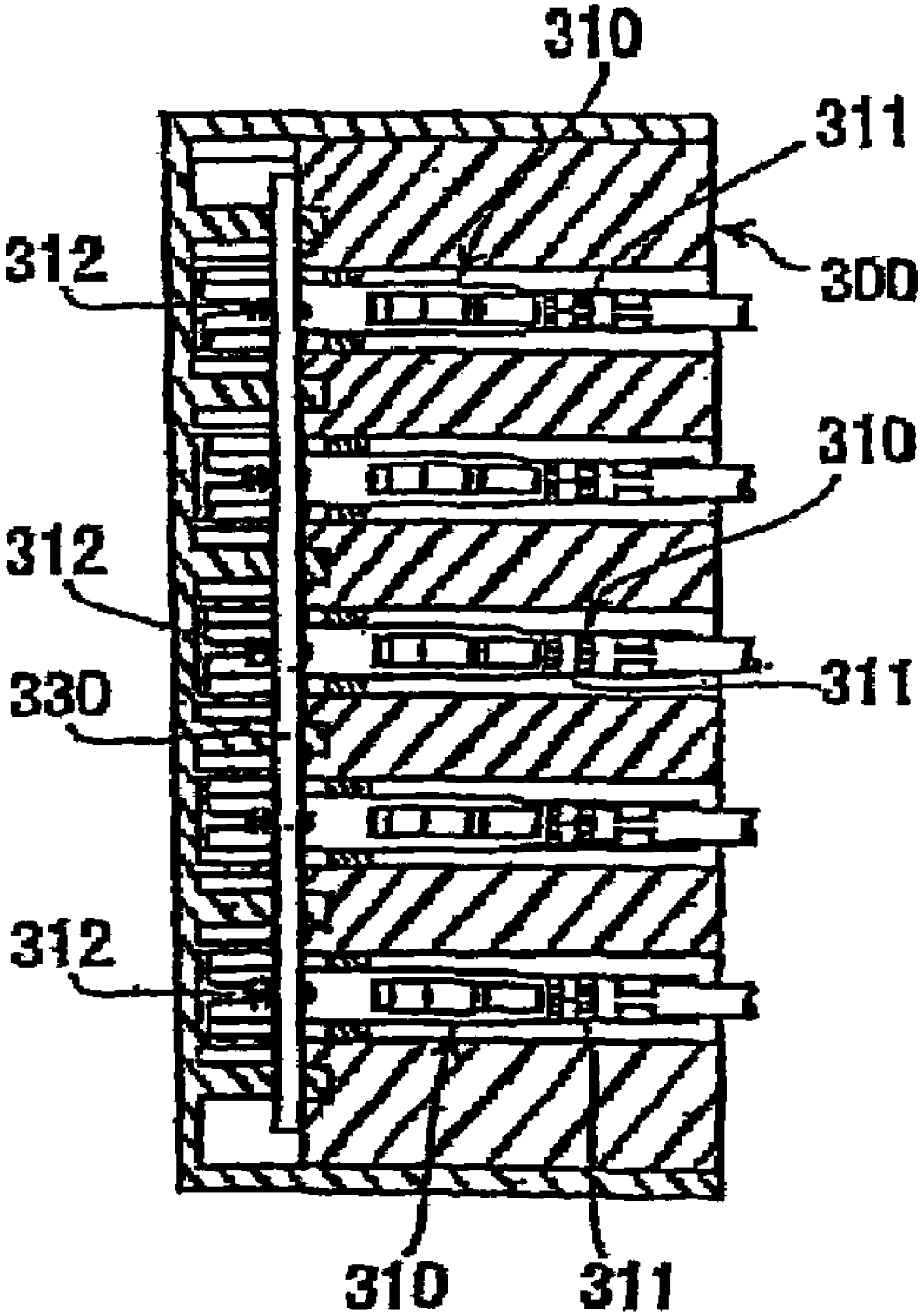
FIG. 5 Prior Art
FIG. 5 is a cross-sectional view taken along a direction of terminals' juxtaposition of the prior-art joint connector shown in FIG. 4.
Figure 6:
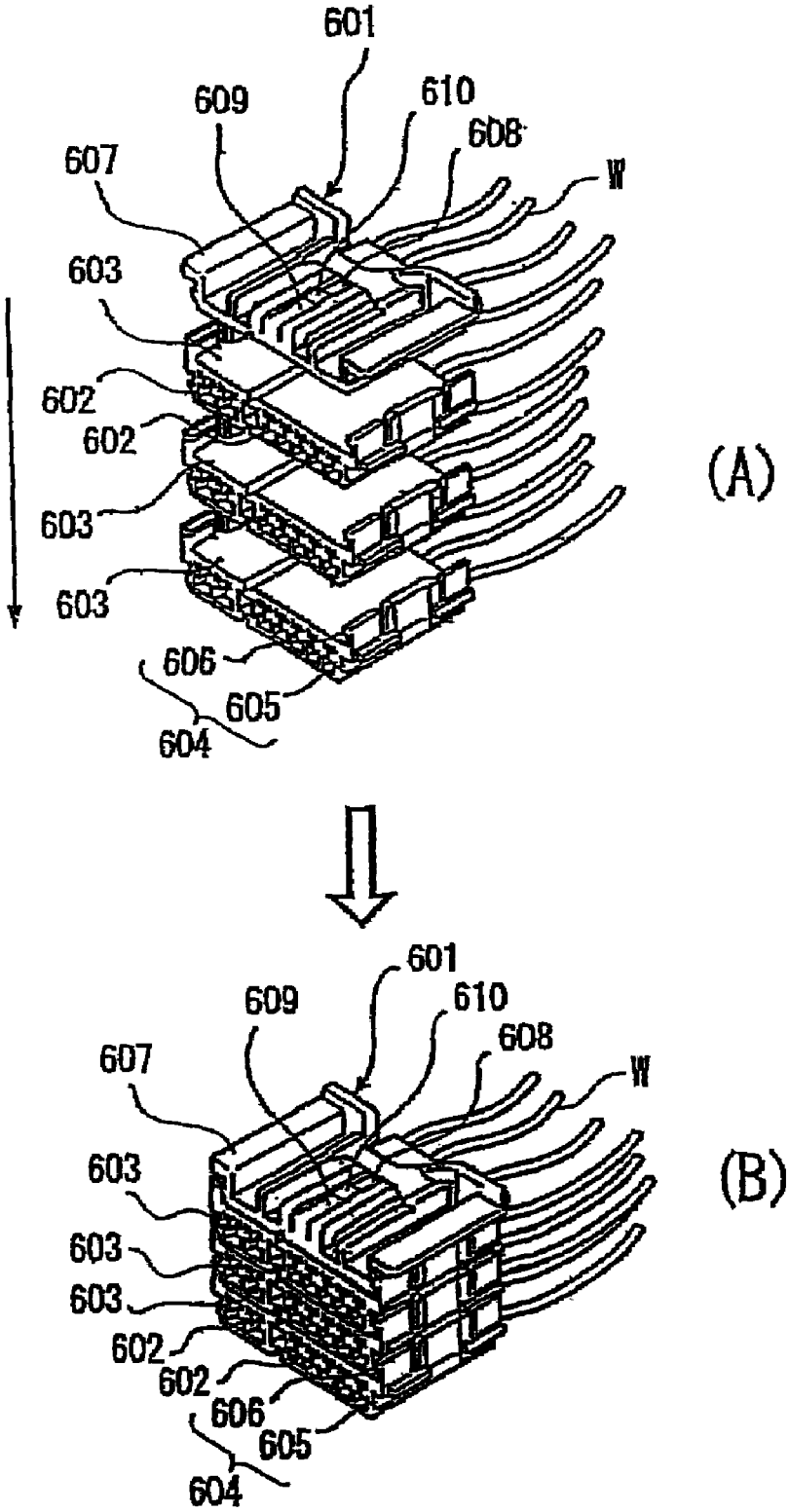
FIG. 6 Prior Art
FIG. 6 show an inserting-side connector portion of a fourth prior-art joint connector, wherein (A) is a perspective view showing connector housings in a condition before they are stacked and (B) is a perspective view showing the connector housings in a condition in which they are stacked and combined.
Figure 7:
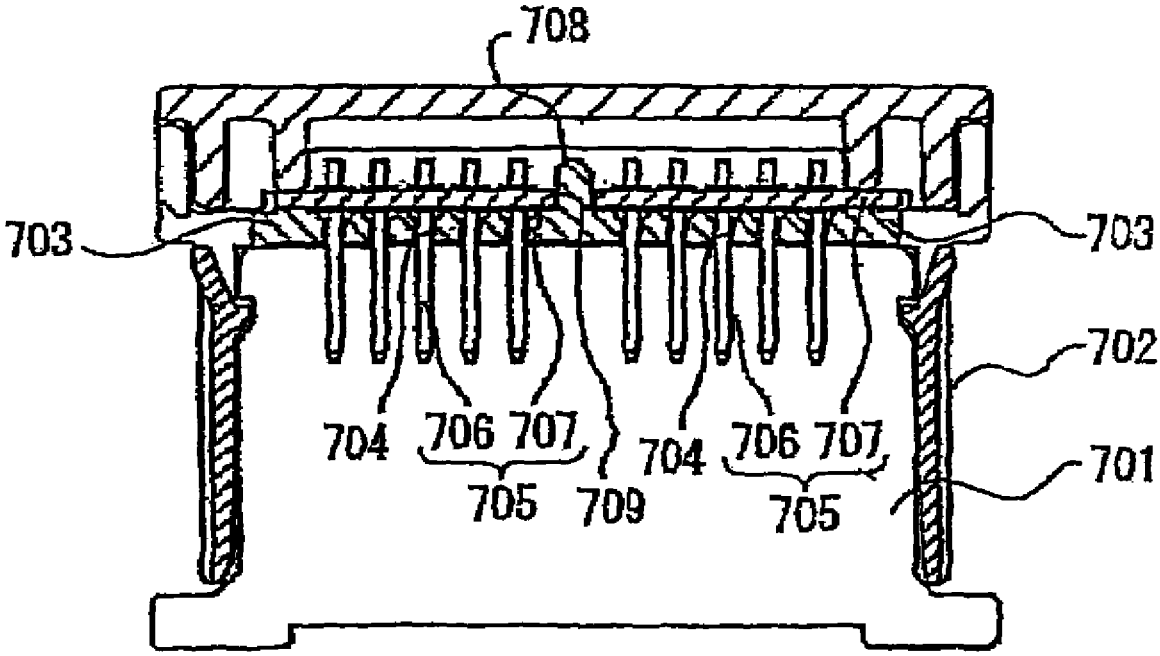
FIG. 7 Prior Art
FIG. 7 is a partially-omitted cross-sectional view showing the way in which an external connector is inserted into a fifth prior-art joint connector, corresponding to a cross section taken along line S-S in FIG. 39.
Figure 8:
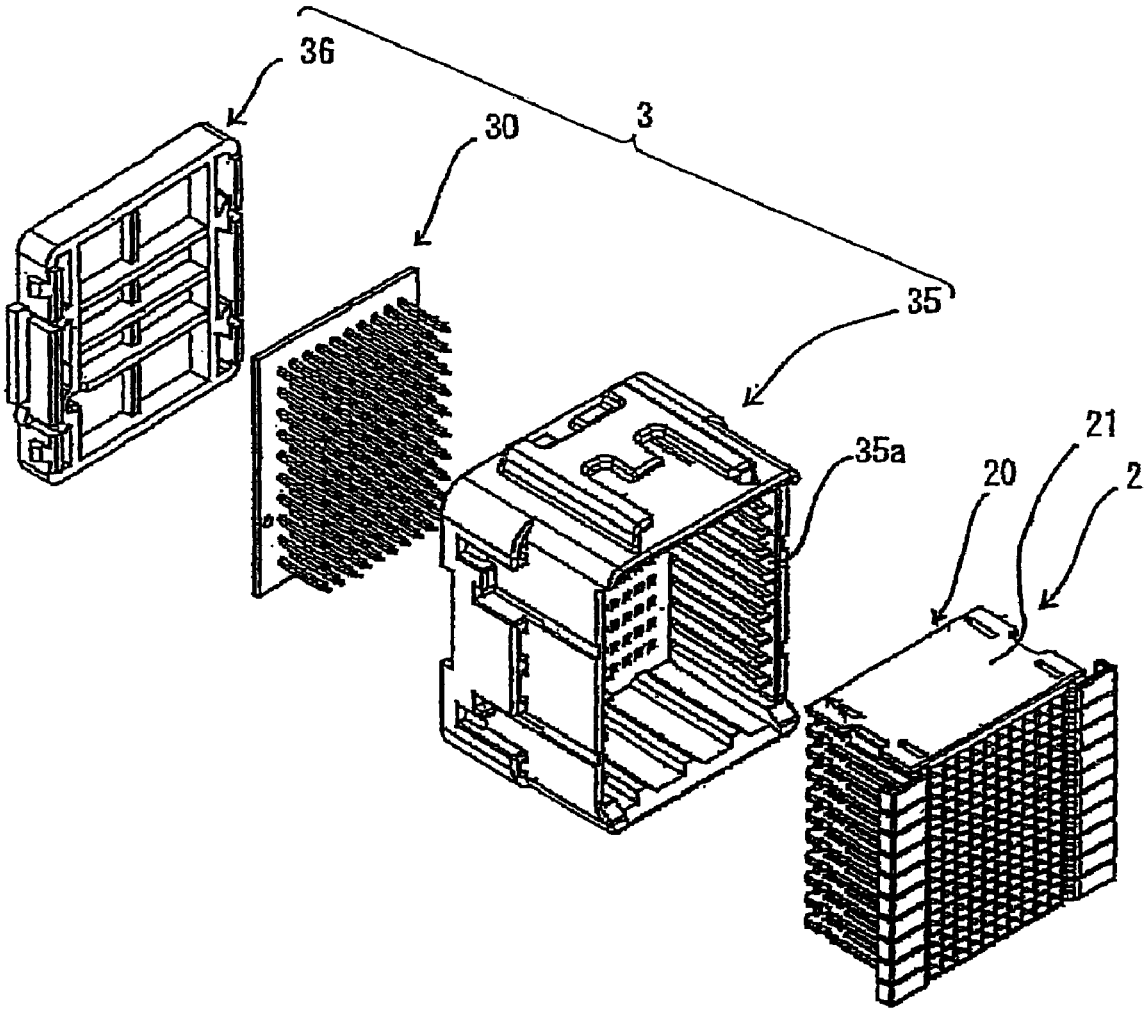
FIG. 8 is a perspective view showing a joint connector according to a first embodiment of the present invention in a disassembled condition.
Figure 9:
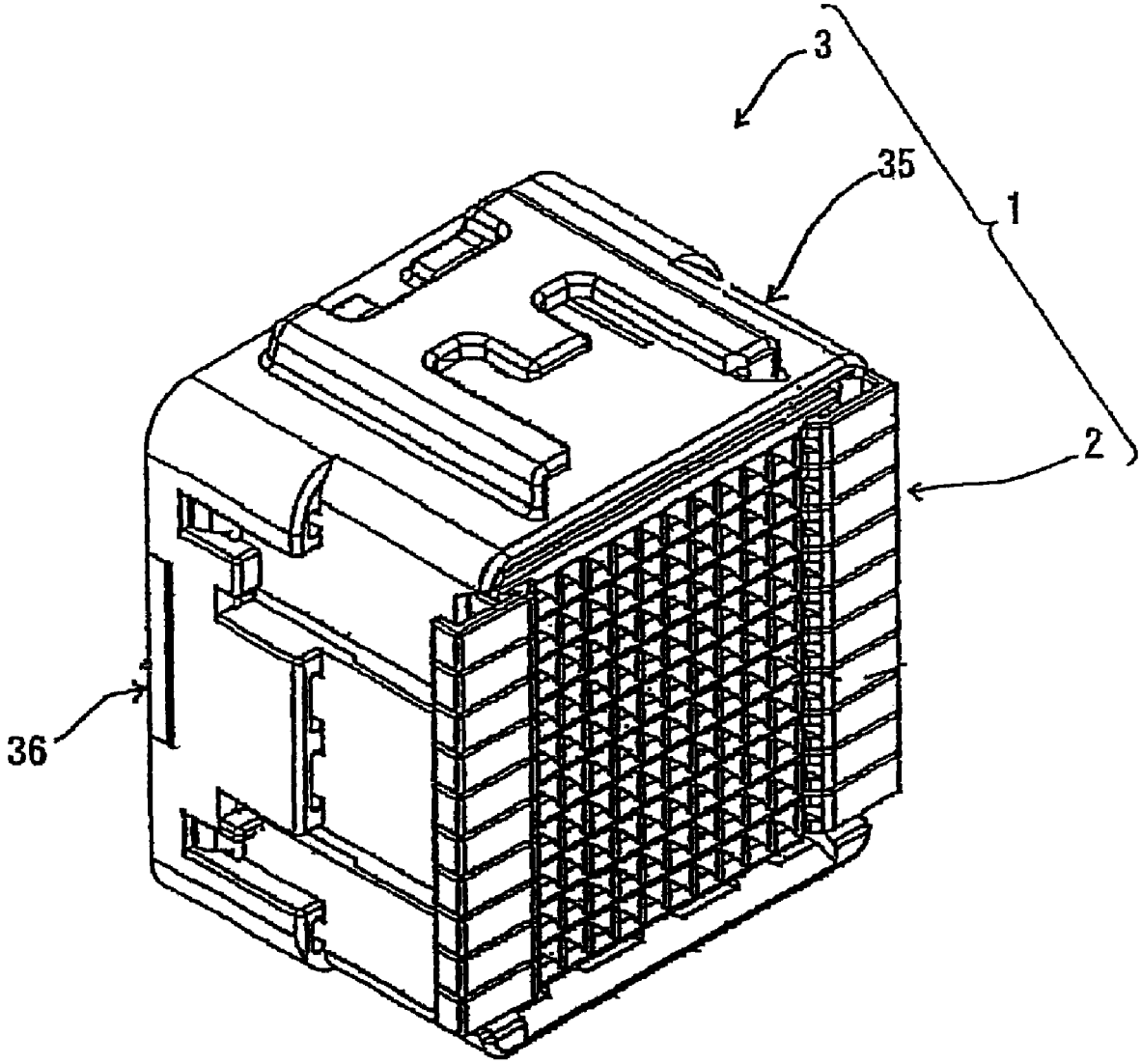
FIG. 9 is a perspective view showing the joint connector of FIG. 8 in an assembled condition.

As shown in the exploded perspective view of FIG. 8 and the assembled view of FIG. 9, a joint connector 1 according to a first embodiment of the present invention is provided with a female connector 2 having a large number of female terminals F, and a housing 35 in which the female connector 2 can be accommodated. It is also provided with a large number of male terminals M (see FIG. 11) for connecting the female terminals F (see FIG. 10) of the female connector 2, and a male connector 3 having a cover 36 attached on a side opposite to the side of the housing 35 into which the female connector is inserted.

Figure 10:
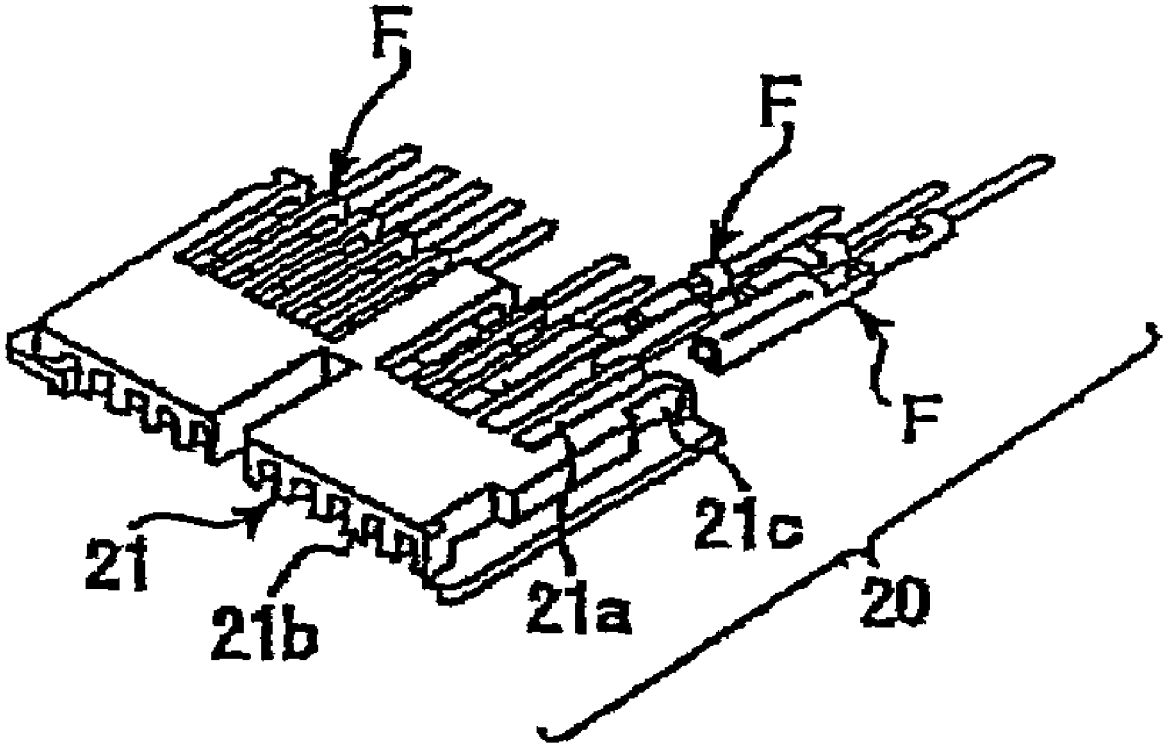
FIG. 10 is a perspective view showing a female connector element of the joint connector of FIG. 8.

As shown FIG. 10, the female connector 2 has a structure in which female connector elements 20, comprising a rectangular thick-plate-like female terminal holder (one-stage parallel-line-shaped connector housing) 21 and female terminals F juxtaposed in the female terminal holder 21, are stacked in a vertical direction. The female connector elements 20 correspond to each one of sub-harnesses, which are not shown in the figure, and each of the female connector elements 20 is configured so as to be attached with a different sub-harness. It should be noted that the female terminal holder 21 of the female connector element 20 is made of a resin material such as PBT (polybutylene terephthalate) and PP (polypropylene), and a plurality of female terminal-accommodating groove portions 21*a* (see FIG. 10) are formed in its upper face overall-widthwise at a predetermined gap. Each of the female terminal-accommodating groove portions 21*a* and one side 21*b* (front side face shown in FIG. 10) of each female terminal holder 21 are connected by a male terminal piercing hole (not shown).

An engaging portion, not shown in the figure, that is latched and engaged with the female terminal F is formed in a portion of the female terminal-accommodating groove portion 21*a* shown in FIG. 10, so that, by inserting the female terminal F into the female terminal-accommodating groove portion 21*a*, the female terminal F is accommodated and retained inside the groove. The female terminal holder 21 also has a claw portion 21*c* for stacking at both ends of the holder. It should be noted that the structure for stacking the female connector elements 20 may be any kind of structure insofar as the elements 20 can be stacked and fixed, and it is not limited to the claw shape shown in the figure.

Each female connector element 20 is provided with an element-locking means 21 for stacking and combining the female connector elements 20 a plurality of stages (10 stages in the example shown in the drawings). It should be noted that the element-locking means 21 is also made of a resin material such as PBT (polybutylene terephthalate) and PP (polypropylene) and is formed by a plastic molding process.

It also should be noted that in the present embodiment, the crimp type female terminal F as shown in FIG. 10 such as 025 terminal, 040 terminal, or 090 terminal is appropriately employed as needed, but this is not restrictive and a press-fit type female terminal may be used for the female terminal.

In FIG. 8, a large number of female connector elements 20 as shown in FIG. 10 are stacked to constitute the female connector 2. During a producing operation of sub-harness, which is one of the producing steps of wire harness, a female terminal F that is required to connect with the same sub-harness or another sub-harness are inserted into each of the female connector elements 20.

On the other hand, the male connector 3 shown in FIG. 8 is provided with a rectangular tubular housing 35, a male terminal assembly 30 that can be inserted into the housing 35, and a cover 36 that is attached to the housing 35. The housing 35 is made of, for example, a resin material such as PBT (polybutylene terephthalate) and PP (polypropylene). The cover 36 has a rectangular plate-like shape, is attached to a side of the housing 35 on which the male terminal assembly 30 is mounted, and serves as a case cover for protecting the male terminal assembly 30. It should be noted that the cover 36 is also made of, for example, a resin material such as PP (polypropylene) and PBT (polybutylene terephthalate) and is formed by a plastic molding process.

Meanwhile, on a side face of an inner wall of the housing 35, a plurality of engaging groove portions 35*a* for engaging with the female connector 2 and accommodating it inside the housing, when it being inserted, are formed so as to be juxtaposed.

It should be noted that the housing 35 of the male connector 3 serves not only to hold the male terminal assembly 30 but also to guide the female connector 2 to an appropriate position relative to the male connector 1 so that the male terminal M and the female terminal F are engaged well.

Figure 11:
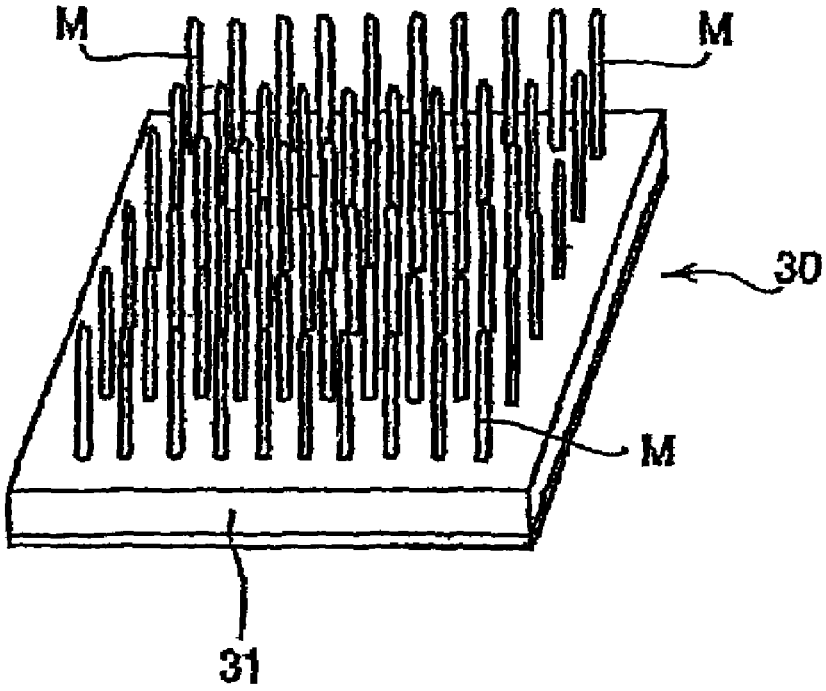
FIG. 11 is a perspective view showing a male terminal assembly of the joint connector of FIG. 8.

The male terminal assembly 30 comprises, as shown in FIG. 11, a circuit board 31, and a large number of male terminals M perpendicularly provided over one surface of the circuit board 31 in a matrix. An end of each individual male terminal M is press-inserted into a terminal insertion hole (not shown) formed in the circuit board 31 in a matrix, and it is solder-joined to the circuit board 31. Here, in FIGS. 11 and 12, the male terminals M are juxtaposed along one direction on the circuit board 31 and in a direction perpendicular thereto, but they may be arranged in intersecting directions in a matrix except the one direction on the circuit board 31 and the direction perpendicular thereto, insofar as the female terminals F and the male terminals M are engaged each other.

The male terminals M are press-inserted in and fixed to the circuit board 31 by general hammering, and thereafter solder-joined to copper foil circuit patterns 31*a*, 31*b*, . . . , etc. (see FIG. 12). Conceivable pitches for the male terminals M include pitches of 040 specification, 025 specification, or 090 specification.

The male terminals M used here are made of brass, but this is not restrictive and they may be made of pure copper.

Figure 12:
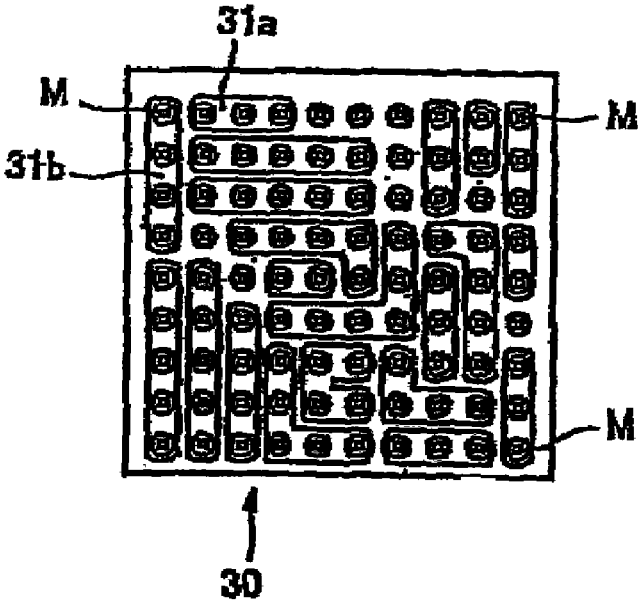
FIG. 12 is a view showing a circuit board face of the male terminal assembly shown in FIG. 11, viewed from an opposite side of FIG. 11.

As shown in FIG. 12, copper foil circuit patterns having a thickness of about 0.2 mm is formed on the circuit board 31 in advance, and the copper foil circuit patterns 31*a*, 31*b*, etc. are formed so as to connect between specific terminal insertion holes selectively.

It should be noted that the copper foil circuit patterns 31*a*, 31*b*, . . . , etc. on the circuit board 31 may be formed, for example, to have identical patterns on both faces of the circuit board. This can ensure conductive characteristic and reduce the amount of generated heat.

The heat dissipation property of the circuit board 31 itself and the low resistance owing to the sufficient thickness (0.2 mm) of the copper foil circuit patterns 31*a*, 31*b* . . . , etc. together achieve reduction in the amount of generated heat and efficient heat dissipation of the generated heat even when a considerable electric current is passed through the joint connector 1; as a result, it is possible to achieve high-density implementation of the male terminal M and side reduction of the joint connector 1.

Thus, by forming a thick copper foil on a surface of the circuit board 31, the width of the circuit can be narrowed and the size of the circuit board itself can be reduced. Here, it is not always necessary that the copper foil circuit patterns be formed on both faces of the circuit board, and a circuit necessary to connect between the male terminals may be formed by etching only on a circuit board face that is opposite the portion on which male terminals are perpendicularly provided.

The male terminals M used here meet a specification that corresponds to the female terminal F, which engage therewith. That is, in the case of the female connector 2 having 025 female terminals, 025 male terminals are perpendicularly provided on the circuit board 31; in the case of the female connector having 040 female terminals, 040 male terminals are perpendicularly provided on the circuit board 31; in the case of the female connector having 090 female terminals, 090 male terminals are perpendicularly provided on the circuit board 31.

Since the joint connector according to the first embodiment of the present invention is configured as described above, the male connector 3 can be easily assembled by accommodating the male terminal assembly 30 in the housing 35 and attaching the upper cover 36. The female connector 2 can also be easily assembled by stacking female connector elements 20 in which a plurality of female terminals F are inserted in the female terminal holder 21. In addition, connection of the joint connector 1 is completed merely by inserting the female connector 2 from an opening on the male terminal side of the male connector 3 to engage them together. That is, a female terminal F(1) inserted in a certain female terminal holder 21 is electrically connected to another female terminal F(2) that is in the same sub-harness circuit, or to further another female terminal F(3) inserted in another female terminal holder 21 that is in another sub-harness circuit, through the male terminals M and the copper foil circuit patterns 31*a*, 31*b*, . . . , etc. on the circuit board. Thus, electric wires in a wire harness can be branched in a desired shape with the use of the joint connector 1.

Therefore, unlike conventional type joint connectors, additional and cumbersome processes are unnecessary, such as folding and bending the fore-end of a terminal of a connector to engage it with an upward terminal's female hole portion having a matching shape, or selectively cutting terminals laterally adjacent thereto, when fitting a male connector and a female connector together.

In addition, such a cumbersome operation is also unnecessary that after terminals are inserted into the connector housing, an electric wire is arranged between terminals that are to be connected to each other and an electric wire's sheath portion is cut through with a blade-shaped portion of a terminal's fore-end to press-fit it with the electric wire's conductor portion.

As described above, the joint connector 1 according to a first embodiment of the present invention can use terminals used as standards including terminals with 025 form, terminals with 040 form, or terminals with 090 form. Consequently, it is advantageous in terms of cost since terminals with special shapes are not necessary.

Moreover, unlike conventional cases, it is not necessary to process the male terminal portion after the terminals are inserted, and therefore, workability in connection of the joint connector 1 improves.

Furthermore, circuit patterns of the circuit board 31 can be easily changed by changing transfer film patterns, and therefore, design changes become easy. For this reason, the joint connector can be adapted to many kinds of harness circuit patterns. Further, since copper foil circuit patterns 31*a*, 31*b*, . . . , etc. are collectively formed on the circuit board 31, special terminals or electric wires for connecting terminals are not necessary, and size reduction of the joint connector itself is possible.

Moreover, because the wiring pattern is composed of the copper foil circuit patterns 31*a*, 31*b*, . . . , etc. having a certain thickness, a sufficient sectional area for continuity is ensured. In addition to this, since a circuit board is used for a part of the joint connector, heat dissipation property improves and heat generation is less than that in conventional type joint connectors. Consequently, it is possible to pass an electric current with a degree that is permitted in a wire harness.

It should be noted that in the foregoing embodiment, the female connector has a form in which one-stage parallel-line-shaped connector housings each having female terminals inserted and interlocked therein are stacked; however, this embodiment is not limited thereto, and any forms may be employed as far as the female connector is such that connector housings each having a plurality of female terminals are stacked. Accordingly, in place of the one-stage parallel-line-shaped connector housings, it is possible to employ a form in which two-stage parallel-line-shaped connector housings are stacked. Alternatively, it is possible to employ a form in which connector housings constructed in an arc shape are stacked, or a form in which connector housings having a plurality of female terminals arranged in a V-shape are stacked.

It should be noted that the thickness of the copper foil circuit patterns 31*a*, 31*b*, . . . , etc. is determined from a cross-sectional view of the wire harness connected to the joint connector and terminals' pitch. When a 0.5 $mm^2$ wire harness is connected to the joint connector of the present invention constituted by 025 terminals, an appropriate thickness of the copper foil thickness is 0.2 mm. If the thickness is greater than that, manufacturing becomes difficult, whereas if less, the copper foil's sectional area becomes insufficient and the wire harness's permissible current cannot be passed through.

Figure 13:
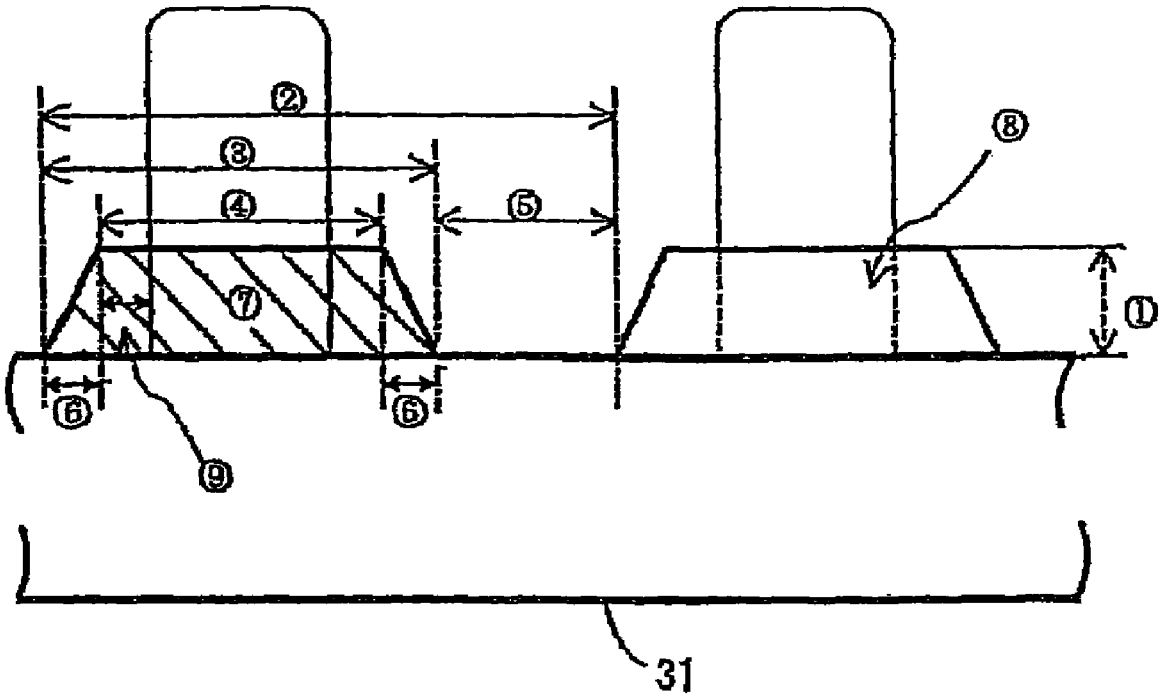
FIG. 13 is a cross-sectional view for illustrating the thickness of a copper foil circuit pattern.

The above-discussed point is specifically explained with reference to FIG. 13. The concept of pattern designing is to strike the balance between dimensions of the width of the copper foil circuit pattern (3) including a pattern slope (6) and an inter-wire gap (5) within the 025 terminal's inter-terminal pitch (2), which is 2.2 mm, and the 2.2 mm pitch, and further the width of a land for soldering (9) after press-fitting the male terminal within the copper foil pattern width (3).

The inter-wire gap (5) is necessary for ensuring the insulation between two opposing copper foil circuit patterns, and a gap of at least 0.5 mm is necessary, for example, in a 12-V automobile power supply. The pattern slope (6) is caused due to etching characteristics of circuit patterns, and when the copper foil thickness (1) is 0.2 mm including its variation, the slope (6) is about 0.1 mm. In that case, the minimum width of the copper foil circuit pattern (3) is 1.5 mm, and the gap (5) in that case is 0.7 mm. Accordingly, the minimum sectional area (7) that can be ensured is (7)=0.28 $mm^2$ when (3)=1.5 mm. This circuit board pattern sectional area corresponds to twice the sectional area of the wire harness since the circuit board is superior in heat dissipation property, so it can cover a wire harness area of approximately 0.5 $mm^2$.

It should be noted that by further varying the thickness of the copper foil, it becomes possible to ensure a sufficient permissible current while using 090 terminals, which are different from 040 terminals or 025 terminals.

Now, a joint connector according to a second embodiment of the present invention is described in detail with reference to the drawings.

Figure 14:
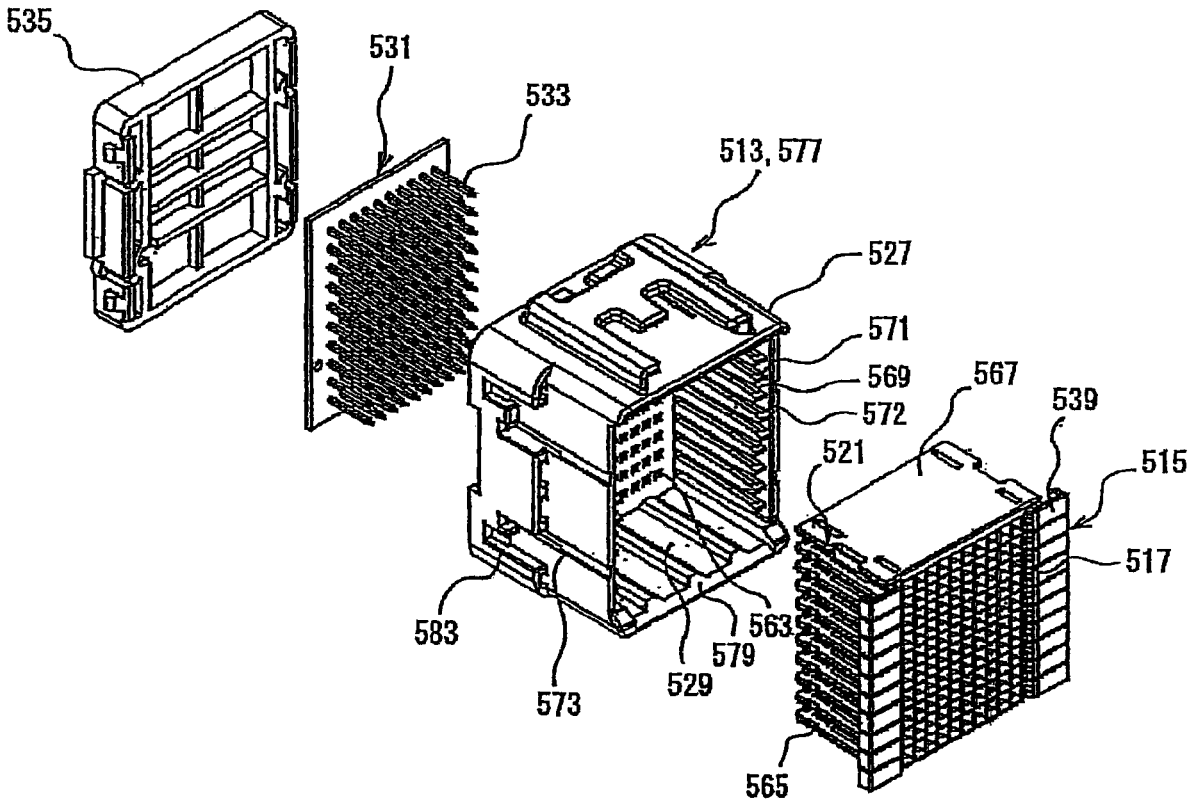
FIG. 14 is an exploded perspective view showing a joint connector according to a second embodiment of the present invention, adapted to a multi-pin connector for automobile wire harnesses.
Figure 15:
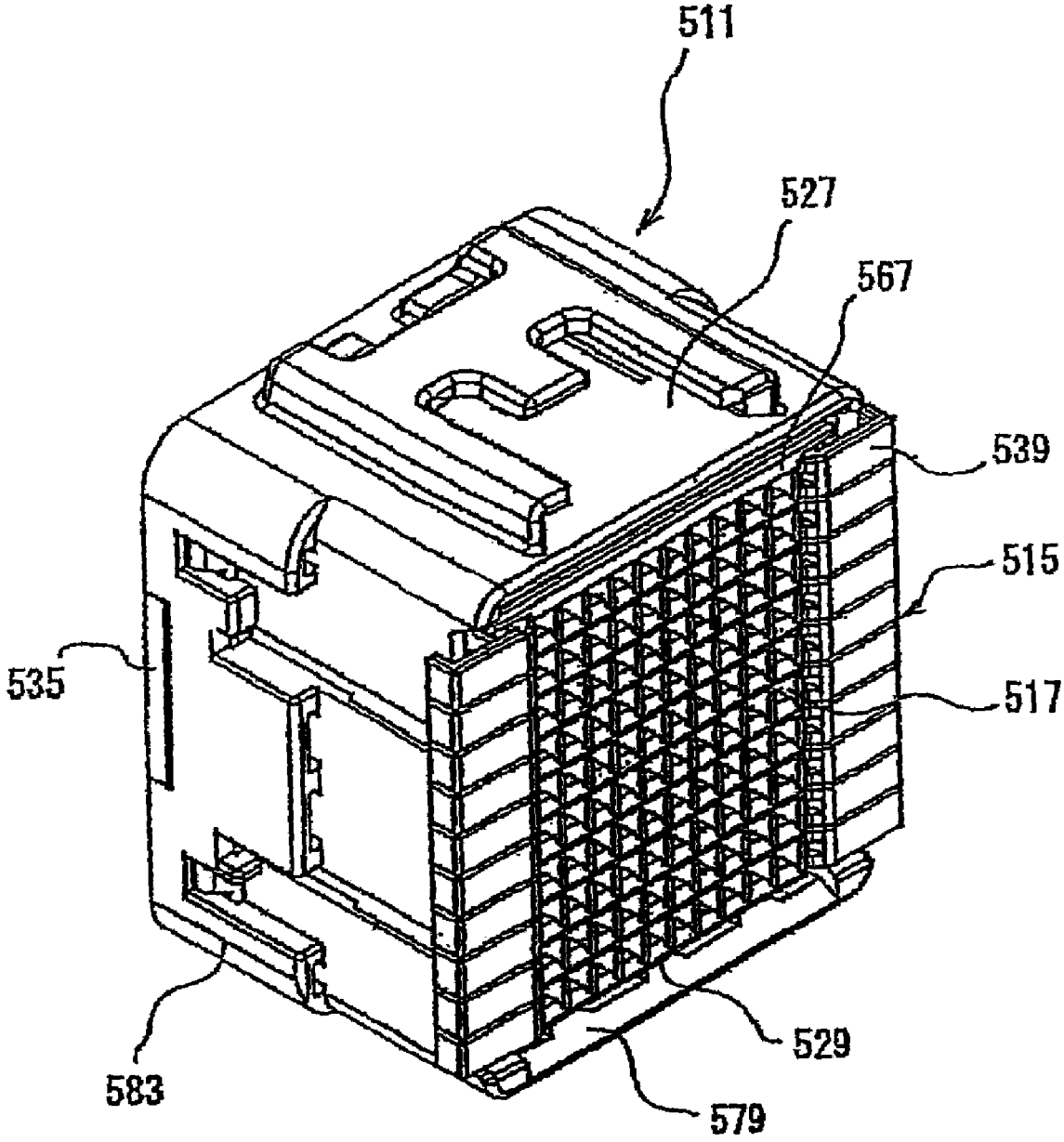
FIG. 15 is an enlarged perspective view showing the joint connector in an assembled condition, in which the component parts of FIG. 14 are combined.
Figure 16A:
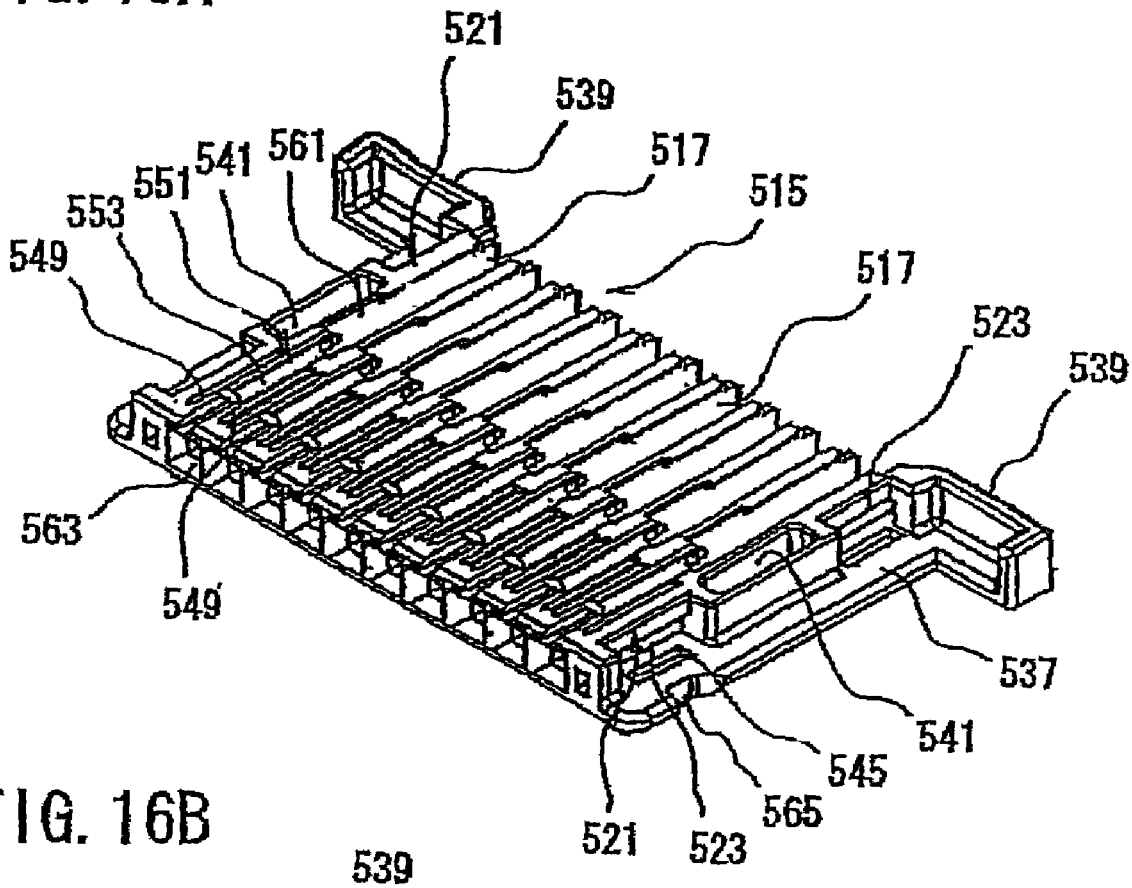
FIG. 16A is a perspective view thereof viewed from its obverse side and FIG. 16B is a perspective view thereof viewed from its reverse side.
Figure 16B:
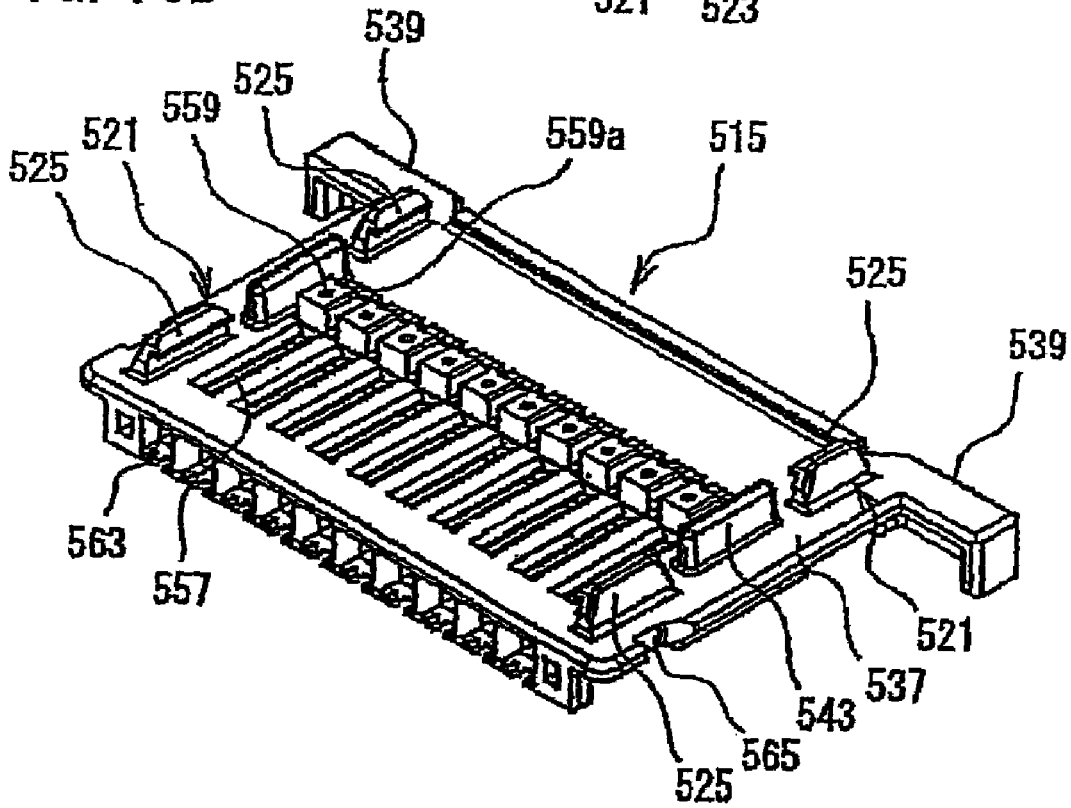
Figure 17A:
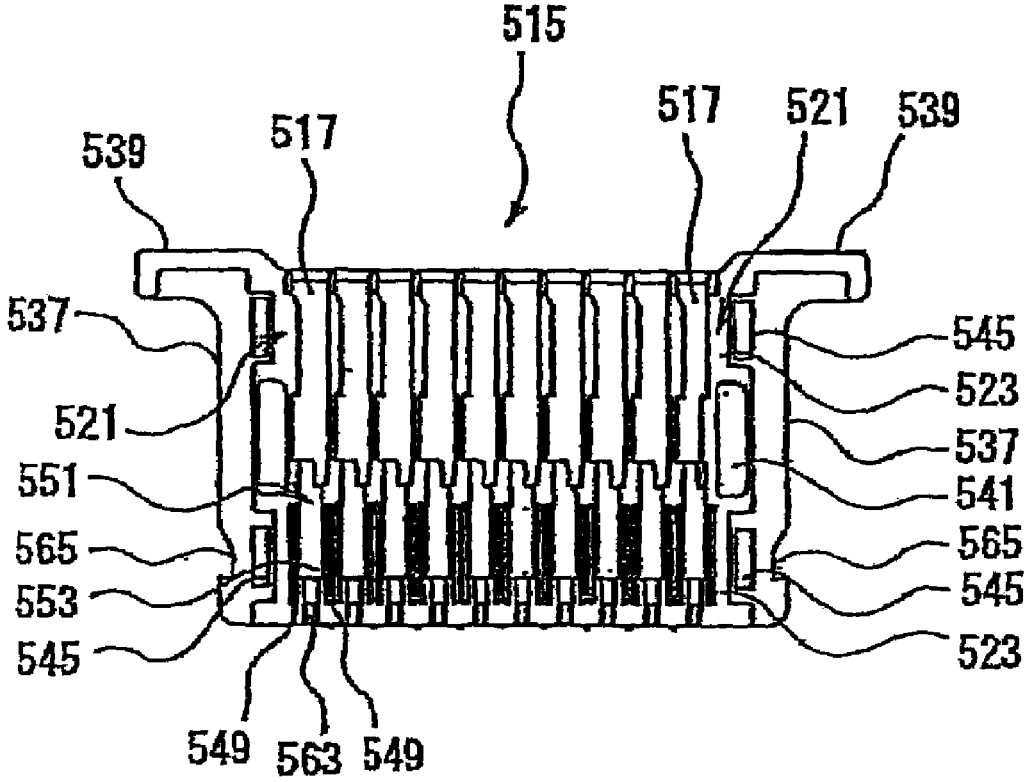
FIG. 17A is a top plan view thereof and FIG. 17B is a bottom plan view thereof.
Figure 17B:
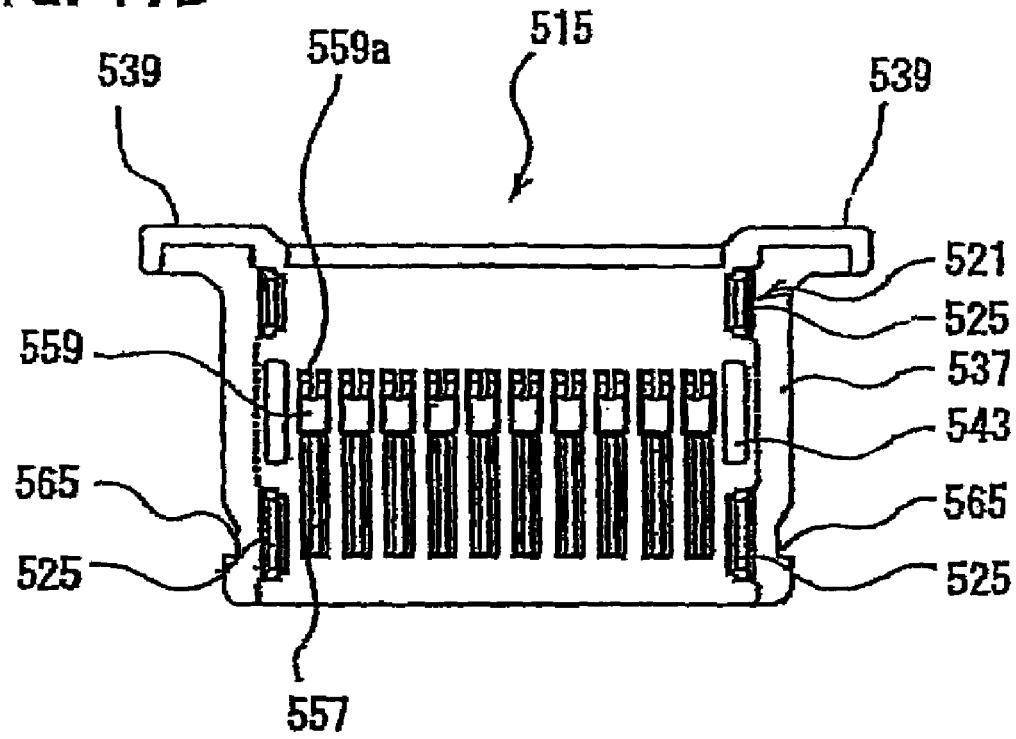

FIG. 14 is an exploded perspective view showing a joint connector according to the second embodiment of the present invention, adapted to a multi-pin connector for automobile wire harnesses. FIG. 15 is an enlarged perspective view showing the joint connector in an assembled condition, in which the component parts of FIG. 14 are combined. FIG. 16 shows a connector housing constituting an inserting-side connector portion of FIG. 14, in which FIG. 16A is a perspective view thereof, viewed from its obverse side and FIG. 16B is a perspective view thereof, viewed from its reverse side. FIG. 17 shows a connector housing of FIG. 16, in which FIG. 17A is a top plan view thereof, and FIG. 17B is a bottom plan view thereof.

A joint connector according to the second embodiment of the present invention comprises, as shown in the above-mentioned figures, an inserting-side connector portion (female connector) 511, and a receiving-side connector portion (male connector) 513 into which the inserting-side connector portion 511 is inserted. The inserting-side connector portion 511 comprises a plurality of ten-terminal connector housings 515 (10 housings in the example shown in the figures) in a rectangular plate-like form having a plurality of terminals in which a plurality of terminal-accommodating compartments 517 (10 compartments in the example shown in the figures) are juxtaposed in a lateral direction for accommodating connecting terminals 519 (see FIGS. 21 through 23 and 26), an interlocking recess portion 523 provided on the connector housing 515, and a connector housing-locking means 521 that has an interlocking protrusion portion 525 that interlocks therewith and is for stacking and combining the connector housing 515 in a plurality of stages (10 stages in the example shown in the figure). These connector housings 515 and the connector housing-locking means 521 are formed by a plastic molding process. It should be noted that each individual connector housing 515 corresponds to each one of the sub-harnesses, and different sub-harnesses are attached to respective connector housings 515.

The receiving-side connector portion 513 has a rectangular box-like shaped connector case 527 and a circuit-forming unit 531. The rectangular box-like shaped connector case 527 is formed by a plastic molding process, and has a rectangular shaped, inserting-side connector portion-receiving compartment 529 on its one side for receiving and holding the inserting-side connector portion 511. The circuit-forming unit 531 is attached to the other side of the connector case 527, and has a plurality of connection pins 533 (100 bars in the example shown in the figures) that protrude in the inserting-side connector portion-receiving compartment 529 so as to be connected to connecting terminals 519 in the inserting-side connector portion 511. The inserting-side connector portion 511 and the receiving-side connector portion 513 are configured to fit and connect to each other. Reference numeral 535 designates a rectangular plate-like shaped case cover for protecting the circuit-forming unit 531 that is provided on a side of the connector case 527 on which the circuit-forming unit 531 is attached, and it is formed by a plastic molding process.

More specifically, all the ten connector housings 515 that constitute the inserting-side connector portion 511 have the same structure so that they can be easily and reliably stacked and combined, and at the rear ends of both its side portions 537 in each of them, ear portions 539 that serve as grip portions when inserting the inserting-side connector portion 511 into the receiving-side connector portion 513 are provided in a protruding manner.

Figure 18:
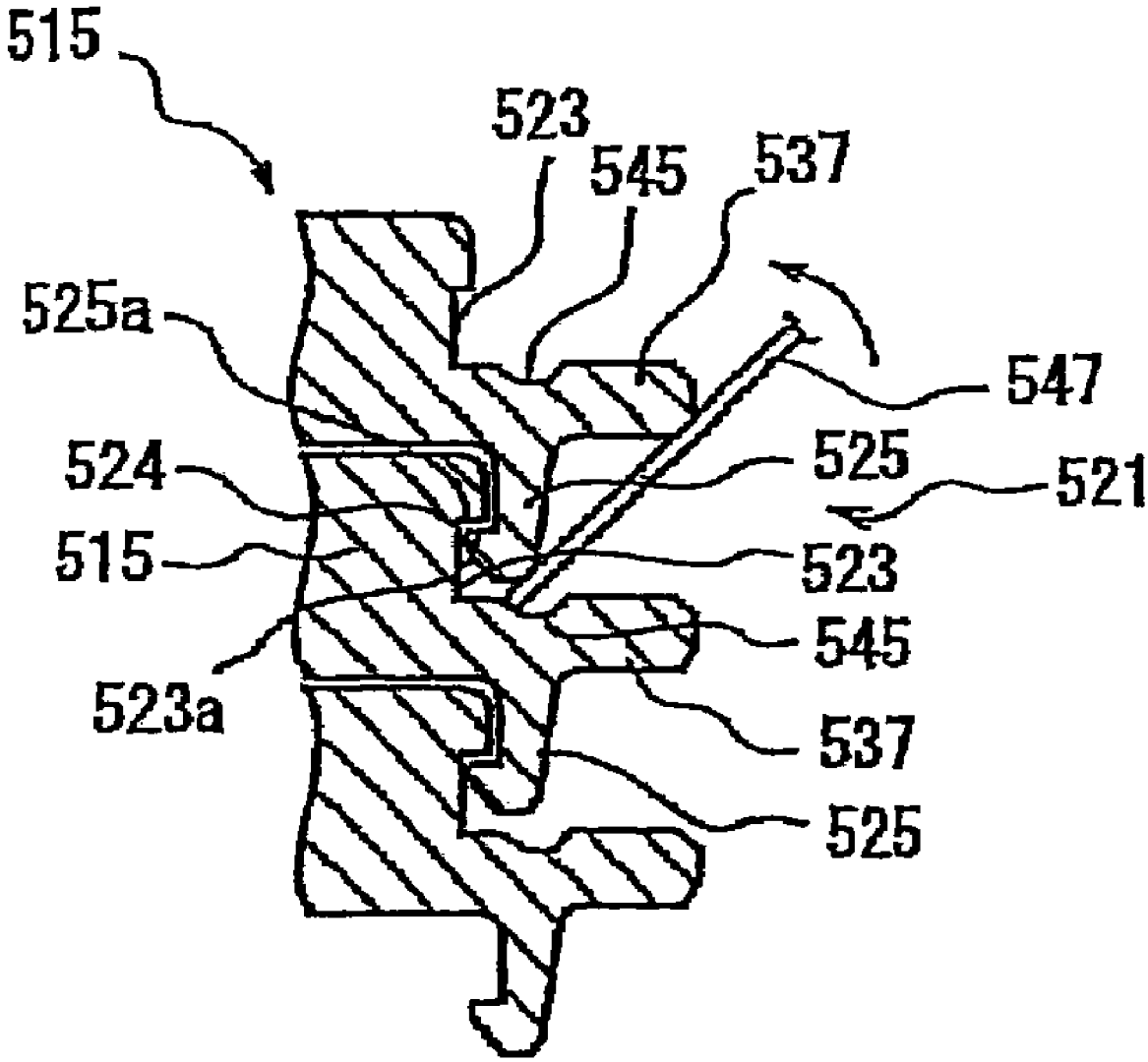
FIG. 18 an enlarged cross-sectional view showing an interlocking condition between an interlocking recess portion and an interlocking protrusion portion of a connector housing-locking means.

As shown in FIGS. 16 through 18, the total of four interlocking recess portion 523 of the connector housing-locking means 521, each of which is made up of an angular C-shaped recessed groove opened in a lateral direction, are provided, on outer side walls of both of the endmost terminal-accommodating compartments 517, and in each of the side portions 537 of each connector housings 515 constituting the inserting-side connector portion 511, so that two of each are spaced apart from each other along the front-and-back direction (a longitudinal direction of the terminal-accommodating compartment 517).

Two of the interlocking protrusion portions 525, the total of four, are provided in the downward positions that correspond to the interlocking recess portions 523 so that they project downwardly in a hook-like shape from the side portions 537; thus, in two adjacent connector housings 515, the interlocking protrusion portions 525 provided on one of them are inserted into interlocking recess portions 523 provided on the other one to interlock with each other.

Further, as is clear from FIG. 18, under the condition in which the interlocking protrusion portions 525 are interlocked with the interlocking recess portions 523, a clearance 524 is provided between interlocking surfaces 523*a* and 525*a* of the interlocking recess portion 523 and the interlocking protrusion portion 525. It is preferable that the gap (play) of the clearance 524 be about 0.1 mm to 0.2 mm.

The connector housing-locking means 521 also comprises, in each of the side portions 537 of each connector housing 515, a rectangular inserting recessed groove 541 protruding on each of outer side walls of the endmost terminal-accommodating compartments 517 so as to be sandwiched between the interlocking recess portions 523, and a rectangular plate-like guide rib 543 protruding directly below the corresponding inserting recessed groove 541 from the side portion 537. Accordingly, inserting recessed groove 541 provided on one of the adjacent connector housings 515 is loosely attached and fitted to the guide rib 543 provided on the other one. Thus, the distance of relative shift (move distance) in the connector housings 515 stacked in a plurality of stages along the horizontal direction (the direction along the contact surfaces) is constrained so that it does not become excessively large.

It should be noted that the numbers of the interlocking protrusion portions 525 (the interlocking recess portions 523) and the guide ribs 543 (the inserting recessed grooves 541) are not limited to those in the above description. Also, it is preferable to vary the shapes and locations of the guide ribs 543 and the inserting recessed grooves 541 appropriately for each connector housing 515 because mistakes in the stacking order of the connector housings 515 become less frequent and workability in stacking can be improved.

Further, as shown in FIGS. 16A, 17A, and 18, a rectangular recessed groove 545 is provided on an upper face of the side portion 537 that corresponds to each of the interlocking recess portions 523. By sticking the fore-end of a rod-like disengaging jig 547 into the recessed groove 545 and rotating it in the direction indicated by the arrow shown in FIG. 18 (in an upward direction), the upper connector housing 515 is slightly lifted and the connector housing-locking means 521 is unlocked to release the combination between the stacked connector housings 515, so that the connector housings 515 can be disassembled into individual pieces.

In the joint connector according to the second embodiment of the present invention, the clearance 524 is, as described above, provided between the interlocking surfaces 523*a* and 525*a* of the interlocking recess portion 523 and the interlocking protrusion portion 525, which constitute the connector housing-locking means 521, and the interlocking protrusion portion 525 is loosely interlocked with the interlocking recess portion 523. As a consequence, the stacked connector housings 515 that constitute the inserting-side connector portion 511 are loosely combined so as to be shiftable relative to each other, forming a flexible structure capable of expansion, contraction, slide, bend, and so forth, like an accordion. For this reason, even when the inserting-side connector portion 511 is inserted into the receiving-side connector portion 513 in an inclined state, the connector housings 515 shift relative to one another quickly, changing their shape, and the inserting-side connector portion 511 is aligned with the receiving-side connector portion 513 to be quickly straightened in a proper posture.

Therefore, insertion of the inserting-side connector portion 511 does not require a great force and, in addition, the insertion does not become difficult midway, making the insertion of the inserting-side connector portion 511 easy. Moreover, no excessive force is applied to the connector housings 515 and the connecting terminals 519, so these are not easily deformed.

Moreover, even when the pitch between the connecting terminals 519 in case that the connector housings 515 have been stacked deviates from the pitch between the connection pins 533 of the receiving-side connector portion 513 because of the dimensional tolerance of the connector housings 515, the connector housings 515 expand one another in the stacking direction and it becomes easy to match the pitch between the connecting terminals 519 with the pitch between the connection pins 533 of the receiving-side connector portion 513.

Consequently, the connection pins 533 of the receiving-side connector portion 513 can be inserted smoothly and not forcibly into the connecting terminals 519 of the inserting-side connector portion 511 when the inserting-side connector portion 511 is inserted into the receiving-side connector portion 513. As a result of the foregoing, fitting and connection between the inserting-side connector portion 511 and the receiving-side connector portion 513 become easy, and the connector's poor electrical connection can be prevented reliably.

Figure 19A:
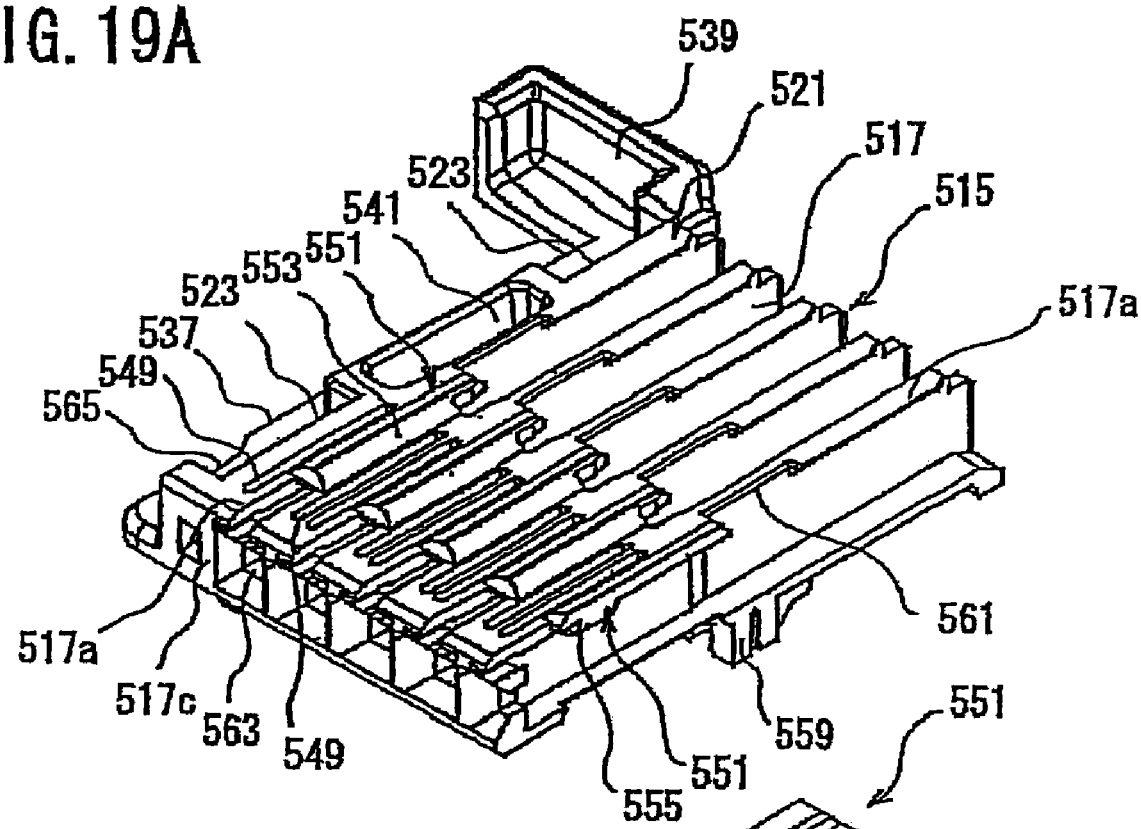
FIG. 19A is a perspective view showing the way in which a lance is provided in a terminal accommodating compartment.
Figure 19B:
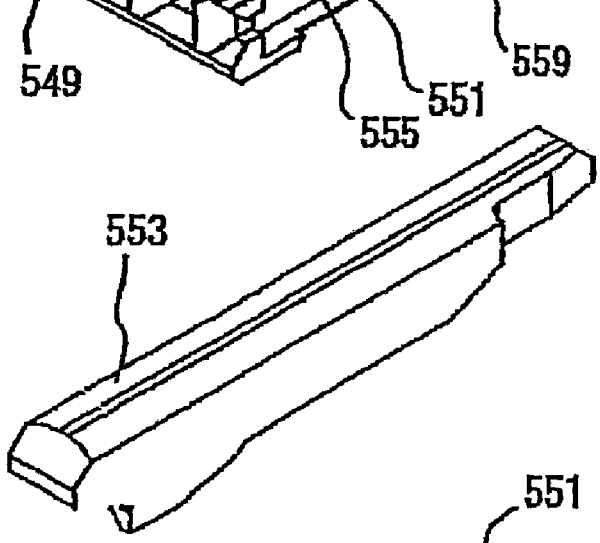
FIG. 19B is an enlarged perspective view of the lance.
Figure 19C:
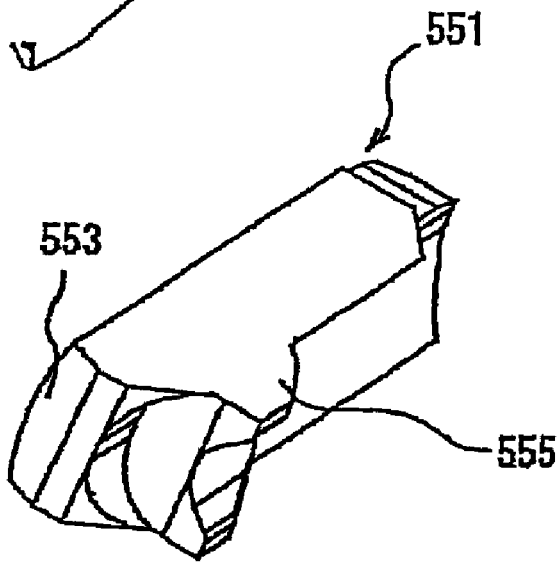
FIG. 19C is an enlarged perspective view showing an interlocking protrusion of the lance.

Furthermore, as shown in FIGS. 16A, 17A, and 19A, a lance 551 is provided on one wall, that is, an upper wall 517*a*, of each terminal-accommodating compartments 517 in each connector housing 515 of the inserting-side connector portion 511. The lance 551 has a straddle structure in which its base line end is supported by the above-mentioned wall 517*a* through a pair of slits 549 formed in the longitudinal direction of the terminal-accommodating compartments 517. The lance 551 is composed of an elastic interlocking piece made of plastic in which a thick-walled built-up portion 553 (see FIGS. 19A and 19B) is formed on its back side and an interlocking protrusion 555 (see FIG. 19C) interlocked with one of the connecting terminals 519 is formed on its inner side.

On the other wall that is opposite the terminal-accommodating compartment 517 corresponding to the location of the lance 551, that is, on the lower wall 517*b*, a lance-receiving portion 557 is provided, as shown in FIGS. 16B, 17B, 20A, and 20B. When the connecting terminal 519 is inserted into the terminal-accommodating compartment 517, the lance-receiving portion 557 receives the built-up portion 553 of the lance 551 provided on the terminal-accommodating compartment 517 of the adjacent connector housings 515 to permit displacement of the lance 551 bending outwardly. The lance-receiving portion 557 is composed of a slit-shaped thin hole. Although the lance-receiving portion 557 shown in the figures is a thin hole, it may be composed of a recessed groove (closed-end hole), not a hole, when the strength of the lance 551 can be ensured sufficiently and the built-up portion 553 can be made small.

When the lance 551 with such a structure is employed, the elastic interlocking piece constituting the lance 551 can attain strong support since it has a straddle structure even in cases where the wall thickness of the terminal-accommodating compartments 517 in the connector housings 515 of the inserting-side connector portion 511 is reduced. In addition, since the built-up portion 553 is provided and the strength becomes greater with the reinforcement, a retention force for the connecting terminals 519 can be sufficiently ensured. Therefore, it is possible to reduce the wall thickness of the terminal-accommodating compartments 517 and accordingly make the connector housings 515 thin, so the height of the inserting-side connector portion 511 in which the connector housings 515 are stacked becomes small, reducing the size of the joint connector. Additionally, the pitch between the connecting terminals 519 along the stacking direction becomes small, minimizing wasted spaces. Thus, it is preferable to use the lance 551 with such a structure.

Furthermore, as shown in FIGS. 16B, 17B, and 21 through 23, a double interlocking rib 559, for example, in a rectangular shape for the connecting terminal 519 is protruded on an outer side (lower portion) of the lower wall (the other wall) 517*b* located rearward of the lance 551 provided on each terminal-accommodating compartment 517 in each connector housing 515 of the inserting-side connector portion 511. Meanwhile, on the upper wall 517*a* (the one wall) corresponding to the location of the double interlocking rib 559, an interlocking hole 561 is provided for interlocking with a double interlocking rib 559 protruding on a terminal-accommodating compartment 517 of an adjacent connector housing 515.

When the connector housings 515 are stacked to form a plurality of stages (10 stages in the example shown in the figures), as shown in FIG. 21, the connecting terminal 519 (electric wire is not shown) is inserted from its entrance side (the right side in FIG. 21) to the terminal-accommodating compartment 517 of each connector housing 515 in advance before the stacking and is accommodated therein. In doing so, a tab-like interlock receptor portion 519*a* protruding on an upper portion of the fore-end of the connecting terminal 519 comes into contact with the interlocking protrusion 555 of the lance 551, bending the lance 551 upwardly from the slit 549 portion to interlock with the interlocking protrusion 555, so that disconnection of the connecting terminal 519 is prevented. In this state, the connector housings 515 are stacked and combined.

Figure 22:
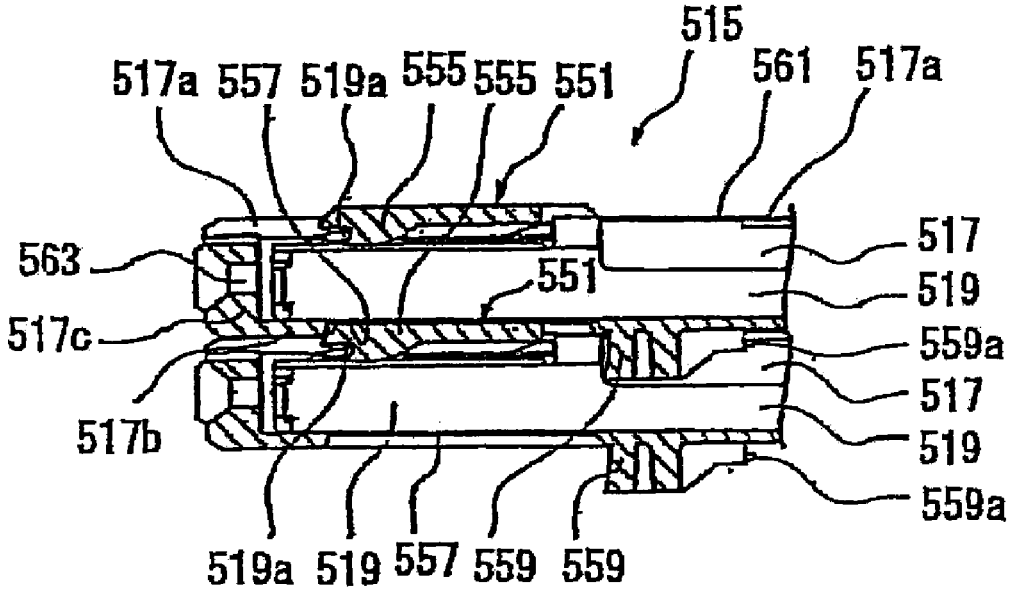
FIG. 22 is a longitudinal sectional view showing the way in which the double interlocking rib is interlocked into the interlocking hole from the state of FIG. 21.

FIG. 21 is a longitudinal sectional view showing a condition before a double interlocking rib 559 protruding on a terminal-accommodating compartment 517 in one of the connector housings 515 is interlocked with an interlocking hole 561 provided in a terminal-accommodating compartment 517 of another one of the connector housings 515 adjacent thereto, when the connector housings 515, in which the connecting terminals 519 are accommodated in the terminal-accommodating compartment 517, are stacked to form a plurality of stages. FIG. 22 is a longitudinal sectional view showing a condition in which the connector housings 515 are stacked and the double interlocking rib 559 is interlocked with the interlocking hole 561 after the condition shown in FIG. 21.

As illustrated here, in stacking the connector housings 515, when the double interlocking rib 559 protruding on the terminal-accommodating compartment 517 is interlocked with the interlocking hole 561, the connecting terminals 519 accommodated in the terminal-accommodating compartments 517 in the connector housings 515 are interlocked doubly with the double interlocking rib 559 in addition to interlocking with the interlocking protrusion 555 of the lance 551. This is preferable in that disconnection of the connecting terminals 519 from the terminal-accommodating compartments 517 can be prevented more reliably.

Moreover, as shown in FIGS. 21, 22, and so forth, it is preferable to provide a projection 559*a* at the rear portion of the double interlocking rib 559 since the projection 559*a* is caught on the edge of the interlocking hole 561 after the double interlocking rib 559 is interlocked with the interlocking hole 561, making it difficult to disengage from the interlocking hole and thus disconnection of connecting terminals 519 is prevented further strongly. The projection 559*a* may be provided for all the double interlocking ribs 559; however, in the case where the width of the connector housing 514 is large, it may be provided for those double interlocking ribs 559 located at its center, since there is a possibility that the center portion may be lifted.

Figure 23:
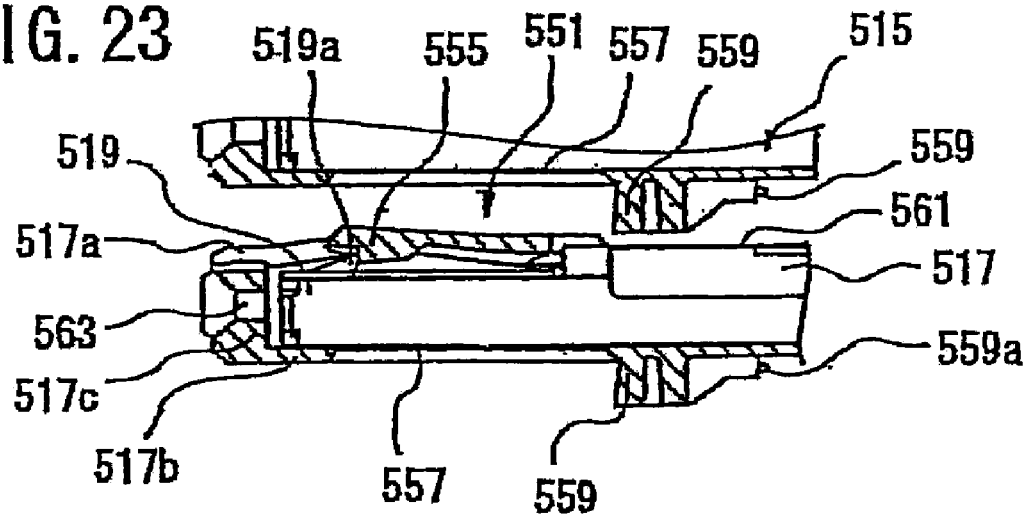
FIG. 23 is a longitudinal sectional view showing a double interlocking rib in a condition before it is interlocked, which is provided in a terminal accommodating compartment of a connector housing adjacent to an interlocking hole of a terminal accommodating compartment of a connector housing into which a connecting terminal is accommodated in an incompletely inserted condition.

FIG. 23 is a longitudinal sectional view of the connector housing 515 showing a condition before a double interlocking rib 559 protruding on the terminal-accommodating compartment 517 of one of the connector housing 515 is interlocked with an interlocking hole 561 provided in a terminal-accommodating compartment 517 of an adjacent one of the connector housings 515 in which a connecting terminal 519 is accommodated in the terminal-accommodating compartment 517 in an incompletely inserted state.

As illustrated here, when the connecting terminal is not inserted deeply to the predetermined location but is in an unfinished, incompletely inserted state in inserting the connecting terminal 519 into the terminal-accommodating compartment 517 before stacking the connector housings 515, the fore-end of the double interlocking rib 559 collides with the rear end of the connecting terminal 519, preventing insertion of the double interlocking rib 559 even if the double interlocking rib 559 protruding on the terminal-accommodating compartment of one of the connector housings 515 is attempted to be inserted into the interlocking hole 561 provided in the terminal-accommodating compartment 517 of an adjacent one of the connector housings 515 when stacking the connector housings 515 to form a plurality of stages. For this reason, the double interlocking rib 559 cannot be inserted into the interlocking hole 561 to a predetermined depth, making the stacking of the connector housings 515 difficult. In view of this, it is preferable to provide the double interlocking rib 559 since the incompletely inserted state of the connecting terminal 519 in the terminal-accommodating compartment 517 can be detected easily without using complex mechanisms.

Figure 24:
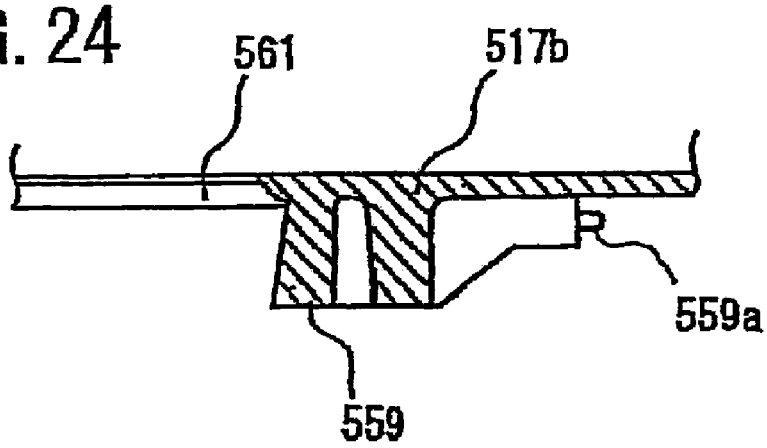
FIG. 24 is across-sectional view showing a modified example of the double interlocking rib.

It should be noted that, as shown in FIG. 24, the double interlocking rib 559 may be formed in such a shape that its lower portion is sloped toward the lance-receiving portion 557, that is, the fore-end of the connecting terminal 519. Such a shape is preferable since it easily makes contact with the housing if the insertion condition of the connecting terminal 519 is incomplete, and sensitivity of detecting the incompletely inserted state of the connecting terminal 519 increases.

In addition, it is preferable to appropriately vary the shapes and locations of the double interlocking rib 559 and the interlocking hole 561 for each connector housing 515, as in the case of the above-described guide rib 543 and the inserting recessed groove 541, since mistakes in the stacking order of the connector housing 515 become less frequent and workability in stacking can be improved.

Reference numeral 563 designates a connection pin insertion hole formed by piercing through a front wall 517*c* of the terminal-accommodating compartments 517 so that, when the inserting-side connector portion 511 is inserted in the receiving-side connector portion 513, the connection pins 533 of the receiving-side connector portion 513 can be inserted in the connecting terminals 519 accommodated in the terminal-accommodating compartments 517 of the connector housings 515 to achieve electrical connection. Reference numeral 565 denotes lock grooves provided on both side portions 537 at the locations near the fore-ends in each of the connector housings 515. After inserting the inserting-side connector portion into the receiving-side connector portion and fitting it thereto, the lock grooves are interlocked with claws 573*a* (see FIG. 27) of lock claw portions 573 provided in the receiving-side connector portion so that the inserting-side connector portion is fixed so as not to come out of the inserting-side connector portion-receiving compartment 529 of the receiving-side connector portion 513. It should be noted that in the example shown in the figures, both the side portions 37 of the connector housing 515 are provided with the lock grooves 565, but only one of the side portions 537 may be provided therewith.

Figure 25A:
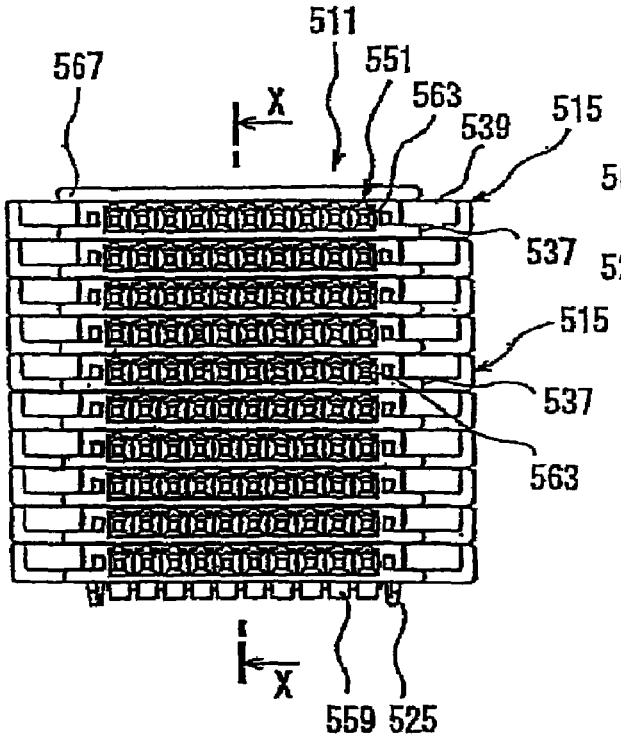
FIG. 25A is a left-side view and FIG. 25B is a front view.
Figure 25B:
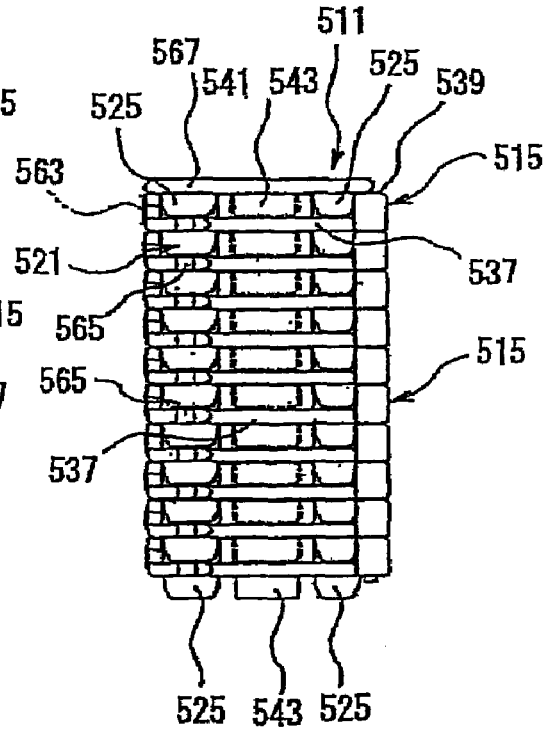
Figure 26:
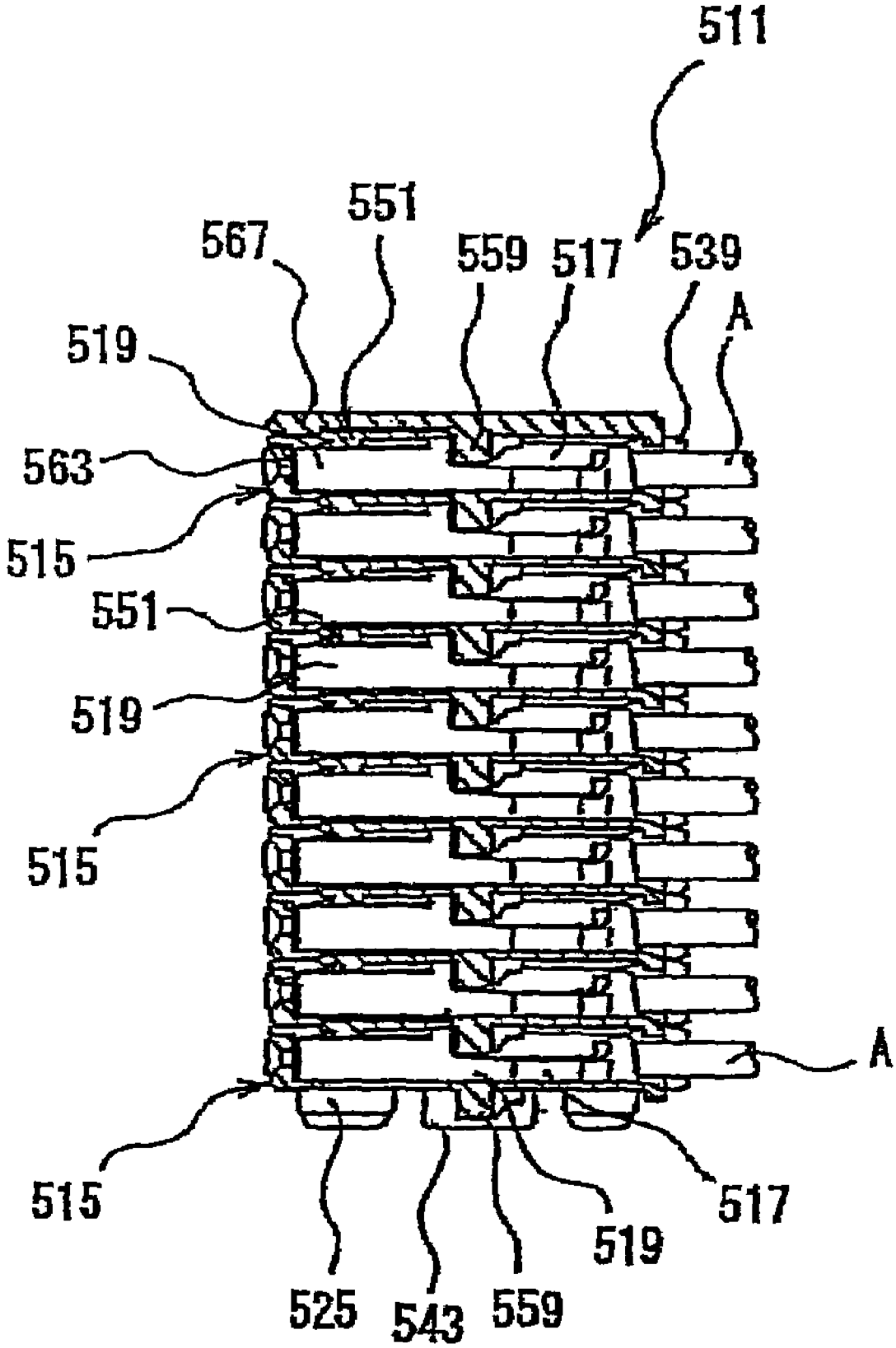
FIG. 26 is a cross-sectional view taken along line X-X in FIG. 25 A.

FIGS. 25A and 25B are a left-side view (front-side view) and a front view, respectively, showing the inserting-side connector portion 511 in which ten of the connector housings 515 are stacked and combined vertically to form 10 stages, and FIG. 26 is a cross-sectional view taken along line X-X in FIG. 25A. To assemble the inserting-side connector portion 511 of this kind, the connecting terminals 519 connected to electric wires A that constitute a sub-harness are inserted and accommodated in advance in the terminal-accommodating compartments 517 of the connector housing 515 before stacking the connector housings 515, as shown in FIG. 26, and thereafter, the connector housings 515 are stacked and combined using the connector housing-locking means 521. In this process, the operation of inserting the connecting terminals 519 inside the terminal-accommodating compartments 517 of the connector housing 515 may be carried out before any of the ten connector housings 515 are stacked, or may be performed sequentially each time a connector housing 515 for an upper stage is stacked over a connector housing 515 for a lower stage.

It should be noted that, above the connector housing 515 stacked to be the uppermost stage of the inserting-side connector portion 511, a rectangular plate-shaped cover 567 is attached (see FIGS. 25 and 26), which is provided with ten double interlocking ribs 559 (not shown) in a protruding condition at corresponding locations on its lower portion such that the connecting terminals 519 accommodated in its terminal-accommodating compartments 517 can be doubly interlocked, and also provided with four interlocking protrusion portion 525 for the connector housing-locking means 521, two guide ribs 543, and a lance-receiving portion (recessed groove) 557 (not shown).

Figure 27A:
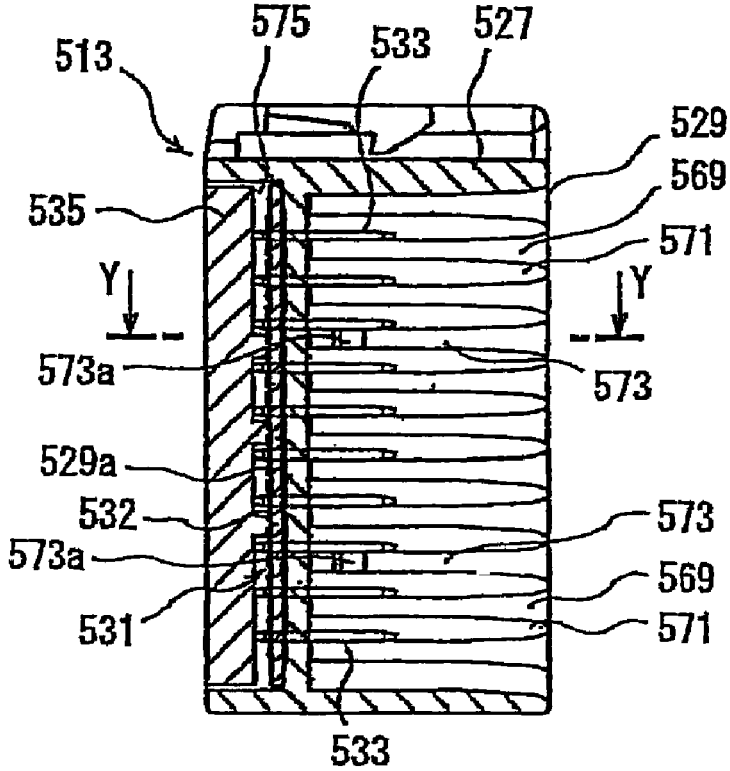
FIG. 27A is an elevational vertical cross-section and FIG. 27B is a cross-sectional view taken along line Y-Y in FIG. 27A.
Figure 27B:
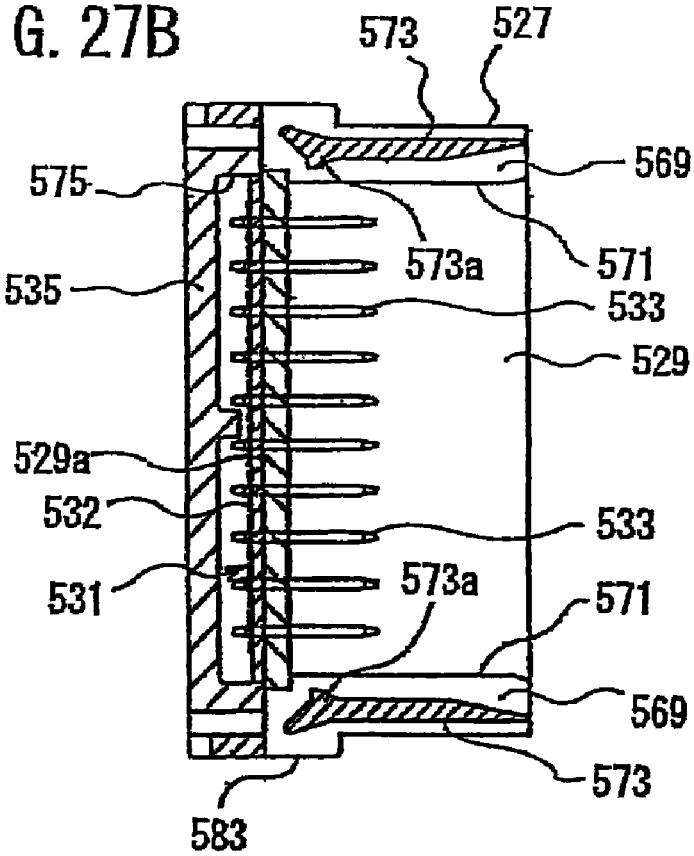

Next, the configuration of the receiving-side connector portion 513 is described further. As shown in FIGS. 15, 27A, and 27B, on both inner side walls the inserting-side connector portion-receiving compartment 529 in the connector case 527 constituting the receiving-side connector portion 513, a plurality of protruding guide portions 571 (only those on one side are shown in the figure) having, for example, a substantially angular cross-sectional shape are juxtaposed to form guide grooves 569 having, for example, a substantially angular C-shape for guiding both side portions 537 of each connector housing 515 in the inserting-side connector portion 511 to be inserted therein. The protruding guide portions 571 are provided along the longitudinal direction of the inserting-side connector portion-receiving compartment 529 and vertically at predetermined intervals, that is, at a pitch size that matches the pitch of the connecting terminals 519 accommodated in the terminal-accommodating compartments 517 of the inserting-side connector portion 511 with respect to the connector housing stacking direction.

In the example shown in the figures, the guide grooves 569 are formed by recessing both inner side walls of the inserting-side connector portion-receiving compartment 529, and for this reason, the height level of each protruding guide portion 571 provided on the inner side walls is at the same level of the inner side wall surface of the inserting-side connector portion-receiving compartment 529, so it does not project inward beyond the inner side wall surface. As for the guide grooves 569, in the example shown in the figures, 11 grooves are provided so that the respective side portions 537 of the inserting-side connector portion 511 side and the side portion 537 of the cover 567 can be inserted, and accordingly, ten protruding guide portions 571 are provided. In addition, the width of each of the protruding guide portions 571 is so formed as to be narrowed and tapered toward the entrance of the inserting-side connector portion-receiving compartment 529, while the width of each of the guide grooves 569 is gradually widened. It should be noted that the protruding guide portions 571 may be juxtaposed so as to project inwardly from both inner side walls of the inserting-side connector portion-receiving compartment 529, and in this case, the guide grooves 569 are formed between the protruding guide portions 571 that project. It also should be noted that in the example shown in the figures, the guide grooves 569 are formed on both inner side walls of the inserting-side connector portion-receiving compartment 529 in the receiving-side connector portion 513, but they may be formed only on one of the inner side walls.

On both side walls of the inserting-side connector portion-receiving compartment 529, lock claw portions 573 each made of an elastic interlocking piece are provided, which interlock with the lock grooves 565 provided on the connector housings 515 when the inserting-side connector portion 511 is inserted into the receiving compartment 529, so that the inserting-side connector portion 511 is fixed so as not to come out of the inserting-side connector portion-receiving compartment 529 of the receiving-side connector portion 513. The lock claw portions 573 can sufficiently fix the inserting-side connector portion 511 even if the number thereof is not as many as the corresponding number (20 in the example shown in the figure) of the lock grooves 565 provided in the connector housings 515. For this reason, in cases where the connector housings 515 of the inserting-side connector portion 511 are stacked to form ten stages as shown in the figures, the total of four lock claw portions 573 are provided on both side walls of the inserting-side connector portion-receiving compartment 529, two at each of locations at which the third-stage and eighth-stage connector housings 515, from the bottom, of the inserting-side connector portion 511 are inserted, for example. It should be noted that in the example shown in the figures, the lock claw portions 573 are provided on both side walls of the inserting-side connector portion-receiving compartment 529, but they may be provided only on one of the side walls.

Meanwhile, in the example shown in the figures, the circuit-forming unit 531 is formed as follows. An insulating substrate 532 is provided with, on one surface (reverse surface) thereof, a circuit pattern formed by printing or the like and made of a conductive material such as a copper foil or the like. On the other surface thereof (obverse surface), a plurality of connection pins 533 (100 pins in the example shown in the figures) composed of good conductive pin contacts and made of a copper material or the like are provided so that one ends of them are connected to the circuit pattern while the other ends of them pierce the insulating substrate 532 and protrude therefrom. This circuit-forming unit 531 is accommodated and held in a circuit-forming unit-accommodating compartment 575 formed opposite the inserting-side connector portion-receiving compartment 529 of the connector case 527, separated therefrom by a partition wall 529*a*, and the connection pins 533 pierce the partition wall 529*a* and protrude inside the inserting-side connector portion-receiving compartment 529 so as to be inserted into and connected to the connecting terminals 519 of the inserting-side connector portion 511. It should be noted that the circuit-forming unit 531 may be a bus bar type (not shown) in which the circuit pattern and the connection pins 563 are formed of bus bars, in place of the circuit board type as described above.

It is preferable to use the receiving-side connector portion 513 having such a configuration for the following reason. When inserting the inserting-side connector portion 511 into the receiving-side connector portion 513, the side portions 537 of the connector housings 515 in the inserting-side connector portion 511 are guided by the guide grooves 569 of the receiving-side connector portion 513, the entrances of which are widened. Therefore, the inserting-side connector portion 511 is not likely to be inserted in an inclined condition against the receiving-side connector portion 513, and the inserting-side connector portion 511 is easily inserted in a proper posture aligned with the receiving-side connector portion 513; thus, both of the connector portions 511 and 513 can be more smoothly fitted and connected to each other.

Figure 28:
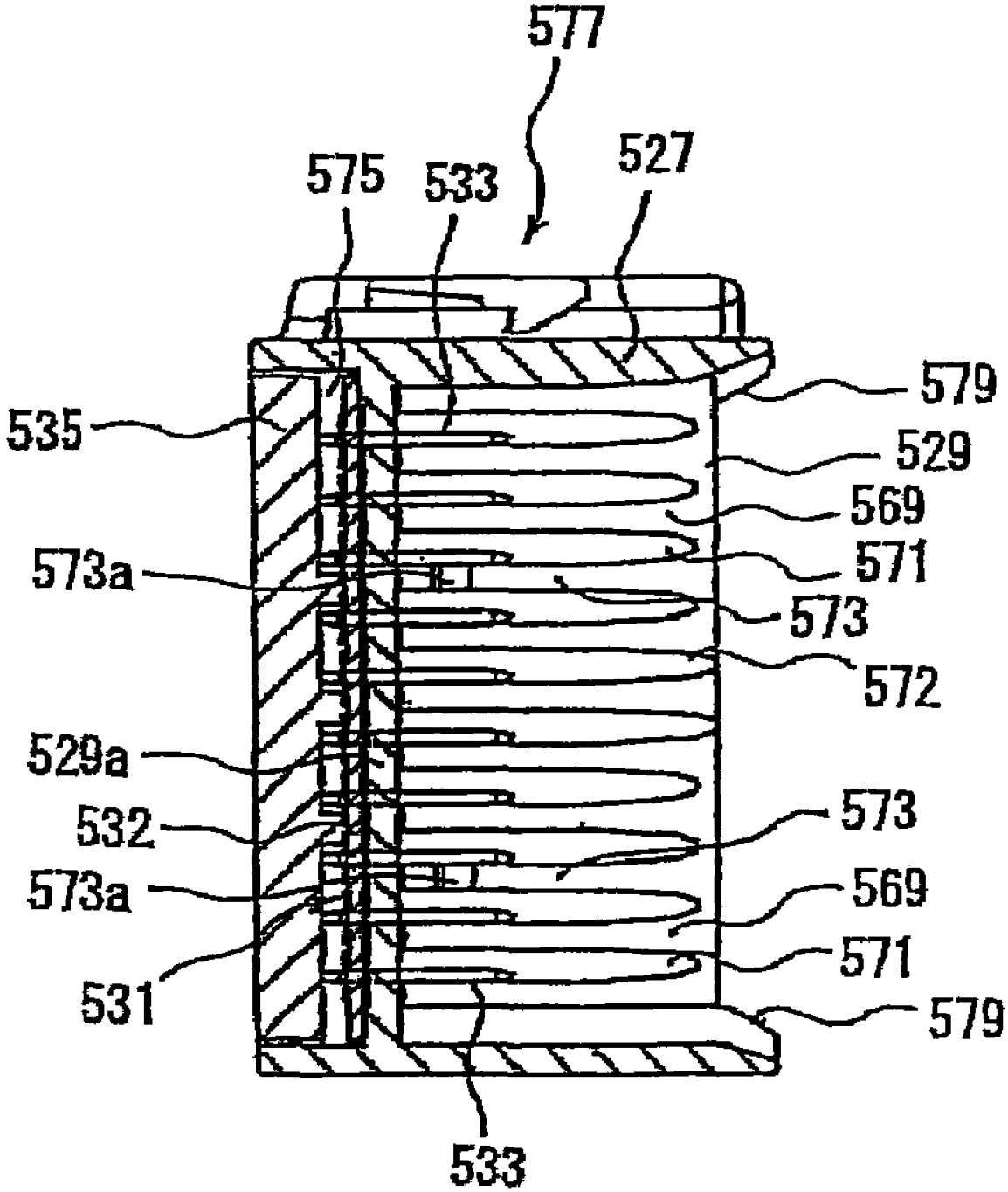
FIG. 28 is an elevational vertical cross-section showing a modified example of the receiving-side connector portion of FIG. 27.

A receiving-side connector portion 577 shown in FIG. 28 shows a modified example of the foregoing receiving-side connector portion 513. The receiving-side connector portion 577 is different from the foregoing receiving-side connector portion 513 as follows. In comparison with the receiving-side connector portion 513, the length of one or a plurality of (two in the example shown in the figure) protruding guide portions 572 that is/are located in the middle of the protruding guide portion 571 is formed longer than the other ones by a predetermined length toward the entrance of the inserting-side connector portion-receiving compartment 529, projecting along the longitudinal direction of the inserting-side connector portion-receiving compartment 529. Also, extension portions 579 are formed on both upper and lower ends of the entrance of the inserting-side connector portion-receiving compartment 529, such that they extend longer than both side ends by a predetermined length and their inner wall surfaces are inclined outwardly toward the entrance to form a funnel-like shape. The rest of the configurations are the same as the foregoing receiving-side connector portion 513.

It is preferable that the protruding guide portions 572 located in the middle region are formed to have a longer length in this way, because the axis deviation in inserting the inserting-side connector portion 511 into the receiving-side connector portion 577 reduces further, and the insertion can be made in a proper posture. It is also preferable to provide the extension portions 579 since the advantageous effect of correcting the axis deviation caused at the time of inserting the inserting-side connector portion 511 into the receiving-side connector portion 577 becomes greater. It should be noted that, naturally, even when either one of the above-described two means is omitted, insertion performance of the inserting-side connector portion 511 can be improved more than that in case of the receiving-side connector portion 513. In addition, in the case of providing the protruding guide portions 572 in the middle region, it is preferable to increase the number of the protruding guide portion 572, that is, to lengthen the vertical distance in which they are provided, since insertion of the inserting-side connector portion 511 becomes easy even when the number of stacked stages of the connector housings 515 in the inserting-side connector portion 511 is increased.

Figure 29A:
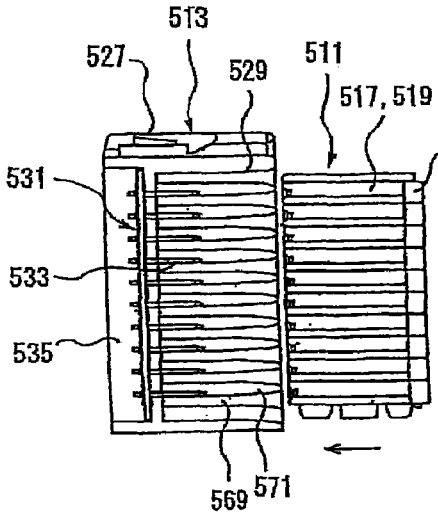
FIG. 29A illustrates a condition in which the inserting-side connector portion and the receiving-side connector portion are opposed and the inserting-side connector portion is inserted in a proper posture.

The joint connector according to the present invention is assembled as follows. As shown in FIG. 29A, the inserting-side connector portion 511 and the receiving-side connector portion 513 are opposed, and in a proper posture in which the axes of both connector portions 511 and 513 are aligned to be parallel, the inserting-side connector portion 511 is inserted into the inserting-side connector portion-receiving compartment 529 of the receiving-side connector portion 513 so that the connection pins 533 of the receiving-side connector portion 513 are inserted inside the connecting terminals 519 accommodated in the terminal-accommodating compartments 517 of the inserting-side connector portion 511; thus, the inserting-side connector portion 511 and the receiving-side connector portion 513 are fitted and connected to each other.

Figure 29B:
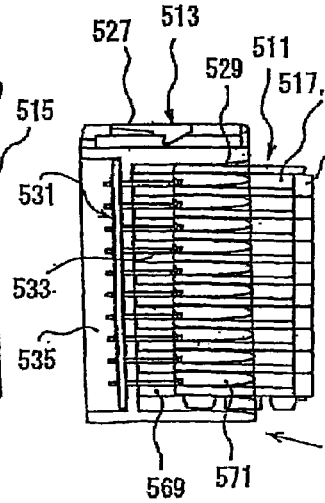
FIG. 29B illustrates a condition in which the inserting-side connector portion is inserted with its right inclined side downward.
Figure 29C:
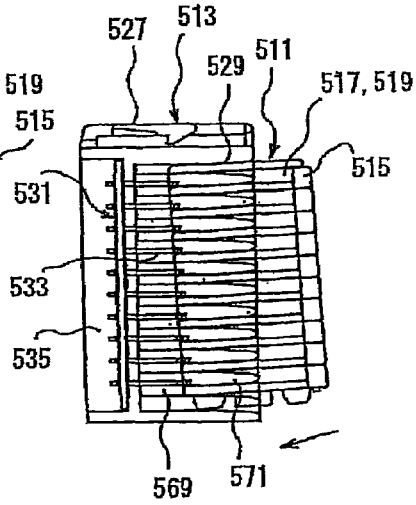
FIG. 29C illustrates a condition in which the inserting-side connector portion is inserted with its right inclined side upward.

Incidentally, in inserting the inserting-side connector portion 511 into the receiving-side connector portion 513, the axis of the inserting-side connector portion 511 often does not become parallel to the axis of the receiving-side connector portion 513. For example, there are many cases in which, as shown in FIG. 29B, the axis of the inserting-side connector portion 511 rotates clockwise relative to the axis of the receiving-side connector portion 513, so that the inserting-side connector portion 511 is inserted in a condition in which it inclines downward to the right, or as shown in FIG. 29C, the axis of the inserting-side connector portion 511 rotates anti-clockwise relative to the receiving-side connector portion 513, so that the inserting-side connector portion 511 is inserted in a condition in which it inclines upward to the right.

When the inserting-side connector portion 511 is inserted in an inclined condition as described above, the connector housings 515 quickly shift relatively to each other since the inserting-side connector portion 511 has a flexible structure as described above, and the axis of the inserting-side connector portion 511 aligns parallel to the axis of the receiving-side connector portion 513, quickly straightening the inserting-side connector portion 511 into a proper posture. Thus, the inserting-side connector portion 511 can be inserted smoothly and not forcibly with a relatively small force, and both of the connector portions 511 and 513 can be quickly fitted and connected to each other.

Figure 30:
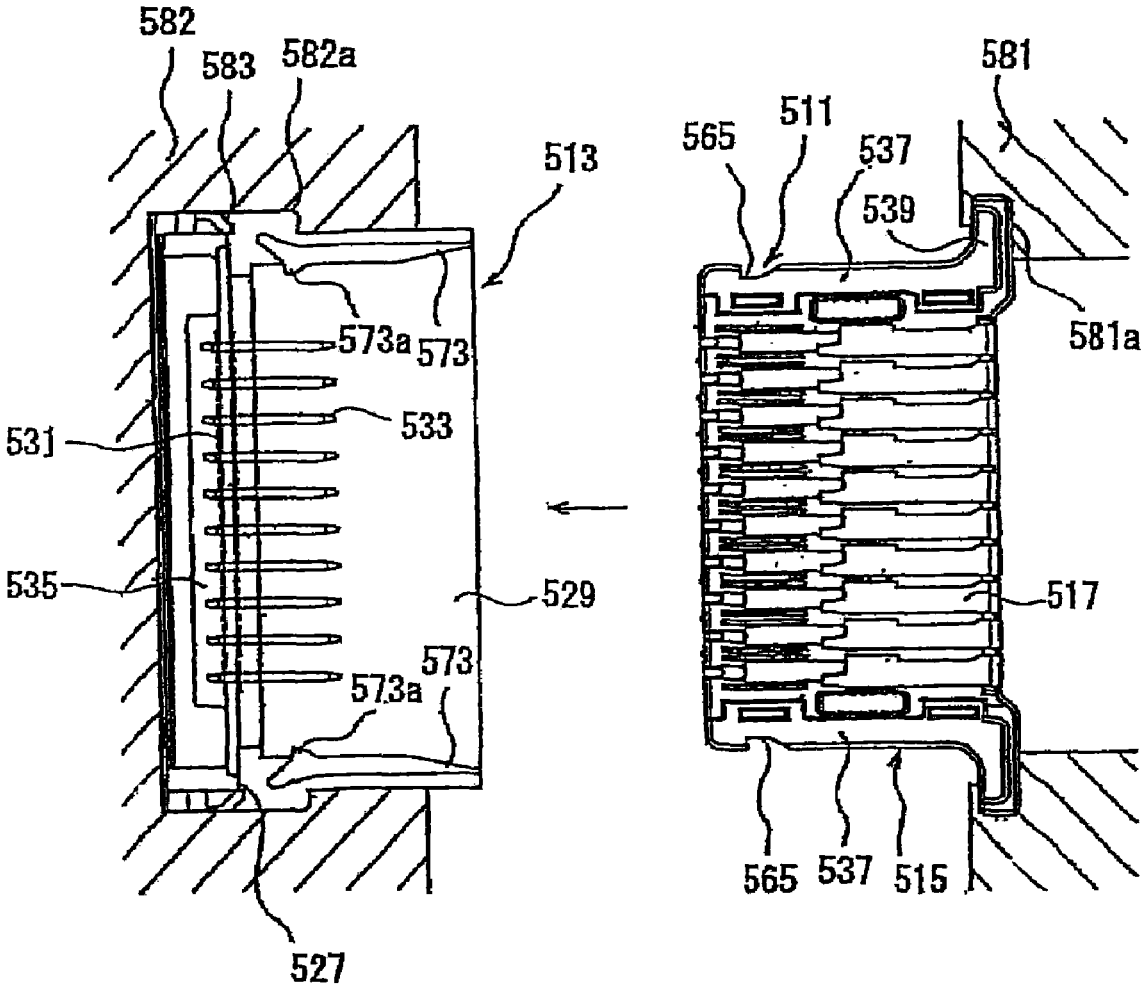
FIG. 30 is a schematic view showing the inserting-side connector portion is inserted into the receiving-side connector portion with the use of a connector retainer.

In assembling the joint connector, it is possible to use connector retainers 581 and 582 as shown in FIG. 30 to fit and connect the inserting-side connector portion 511 and the receiving-side connector portion 513 together. In this case, the support-retaining portions 581*a* of the connector retainer 581 is made to support the ear portions 539 of the connector housing 515 in the inserting-side connector portion 511, and support-retaining portions 582*a* of the connector retainer 582 are made to hold chuck portions 583 provided on the connector case 527 of the receiving-side connector portion 513 in a protruding condition. By operating the connector retainers 581 and 582, the inserting-side connector portion 511 is inserted into the receiving-side connector portion 513. It is preferable to use such connector retainers 581 and 582 since shifts of both of the connector portions 511 and 513 in vertical and lateral directions are suppressed, and the inserting-side connector portion 511 can be easily inserted into the receiving-side connector portion 513.

In addition, when inserting the inserting-side connector portion 511 into the receiving-side connector portion 513, if the number of stacked stages of the connector housings 515 in the inserting-side connector portion 511 is small, a free space is sometimes created inside the inserting-side connector portion-receiving compartment 529 of the receiving-side connector portion 513 in which the inserting-side connector portion 511 is to be inserted, making it difficult to insert the inserting-side connector portion 511. When this is the case, it is preferable to insert dummy plates in the guide grooves 569 of the inserting-side connector portion-receiving compartment 529 in which such free spaces are created in order to fill the free spaces because not only insertion of the inserting-side connector portion 511 becomes easy but also the inserted inserting-side connector portion 511 is prevented from becoming wobbly by vibrations or the like and made stable.

Figure 31:
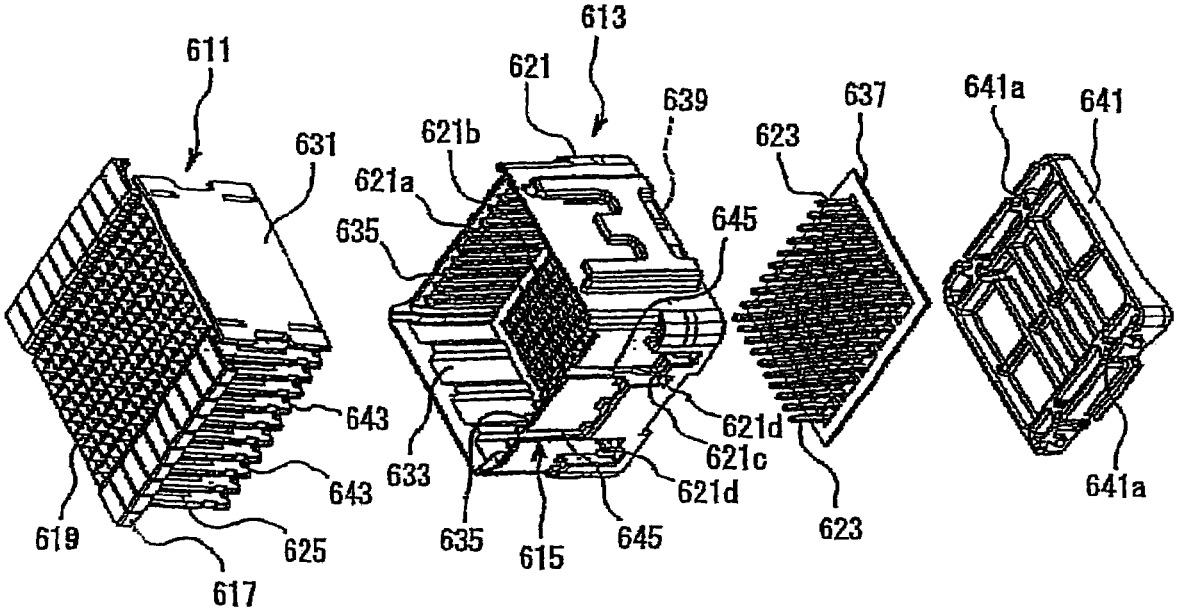
FIG. 31 is an exploded perspective view showing a joint connector according to a third embodiment of the present invention, adapted to a multi-pin connector for an automobile wire harness.

Next, a joint connector according to a third embodiment of the present invention is described in detail with reference to the drawings. FIG. 31 is an exploded perspective view showing a joint connector according to the third embodiment of the present invention, adapted to a multi-pin connector for an automobile wire harness A joint connector according to the third embodiment of the present invention is, as shown in the foregoing figure, configured as follows. The joint connector is provided with an inserting-side connector portion (stacked connector) 611 and a receiving-side connector portion (electrical connection box) 613. The inserting-side connector portion (stacked connector) 611 is provided with ten-terminal connector housings 617 that are stacked and combined in a plurality of stages (10 stages in the example shown in the figures), each of the connector housings having a plurality of terminal-accommodating compartments 619 (10 compartments in the example shown in the figure) for accommodating female terminals (not shown). The receiving-side connector portion (electrical connection box) 613 has a connector case (upper case) 621 in which the inserting-side connector portion 611 is inserted from an opening thereof and is accommodated, and a plurality of male terminals 623 (10 terminals vertically and 10 terminals horizontally, the total of 100 in the example shown in the figures) that are provided in the case 621 in a protruding condition and are to be connected to the female terminals in the connector housings 617 in the inserting-side connector portion 611. The inserting-side connector portion 611 is inserted into the receiving-side connector portion 613, and the inserting-side connector portion 611 and the receiving-side connector portion 613 are interlocked by a connector-locking means 615.

More specifically, the connector housings 617 that constitute the inserting-side connector portion 611 are formed by a plastic molding process in a plate-like shape having the same shape, structure, and size so that they can be easily and readily stacked and combined, and be easily inserted into the receiving-side connector portion 613. In their terminal-accommodating compartments 619, female terminals connected to the terminals of electric wires (not shown) constituting a wire harness are accommodated. The connector housings 617 are stacked into 10 stages in the present embodiment and are combined with each other by connector-coupling means 625.

Figure 32:
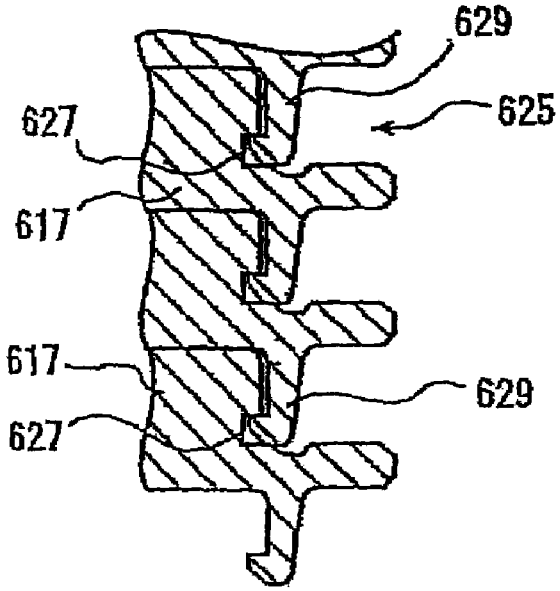
FIG. 32 is a schematic enlarged view showing a connector-coupling means in the inserting-side connector portion of FIG. 31.

The connector-coupling means 625 each have, as shown in FIGS. 31 and 32, an angular C-shaped engagement recess portion 627 and a hook-like engaging protruding portion 629 for interlocking therewith, which form a vertical pair and are provided on both side portions (only one of the side portions is shown in the example shown in the figure) of each connector housings 617. The engaging protruding portion 629 of an adjacent one of the connector housings 617 is engaged with the engagement recess portion 627 so that the connector housings 617 are connected and combined with each other. It should be noted that, although not shown in the figures, the connector-coupling means 625 is also provided with, near the engagement recess portion 627 and the engaging protruding portion 629, engaging protruding/recessed portions for restricting the relative shift of the connector housings 617 in the direction along the stacking surface. Reference numeral 631 denotes a cover that is attached on the uppermost connector housing 617 after the connector housings 617 are stacked and combined into 10 stages.

The connector case 621 of the receiving-side connector portion 613 is formed into a squared box-shape by a plastic molding process, and is provided with a first accommodating space 633 for receiving and accommodating the inserting-side connector portion 611 that is inserted from an opening on one side. On both inner wall faces of the connector case 621 provided with the first accommodating space 633, guide grooves 635 are provided, by which both side portions of the connector housings 617 of the inserting-side connector portion 611 are guided when inserted. The guide grooves 635 are juxtaposed along the longitudinal direction of the connector case 621, that is, along the inserting direction of the inserting-side connector portion 611, so as to have a predetermined gap in the vertical direction, that is, at a pitch size that matches the pitch of the female terminals accommodated in the terminal-accommodating compartments 619 of the inserting-side connector portion 611 in the connector housing stacking direction.

Figure 33:
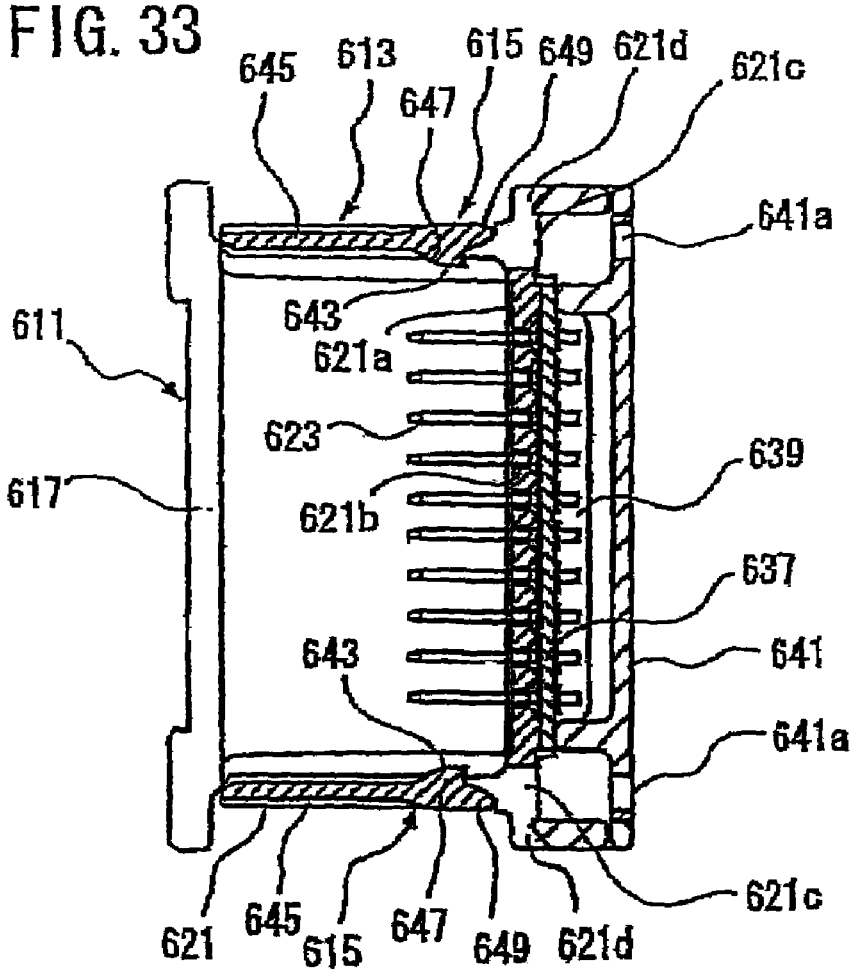
FIG. 33 a schematic cross-sectional view showing the way in which the inserting-side connector portion is inserted in the receiving-side connector portion shown in FIG. 31.

The male terminals 623 provided in the first accommodating space 633 of the connector case 621 in a protruding condition are, as shown in FIGS. 31 and 33, composed of pin-shaped connecting members made of a good conductive material such as copper, copper alloy materials, or the like. Their base ends pierce through, and are supported by, a circuit board 637 in which a circuit pattern formed of a conductive material such as a copper foil is formed on one surface (back surface) of an insulating plate of plastic or the like by printing or the like, and they are connected at the other surface (obverse surface) of the circuit board 637 to the circuit pattern by soldering.

The circuit board 637 is, as shown in FIG. 33, configured as follows; it is accommodated and held in a second accommodating space 639 provided in the opposite side of the first accommodating space 633 of the connector case 621 and separated by a partition wall 621*a*; also, the male terminals 623 protrude in the first accommodating space 633 from through holes 621*b* formed in the partition wall 621*a* so that they are inserted into and are connected with the female terminals of the inserting-side connector portion 611. It should be noted that the male terminals 623 and the circuit board 637 may be composed of a bus bar made of a good conductive material such as copper and a copper alloy material. Reference numeral 641 denotes, as shown in FIG. 31 and FIG. 33, a case cover (lower case) attached to an opening portion of the second accommodating space 639 of the connector case 621, which is for supporting and protecting the circuit board 637 accommodated in the second accommodating space 639.

As shown in FIG. 33, the connector-locking means 615, which are for interlocking the inserting-side connector portion 611 and the receiving-side connector portion 613 each other by inserting the inserting-side connector portion 611 into the receiving-side connector portion 613, are provided on both side positions according to the present embodiment so that both side portions of the connector housings 617 in the inserting-side connector portion 611 interlock with both side walls of the connector case 621 in the receiving-side connector portion 613 in which the first accommodating space 633 is provided.

Figure 34:
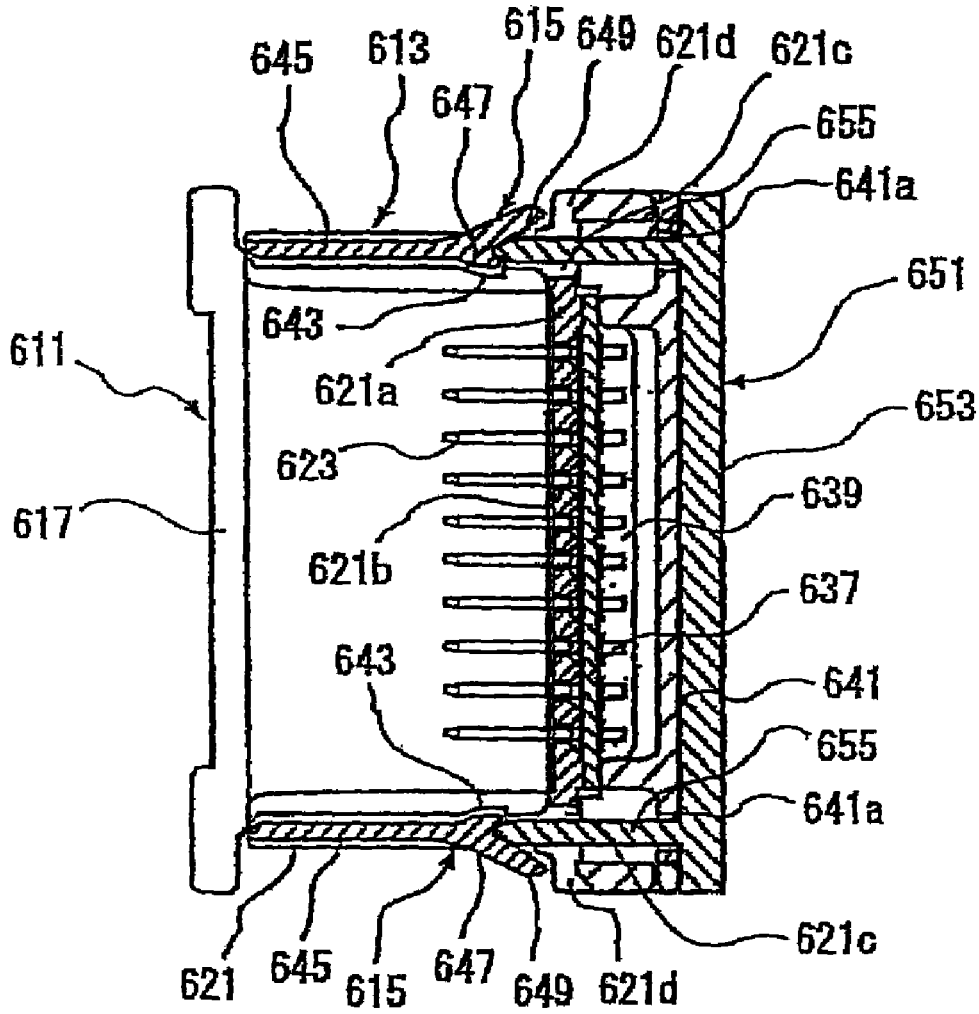
FIG. 34 is a schematic cross-sectional view showing the way in which a locked state of the inserting-side connector portion and the receiving-side connector portion is released.
Figure 35:
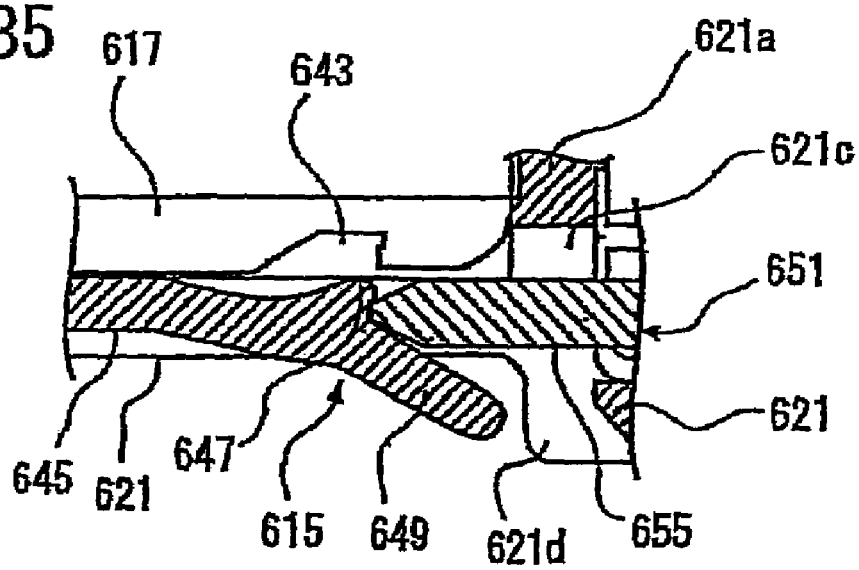
FIG. 35 is an illustration showing the way in which a claw of an engaging claw portion is disengaged from an engagement recess portion using a connector lock-releasing jig in FIG. 34.

More specifically, the connector-locking means 615 is composed of, as shown in FIGS. 33 through 35, an engagement recess portion 643 and an engaging claw portion 645. The engagement recess portion has a substantially angular C-shape, and it is provided on both side portions of each of the connector housings 617 in the inserting-side connector portion 611 and at locations relatively near the fore-end with respect to the inserting direction of the inserting-side connector portion. The engaging claw portion 645 is composed of an elastic piece having, at its fore-end, a claw 647 for engaging with the engagement recess portion 643 and a curved tab 649 diagonally extending outwardly against the claw so that it forms a substantially Y shape (substantially forked shape).

The engaging claw portions 645 are provided in a cantilevered fashion so that the claws 647 are located near the bottom side (the partition wall 621*a* side) of the first accommodating space 633 and lined with the direction in which the inserting-side connector portion 611 is inserted, and that its base ends are provided on both side walls of the connector case 621 of the receiving-side connector portion 613 provided with the first accommodating space 633 and at locations where there are the guide grooves 635 in which the third and eighth stage connector housings 617 are guided and inserted when the receiving-side connector portion 613 is inserted into the inserting-side connector portion 611 (see FIG. 31).

When the inserting-side connector portion 611 is inserted into the receiving-side connector portion 613 and accommodated in the first accommodating space 633 of the connector case 621, the claws 647 of the engaging claw portions 645 of the connector-locking means 615 are engaged with the engagement recess portions 643, locking the inserting-side connector portion 611 and the receiving-side connector portion 613 with each other, and the male terminals 623 of the receiving-side connector portion 613 are inserted into the female terminals of the inserting-side connector portion 611, so that both connector portions 611 and 613 are electrically connected (see FIG. 33).

The joint connector according to the third embodiment of the present invention is assembles as follows. In the terminal-accommodating compartments 619 of the connector housings 617, the female terminals connected to the terminals of the electric wires constituting a wire harness are accommodated, and the connector housings 617 are stacked, and are combined by the connector-coupling means 625, to obtain the inserting-side connector portion 611. Next, this inserting-side connector portion 611 is opposed to the receiving-side connector portion 613, the centers (axes) of both connector portions 611 and 613 are aligned, and the inserting-side connector portion 611 is inserted into the first accommodating space 633 of the connector case 621 in the receiving-side connector portion 613. Then, the claws 647 of the engaging claw portions 645 of the connector-locking means 615 are engaged with the engagement recess portions 643 to lock both connector portions 611 and 613, and the male terminals 623 of the receiving-side connector portion 613 side are inserted into the female terminals of the inserting-side connector portion 611 side to electrically connect both connector portions 611 and 613.

It should be noted that although in the above-described embodiment, the connector-locking means 615 are provided at positions on both sides so as to lock both side portions of the connector housings 617 in the inserting-side connector portion 611 with the both side walls of the connector case 621 in the receiving-side connector portion 613, it is possible that they are provided on one of the sides so that one of the side portions of the connector housings 617 in the inserting-side connector portion 611 is locked with one of the side walls of the connector case 621 in the receiving-side connector portion 613 that opposes the one of the side portions.

Since the connector-locking means 615 are provided at side locations when viewed in the inserting direction so that the side portions of the connector housings 617 of the inserting-side connector portion 611 are locked with the side walls of the connector case 621 in the receiving-side connector portion 613, one or a plurality of lock supporting points for locking the connector housings 617 vertically stacked into a plurality of stages shifts/shift from the uppermost end locations of both connector portions 611 and 613 to arbitrary midway locations vertically, and the distance from the lock supporting points of the connector-locking means 615 to free ends, such as the uppermost end and lowermost end positions of both connector portions 611 and 613, is shortened.

As a result, the number of connector housings 617 stacked between the lock supporting point of the connector-locking means 615 and the respective free ends becomes less, so that the accumulated amount of backlash caused between the connector housings 617 is reduced and the connector housings 617 are prevented from shifting and being lifted in the direction in which it is removed from the receiving-side connector portion 613 due to the effect of the foregoing tensile force.

Therefore, even when the number of stacked stages of the connector housing 617 is increased in the inserting-side connector portion 611, a good connecting state between the inserting-side connector portion 611 and the receiving-side connector portion 613 is maintained and the performance and reliability of the joint connector can be improved.

In addition, it is preferable to provide the connector-locking means 615 at the positions on both sides so that both side portions of the connector housings 617 of the inserting-side connector portion 611 are locked with both side walls of the connector case 621 in the receiving-side connector portion 613 because, if a tensile force such as to pull the connector housings 617 out of the receiving-side connector portion 613 acts on the connector housings 617 of the inserting-side connector portion 611, the connector housings 617 are firmly held by the connector-locking means 615 at both side ends and are stabilized and the joint connector becomes strong.

It is also preferable that the connector-locking means 615 is made of the engagement recess portion 643 and the engaging claw portion 645 composed of an elastic piece having at its fore-end the claw 647 for engaging with the engagement recess portion 643, since the engaging operation in the connector-locking means becomes smooth and their engagement failure becomes infrequent, so connection of the inserting-side connector portion with the receiving-side connector portion is made more reliable.

The connector-locking means 615 may be configured such that, as opposed to the above-described embodiment, its engagement recess portions 643 are provided on the side walls of the connector case 621 in the receiving-side connector portion 613, and the engaging claw portions 645 are provided on the side portions of connector housings 617 of the inserting-side connector portion 611.

As in the foregoing embodiment, it is preferable to provide the engagement recess portions 643 having generally a simple shape and structure on the side portions of the connector housings 617 in the inserting-side connector portion 611 and to provide the engaging claw portions 645 having a more complex shape and structure than the engagement recess portion 643 on the side walls of the connector case 621 in the receiving-side connector portion 613 in a cantilevered fashion, since manufacture of the joint connector becomes easier and less costly and, in addition, size reduction can be achieved.

The engaging claw portions 645 of the connector-locking means 615 may be provided so as to correspond to the engagement recess portions 643 provided on the respective connector housings 617 of the inserting-side connector portion 611; however, as in the foregoing embodiment, even if they are provided at positions on the side walls of the connector case 621 that correspond to the third and eighth stage connector housings 617, any stages of the connector housing 617 are not loosened or lifted when a tensile force such as to pull out the connector housings 617 acts thereon after locking the inserting-side connector portion 611 and the receiving-side connector portion 613, and a good connecting state can be maintained.

Accordingly, the locations of and the number of the engaging claw portions 645 to be provided are not limited to the foregoing embodiment and may be appropriately changed according to the number of stacked connector housings 617, the environment and conditions in which the joint connector is used, or the like. Generally, the number of the engaging claw portions should be increased when the number of stacked stages of the connector housings 617 is large, but be reduced when the number of stacked stages thereof is small. When the number of the engaging claw portion 645 provided on the side wall of the connector case 621 is one, it is preferable to provide it at the center position that is the intermediate point along the vertical direction of the connector case 621. Meanwhile, the engagement recess portions 643 are provided for each of the connector housings 617 since it is desirable that the connector housings 617 are formed to have the same shape, structure, and size so that they can be easily stacked and combined, or inserted into the receiving-side connector portion 613; however, they may be provided only on the side portions of the connector housings 617 corresponding to the engaging claw portions 645, and the number thereof is not limited to that described in the present embodiment.

To release the locked state of the inserting-side connector portion 611 and the receiving-side connector portion 613, a simple connector lock-releasing jig 651 as shown in FIGS. 34 and 35 is used, in which a four rod-like pushing members 655 the fore-ends of which are formed in a tapered shape are protruded from a support member 653 made of a rectangular plate at positions corresponding to the positions in the connector-locking means 615 at which the engaging claw portions 645 are provided.

The four pushing members 655 of the connector lock-releasing jig 651 are passed through four piercing holes 641*a* formed in the case cover 641 in the receiving-side connector portion 613 and through holes 621*c* provided in the connector case 621, and are pushed in the axis direction of the engaging claw portions 645 by pressing the fore-ends of respective pushing members 655 onto inclined inner side faces 649*a* of the curved tabs 649 of the engaging claw portions 645. By doing so, the curved tabs 649 are deformed outwardly and bent away from the side walls of the connector case 621 against the elasticity of the elastic piece, and the claws 647 are easily disengaged from the engagement recess portions 643; thus, the connector-locking means 615, that is, the locked state of both connector portions 611 and 613 is released, and the inserting-side connector portion 611 can be easily and readily pulled out and separated from the receiving-side connector portion 613. After the locked state being released, the engaging claw portions 645 quickly return to their original positions because of their elasticity.

Figure 36:
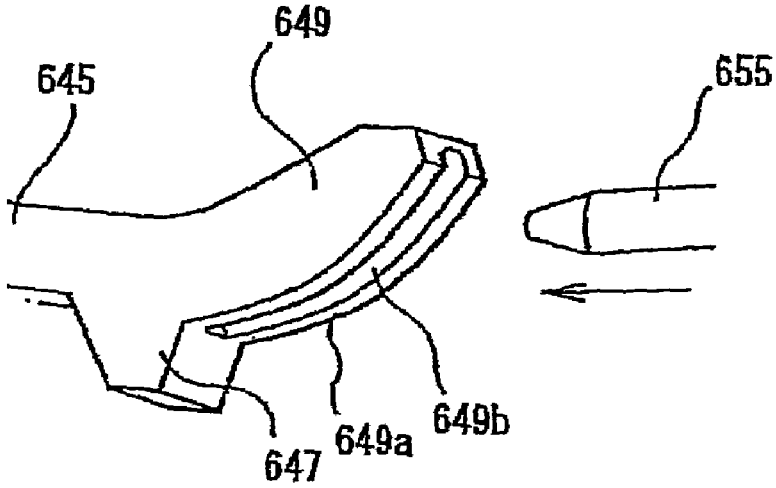
FIG. 36 is a perspective view showing a modified example of the engaging claw portion in a connector-locking means.

It should be noted that there may be cases where the fore-end portions of the pushing members 655 or the curved tabs 649 are caused to slide aside when pressing the fore-ends of the pushing members 655 of the connector lock-releasing jig 651 against the inner side faces 649*a* of the curved tabs 649 of the engaging claw portions 645, and the claws 647 of the engaging claw portions 645 do not easily come off from the engagement recess portions 643, inhibiting a quick release of the locked state between both connector portions 611 and 613. If this is the case, it is preferable that, as shown in FIG. 36, the inner side face 649*a* of the engaging claw portion 645 is provided with a recessed groove 649*b* having, for example, a U-shaped cross-sectional shape in which the fore-end of the pushing member 655 enters along its longitudinal direction of the curved tab 649. When the recessed groove 649*b* is provided, the pushing member 655 is pressed in the axis direction of the engaging claw portion 645 (the direction indicated by the arrow) while it is being guided by the recessed groove 649*b*, and therefore, the relative slide (sideway drift) of the pushing member 655 or the curved tab 649 is prevented reliably.

Figure 37:
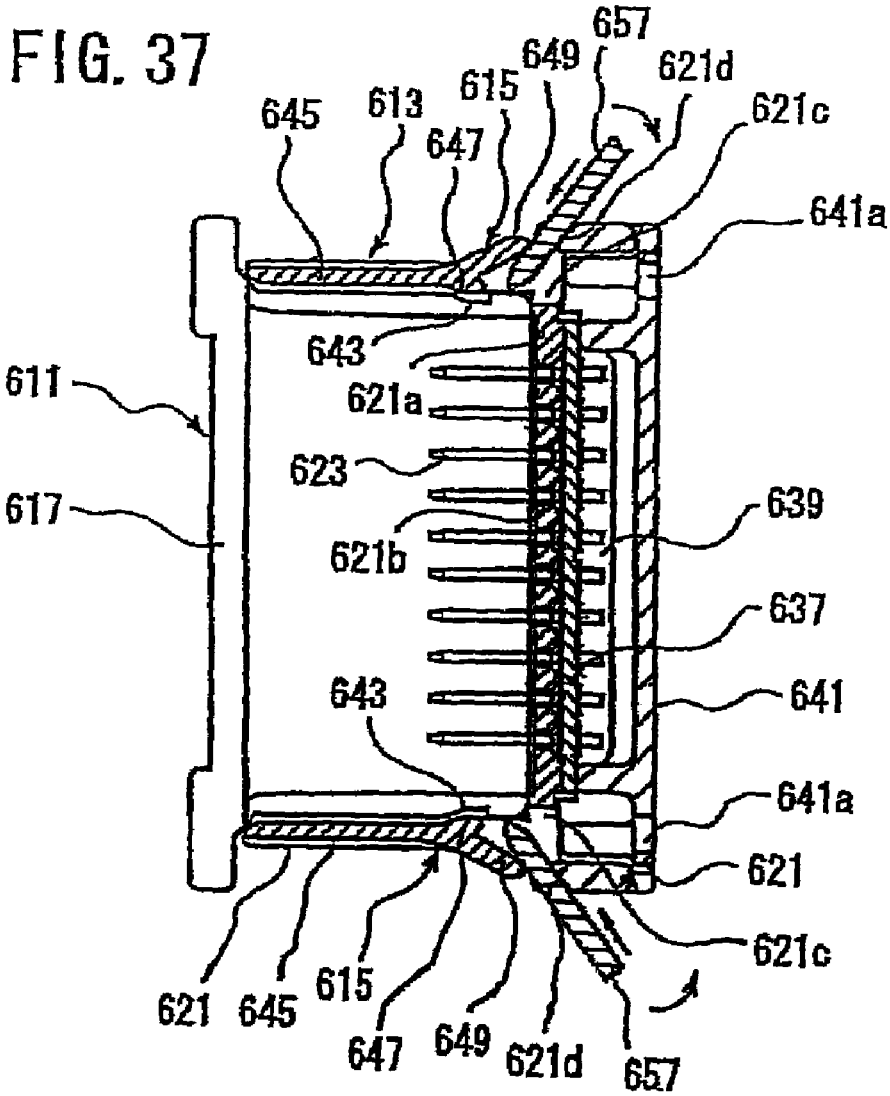
FIG. 37 is a schematic cross-sectional view showing the way in which a locked state between the inserting-side connector portion and the receiving-side connector portion is released using a commercially available screw driver.

In addition, in cases where the connector lock-releasing jig 651 is not available (for example, in cases where the locked state needs to be released at a small-scale garage in a town), a small, flat head screwdriver driver 657 as shown in FIG. 37 is passed through four inclined holes 621*d* formed diagonally in the vicinity of the locations at which the curved tabs 649 of the engaging claw portions 645 of the connector case 621 are provided, one at a time. Then, its fore-end is pressed against the curved tab 649, and the screwdriver 657 is tilted until the side face of the shaft of the screwdriver 657 hits the slope and the entrance edge of the inclined hole 621*d*, so that the curved tab 649 is deformed outwardly and the claw 647 is set free and disengaged from the engagement recess portion 643. This operation is repeated four times to release the locked state between both connector portions 611 and 613.

Thus, it is preferable to use the engaging claw portion 645 having the curved tab 649, since the inserting-side connector portion 611 can be easily and readily pulled out and separated from the receiving-side connector portion 613 merely using the simple connector lock-releasing jig 651 or the commercially available driver 657 and replacement, repair, or the like of the connector can be made conveniently.

Next, a joint connector according to a fourth embodiment of the present invention is described in detail with reference to the drawings.

Figure 38:
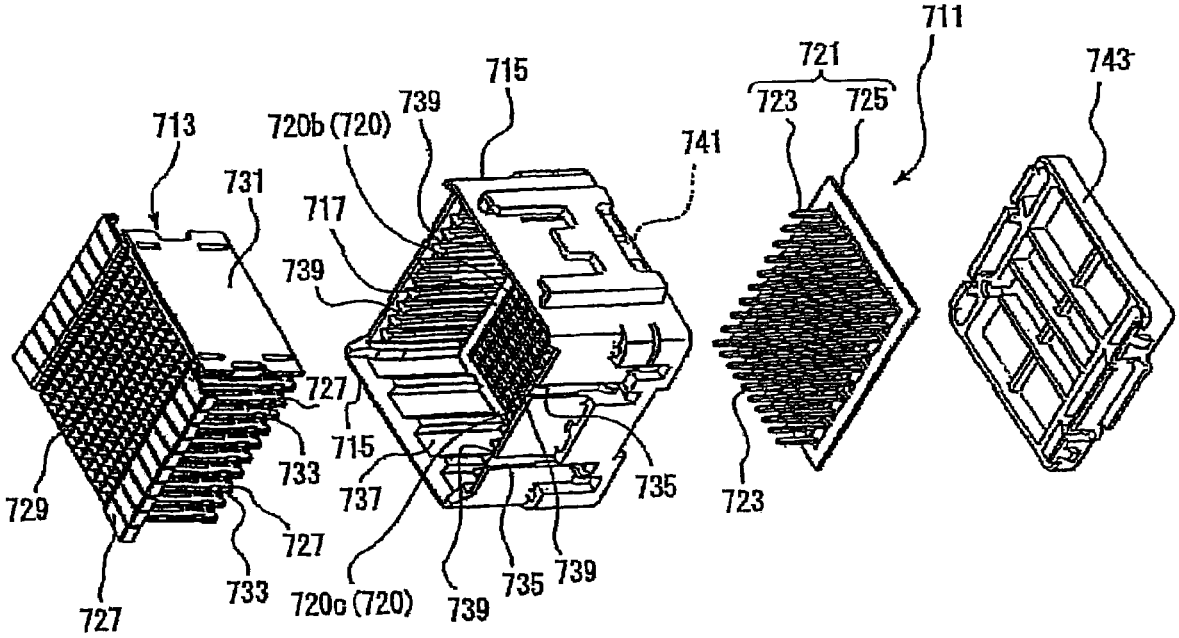
FIG. 38 is an exploded perspective view showing a joint connector according to a fourth embodiment of the present invention, into which an external connector is inserted.
Figure 39:
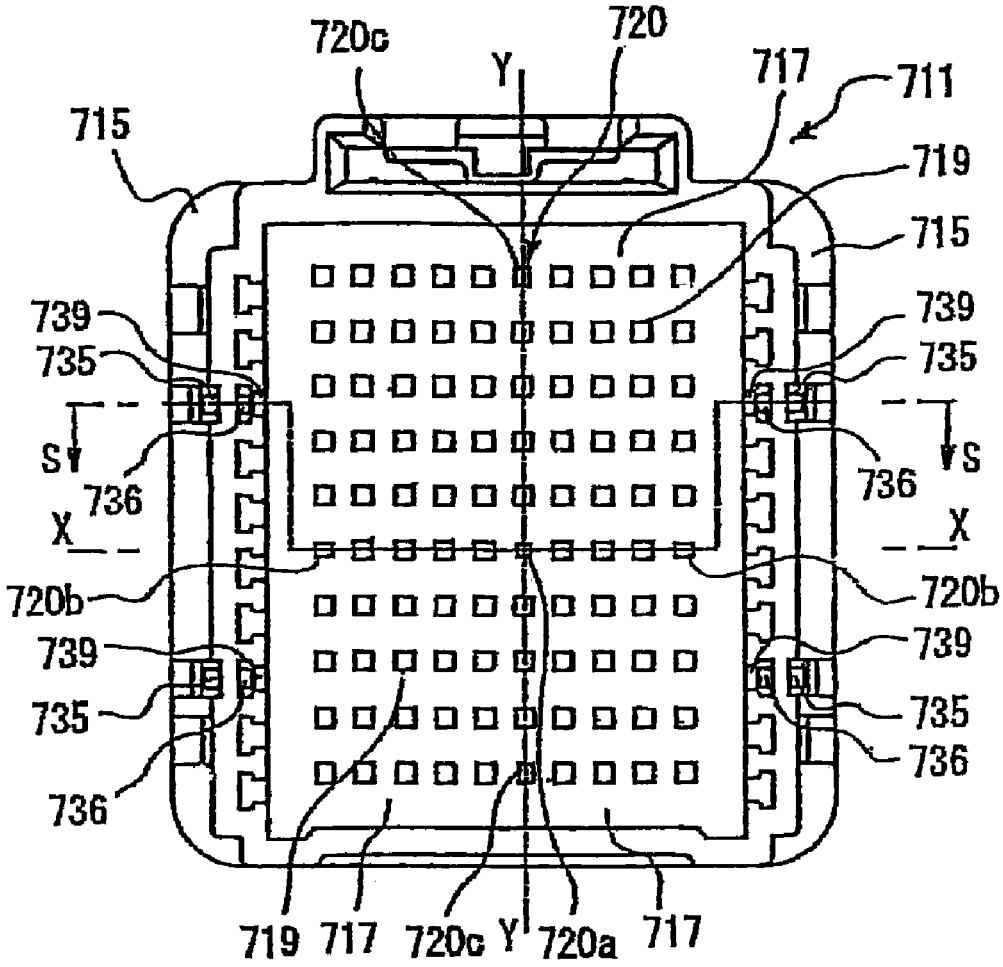
FIG. 39 is a front view of the joint connector of FIG. 38, viewed from a side from which an external connector is inserted, where its male terminals are not shown.
Figure 40:
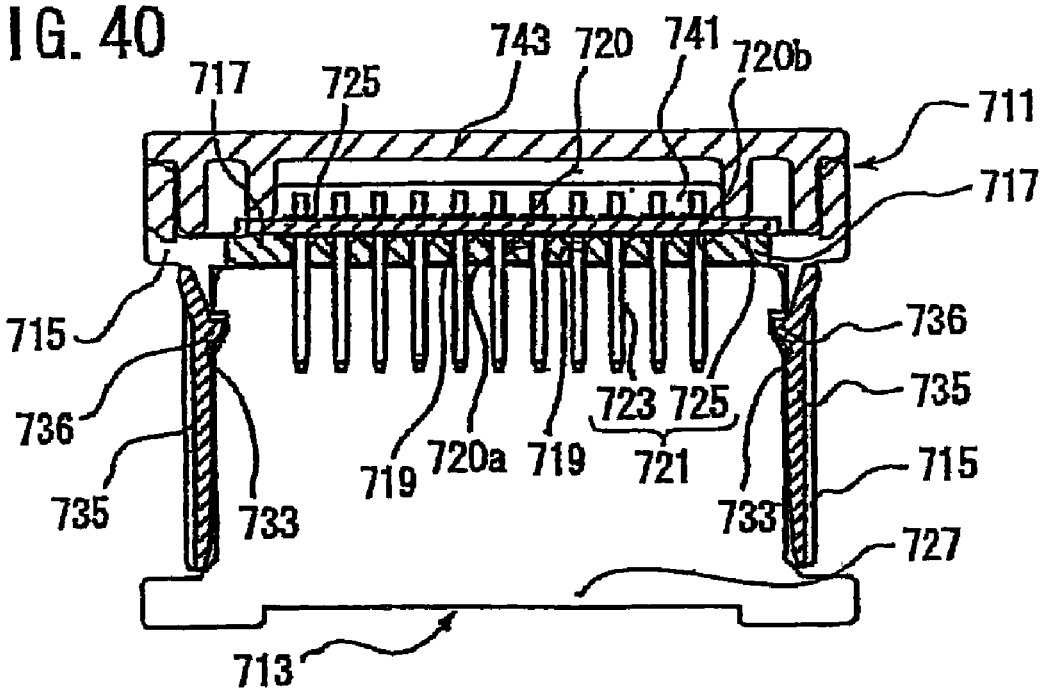
FIG. 40 is a partially-omitted cross-sectional view showing the way in which an external connector is inserted into the joint connector, taken along line S-S in FIG. 39.

FIG. 38 is an exploded perspective view showing one embodiment of a joint connector 711 according to the fourth embodiment of the present invention, into which an external connector 713 is inserted. FIG. 39 is a front view of the joint connector of FIG. 38, viewed from a side from which the external connector is inserted. FIG. 40 is a partially-omitted cross-sectional view taken along line S-S in FIG. 39, showing the joint connector 711 in which an external connector 713 is inserted.

The joint connector according to the fourth embodiment of the present invention is used as a multi-pin connector for an automobile wire harness. As shown in FIGS. 38 through 40, it is provided with a connection case (upper case) 715 in which an external connector 713 for accommodating a plurality of female terminals (not shown) is inserted (including external insertion), and a circuit-forming unit 721 attached to a base wall 717 of the connection case 715 and having a plurality of male terminals 723 (100 terminals in the example shown in the figures) and a holder 725 for supporting them, the male terminals 723 protruding in the connection case 715 through a plurality of male terminal piercing holes 719 (100 holes in the example shown in the figures) formed in the base wall 717.

As shown in FIG. 38, the external connector 713 is configured by a stacked connector having 10 connector housings 727 each having a plurality of terminal-accommodating compartments 729 (10 compartments in the example shown in the figures) that are for accommodating female terminals (not shown) connected to terminals of electric wires (not shown) for a wire harness and are juxtaposed into a single layer. The connector housings 727 are formed in a plate shape by a plastic molding process so as to have the same structure and size, and are stacked into a plurality of stages (10 stages in the example shown in the figures). The connector housings 727 are combined by connector-coupling means (not shown), and on the uppermost stage connector housing 727, a cover 731 is attached.

Reference numeral 733 denotes substantially angular C-shaped engagement recess portions provided on both side portions of the connector housings 727 near their fore-ends to detachably lock (fix) the external connector 713 inserted in the joint connector 711 so that it does not come out of the joint connector 711, and they engage with the later-described engaging claw portions 735 provided on the connection case 715 to lock the external connector 713 when the external connector 713 is inserted into the joint connector 711. It should be noted that various other types than the stacked connector may be used for the external connector 713, and for example, one in which a plurality of terminal-accommodating compartment 729 are provided in a connector block formed of plastic may be used.

The connection case 715 is, as shown in FIG. 38, formed by processing a plastic material into a squared box shape and is provided with a connector accommodating compartment 737 for receiving and accommodating the external connector 713 inserted from one opening thereof. On both inner wall faces of the connection case 715 provided with the connector accommodating compartment 737, guide grooves 739 by which both side portions of the connector housings 727 in the external connector 713 are guided and inserted are juxtaposed along the longitudinal direction of the connection case 715, that is, along the inserting direction of the external connector 713, and at intervals that match the stacking intervals of the connector housings 727 of the external connector 713.

Engaging claw portions 735 (see FIGS. 38 and 40) are provided in a cantilevered fashion on both side walls of the connection case 715 provided with the connector accommodating compartment 737 and at locations where there are the guide grooves 739 into which, for example, the third and eight stage connector housings 727 of the external connector 713 are guided and inserted when the connector 713 is inserted into the connection case 715. Each of the engaging claw portions 735 is composed of an elastic piece and has on its fore-end a claw 736 for engaging with an engagement recess portion 733 provided on the connector housings 727 of the external connector 713.

The 100 male terminals 723 protruding in the connector accommodating compartment 737 of the connection case 715 are, as shown in FIGS. 38 and 40, are each composed of a pin-shaped connecting member made of a good conductive material such as copper and a copper alloy material. These male terminals 723 are formed to have, for example, a squared cross-sectional shape and to have the same width, height, and length. The shape of the male terminals 723 may be a rectangular cross-sectional shape, a circular cross-sectional shape, or the like. The holder 725 is composed of a circuit board in which a circuit pattern formed of a conductive material such as a copper foil is provided on one surface (reverse surface) of an insulating plate of plastic or the like. Base ends of the male terminals 723 are supported on another surface (obverse surface) of the holder 725 by passing through holder 725 and are connected to the circuit pattern. It should be noted that the male terminals 723 and the holder 725 constituting the circuit-forming unit 721 may be composed of a bus bar made of a good conductive material such as copper and a steel alloy material.

The circuit-forming unit 721 is, as shown in FIG. 40, configured as follows. It is accommodated in a circuit-forming unit-accommodating compartment 741 provided in the opposite side to the connector-accommodating compartment 737 of the connection case 715 and separated by a base wall 717, and is attached on the base wall 717 of the connection case 715, and the male terminals 723 of the circuit-forming unit 721 protrude inside the connector accommodating compartment 737 through the male terminal piercing holes 719 formed in the base wall 717 so that they are inserted into the female terminals of the external connector 713 and connected therewith. Reference numeral 743 is, as shown in FIGS. 38 and 40, a case cover (lower case) attached to the opening of the circuit-forming unit-accommodating compartment 741 of the connection case 715, for holding and protecting the circuit-forming unit 721 accommodated in the circuit-forming unit-accommodating compartment 741.

Meanwhile, among the plurality of male terminal piercing holes 719 (100 holes in the example shown in the figures) formed in the base wall 717 of the connection case 715, some of the male terminal piercing holes 719 are made into reference holes 720 smaller than the other male terminal piercing holes 719 so that the circuit-forming unit 721 can be accurately positioned and mounted when the circuit-forming unit 721 is mounted to the base wall 717 of the connection case 715.

More specifically, for example, in the example shown in FIG. 39, among the 100 male terminal piercing holes 719, five male terminal piercing holes 719 are made to have a smaller shape than the other male terminal piercing holes 719, whereby reference holes 720*a*, 720*b*, and 720*c* are formed. That is, the reference hole 720*a* is formed by making smaller the male terminal piercing hole 719 that is formed in the vicinity of the center of the base wall 717 of the connection case 715. The reference holes 720*b* are formed by making smaller two male terminal piercing holes 719 that are at a plurality of positions radially spaced from the reference hole 720*a*, the vicinity of the center of the connection case, each one of which is respectively in the left and right peripheral portions (left and right side end portions) spaced along the X-axis in the example of the figure. In addition, the reference holes 720*c* are formed by making smaller two male terminal piercing holes 719 that are at a plurality of positions radially spaced from the reference hole 720*a*, the vicinity of the base wall of the connection case, each one of which is respectively in the upper and lower peripheral portions (upper and lower end portions) spaced along Y-axis in the example of the figure.

The male terminal piercing holes 719 and reference holes 720 are formed to have an angular cross-sectional shape, and except the reference holes 720*b* and 720*c*, the male terminal piercing holes 719 and the reference hole 720*a* are formed to have a squared cross-sectional shape. Except for the reference hole 720, the male terminal piercing holes 719 are formed in a squared cross-sectional shape with a size having a gap such that the male terminals 723 can be easily inserted therein.

Although the reference hole 720*a* has a squared cross-sectional shape, its axis diametrical size along the X-axis and its axis diametrical size along the Y-axis are made shorter than those of the other male terminal piercing holes 719 except the reference hole 720, so it is formed smaller. This reduces the vertical and horizontal clearances of the male terminal 723 that passes through the reference hole 720*a*, suppressing side-to-side rattling (backlash) of the male terminal 723 in the X-axis direction and the Y-axis direction.

Likewise, the two reference holes 720*b* on the right and left are formed small such that their axis diametrical size along the Y-axis is smaller than the axis diametrical size along the corresponding axis (Y-axis) of the other male terminal piercing holes 719 except the reference holes 720; this reduces the clearances with the male terminals 723 along the Y-axis, thereby suppressing side-to-side rattling (backlash) of the male terminals 723 that are inserted in the reference holes 720*b* more reliably, with respect to the Y-axis direction. On the other hand, their axis diametrical size with respect to the X-axis is not different from the axis diametrical size of the male terminal piercing holes 719 other than that of the reference holes 720 with respect to the corresponding axis (X-axis). Therefore, these reference holes 720*b* have a rectangular shape with long sideways, and some margin is created in the clearances between the reference holes 720*b* and the male terminals 723 with respect to the X-axis. For this reason, the male terminals 723 can be easily passed through the reference holes 720*c* even when a positional deviation with respect to the X-axis is caused between the male terminal piercing holes 719 and the male terminals 723 opposed to each other as the amount of pitch variation with respect to the X-axis between the male terminal piercing holes 719 and the male terminals 723 is accumulated as they are spaced farther from the respective central areas of the base wall 717 of the connection case 715 and the circuit-forming unit 721 in the X-axis direction.

Moreover, the reference holes 720*c* at the top and bottom are formed small such that their axis diametrical size with respect to the X-axis is shorter than the axis diametrical size of the other male terminal piercing holes 719 except the reference holes 720 with respect to the corresponding axis (X-axis); this reduces the clearance with the male terminals 723 with respect to the X-axis, thereby suppressing side-to-side rattling (backlash) of the male terminals 723 inserted into the reference holes 720*c* more reliably with respect to the X-axis. On the other hand, their axis diametrical size with respect to the Y-axis is not different from the axis diametrical size of the male terminal piercing holes 719 other than the reference holes 720 with respect to the corresponding axis (Y-axis). Therefore, these reference holes 720*c* have a vertically long rectangular shape, and some margin is created in the clearances between the reference holes 720*c* and the male terminals 723 with respect to the Y-axis. For this reason, the male terminals 723 can be easily passed through the reference holes 720*c* even when a positional deviation with respect to the Y-axis is caused between the male terminal piercing holes 719 and the male terminals 723 that are opposed to each other since the amount of pitch variation with respect to the Y-axis between the male terminal piercing holes 719 and the male terminals 723 is accumulated as they are spaced farther from the vicinity of the centers of the base wall 717 of the connection case 715 and the circuit-forming unit 721 in the Y-axis direction. In this way, when mounting the circuit-forming unit 721 to the base wall 717 of the connection case 715, the circuit-forming unit 721 can be accurately positioned. In addition, mounting of the circuit-forming unit 721 can be made easily, and efficiency in manufacturing (assembling) the joint connector 711 can be improved. It should be noted that the shapes of the male terminal piercing holes 719 and the reference holes 720 may be such shapes as a circular cross-sectional shape and an elliptic cross-sectional shape, other then the angular cross-sectional shape such as a squared cross-sectional shape, a rectangular cross-sectional shape, and a triangular cross-sectional shape.

The reference holes 720 may be such a hole/holes as formed small only among one or a plurality of the male terminal piercing holes 719 that are formed in the vicinity of the center of the base wall 717 of the connection case 715, other than those shown in FIG. 39. In addition, they may be such a hole/holes formed small out of only one or a plurality of the male terminal piercing holes 719 that are spaced radially (along the X-axis, the Y-axis, or the X and Y axes) from the vicinity of the center of the base wall 717 to arbitrary positions. Further, they may be such a hole/holes formed small out of the male terminal piercing holes 719 formed in the vicinity of the center and the male terminal piercing holes 719 formed at one or a plurality of positions that are spaced to arbitrary positions along the X-axis, the Y-axis, or the X and Y axes.

When one reference hole 720 is formed to be small out of the male terminal piercing holes 719, it is desirable to make its axis diametrical size with respect to the X-axis and its axis diametrical size with respect to the Y-axis smaller than those of the male terminal piercing holes 719 other than the reference hole 720. Even in cases where a plurality of reference holes 720 are arranged spaced from each other, if they are arranged only on the X-axis or on the Y-axis, their axis diametrical size with respect to the X-axis and their axis diametrical size with respect to the Y-axis are made smaller than those of the male terminal piercing holes 719 other than the reference holes 720, as in the case of only one reference hole.

Thus, by forming some of the male terminal piercing holes 719 to be reference holes 720, which are smaller than the other male terminal piercing holes 719 among the plurality of male terminal piercing holes 719 formed in the base wall 717 of the connection case 715, the reference holes 720 and the male terminals 723 passing through the reference holes 720 can be utilized as the conventional positioning hole and the conventional positioning protrusion, respectively. Consequently, when mounting the circuit-forming unit 721 to the base wall 717 of the connection case 715, the male terminals 723 are passed through the reference holes 720 at small clearances so that the circuit-forming unit 721 can be quickly guided and held in a predetermined location. Thereby, the circuit-forming unit 721 can be accurately positioned without additionally providing the positioning protrusions and the positioning holes that have been required conventionally. As a result, when the circuit-forming unit 721 is mounted to the base wall 717, the male terminals 723 protruding in the connection case 715 do not deviate from predetermined locations, and when the external connector 713 is inserted into the joint connector 711, the male terminals 723 and the female terminals are aligned so that poor connections between both terminals are prevented. Thus, performance and reliability of the joint connector 711 can be improved.

Moreover, it becomes unnecessary to provide a space for providing the positioning protrusion in the base wall 717 of the connection case 701 and a space for forming the positioning hole in the holder 725 of the circuit-forming unit 721, and in addition, it is unnecessary to form the shape of the circuit pattern on the holder 725 so that the wiring greatly extends outwardly to get around the positioning hole. Therefore, the shapes of the connection case 715 and the circuit-forming unit 721 become smaller, thus making the joint connector 711 small and lightweight. Furthermore, since the shapes of the connection case 715 and the circuit-forming unit 721 become smaller and the positioning protrusion is eliminated, cost of the materials can be reduced and accordingly the cost of the joint connector 711 can be reduced.

Further, because the reference hole 720 is formed to be small out of the male terminal piercing holes 719 formed in the vicinity of the center of the base wall 717 of the connection case 715, the reference hole 720 is formed at a location in the vicinity of the center of gravity of the circuit-forming unit 721. Therefore, the circuit-forming unit 721 can be positioned in a well-balanced manner, and the circuit-forming unit 721 can be easily mounted to the base wall 717 of the connection case 715.

In addition, since the reference holes 720 is formed to be small out of the male terminal piercing holes 719 formed at a plurality of positions radially spaced from the vicinity of the center of the base wall 717 of the connection case 715, the circuit-forming unit 721 can be positioned in a well-balanced manner and the accuracy in the positioning can be improved even when the number of the male terminals 723 in the circuit-forming unit 721 is increased.

Moreover, the reference holes 720 (720*b* and 720*c*) are the male terminal piercing holes 719 formed at a plurality of positions radially spaced from the vicinity of the center of the base wall 717 of the connection case 715, and they are formed to be small by making their axis diametrical size with respect to the Y-axis of the male terminal piercing holes 719 formed at locations spaced along the X-axis and their axis diametrical size with respect to the X-axis of the male terminal piercing holes 719 formed at locations spaced along the Y-axis shorter than the respective axis diametrical sizes with respect to the corresponding axes of those male terminal piercing holes 719 other than the reference holes 720. Therefore, side-to-side rattling (backlash) of the male terminal 723 inserted into the reference holes 720 (720*c* and 720*c*) can be suppressed with respect to the X-axis direction and the Y-axis direction, and the circuit-forming unit 721 can be accurately positioned.

Furthermore, since the axis diametrical size with respect to the X-axis of the reference holes 720*b* formed on the X-axis and the axis diametrical size with respect to the Y-axis of the reference holes 720*c* formed on the Y-axis are not different from the corresponding axis diametrical sizes of the other male terminal piercing holes 719, some margin is created in the clearance between the reference holes 720*b* and the male terminals 723 with respect to the X-axis and in the clearance between the reference holes 720*c* and the male terminals 723 with respect to the Y-axis. Thus, even when a positional deviation is caused between the male terminal piercing holes 719 and the male terminals 723 in the X-axis or Y-axis direction, the male terminals 723 of the circuit-forming unit 721 can be passed through the reference holes 720 (720*b* and 720*c*) not forcibly in mounting the circuit-forming unit 721 to the base wall 717 of the connection case 715; thus mounting of the circuit-forming unit can be made easy.

The joint connector 711 of the present invention has such a configuration as described above. When using the joint connector 711, the external connector 713 is opposed to the connector accommodating compartment 737 of the connection case 715 in the joint connector 711, then the centers of the joint connector 711 and the external connector 713 are aligned, and the external connector 713 is inserted into the connector accommodating compartment 737 of the joint connector 711. Then, the claws 736 of the engaging claw portions 735 on the joint connector 711 side are engaged with the engagement recess portions 733 on the external connector 713 side to lock the external connector 713 with the joint connector 711, and meanwhile, the male terminals 723 on the joint connector 711 side are inserted into the female terminals on the external connector 713 side to make connection.

Figure 41:
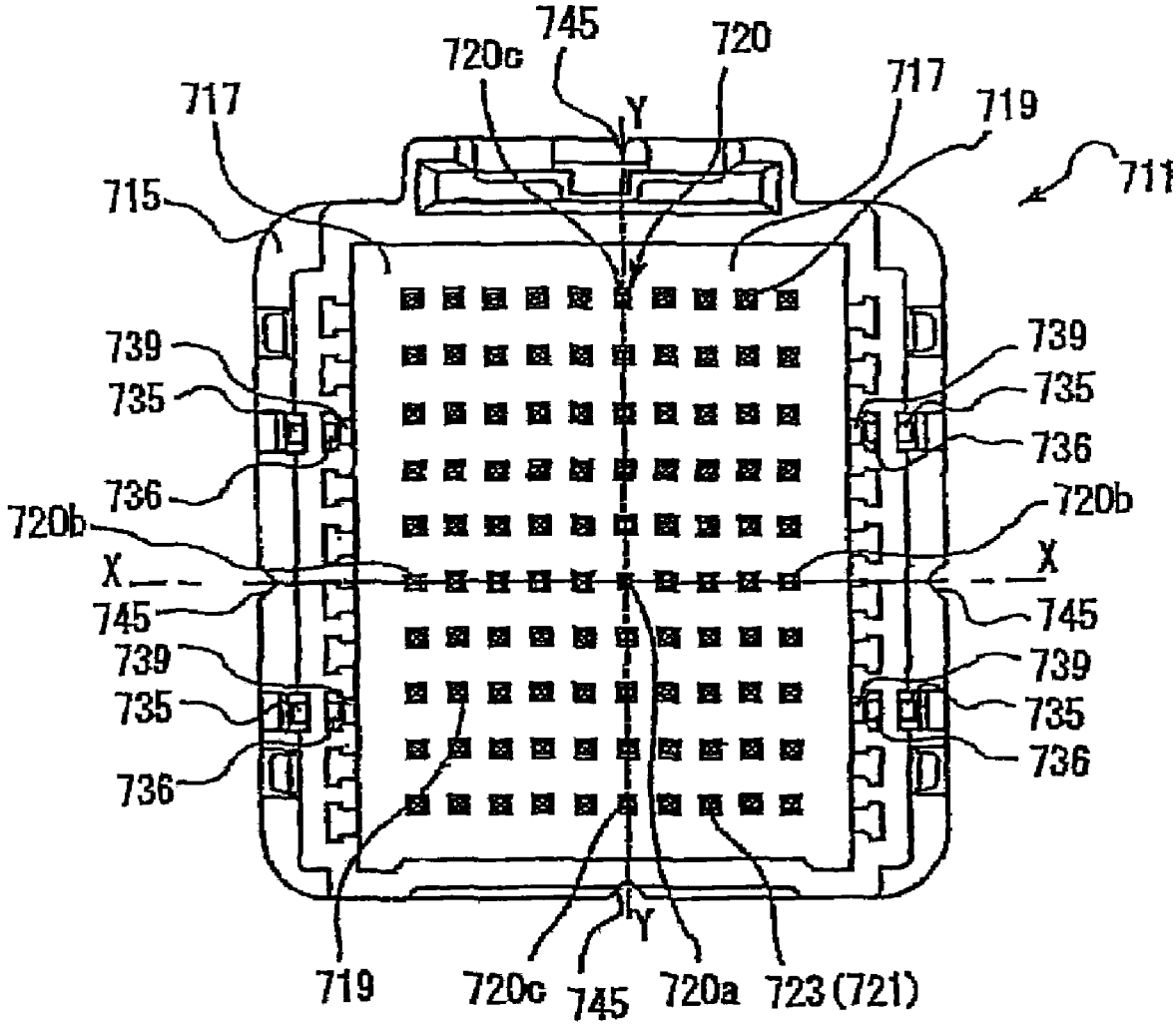
FIG. 41 is a front view showing another embodiment of the joint connector according to the present invention, viewed from a side from which an external connector is inserted.

FIG. 41 shows, in the joint connector 711 of the embodiment depicted in, for example, FIGS. 38 through 40, guide grooves 745 having, for example, a V-shaped cross-sectional shape provided along the direction in which the external connector 713 is inserted and at four locations on the outer peripheral surface of the connection case 715, that is, at respective four locations on both side faces along the X-axis and on the top and bottom faces along the Y-axis direction. These guide grooves 745 are provided for smoothly inserting a continuity testing jig (not shown) into the joint connector 711 while aligning their center axes, and the continuity testing jig is provided with guiding projections having a V-shaped cross-sectional shape that fits to the guide grooves 745.

It should be noted that guiding projections may be provided in place of the guide grooves 745 and the continuity testing jig may be provided with guide grooves. Also, the shapes of the guide grooves and the guiding projections are not restricted to the V-shaped cross-sectional shape, and may be such a shape as a semi-circular cross-sectional shape, a U-shaped cross-sectional shape, a T-shaped cross-sectional shape, an angular C-shaped cross-sectional shape, a dovetail groove-shaped cross-sectional shape. Moreover, the number of the guide grooves 745 and the guiding projections may be only one or more than one (may be other than four as described above). The other configurations are the same as illustrated in FIGS. 38 through 40 and are not further elaborated on.

Thus, by providing the guide grooves 745 or the guiding projections, a continuity testing jig can be smoothly and accurately inserted when inserting the testing jig to test the continuity of the joint connector 711, and the testing accuracy for the joint connector 711 can be improved.

Next, a joint connector according to a fifth embodiment of the present invention is described in detail with reference to the drawings.

Figure 42:
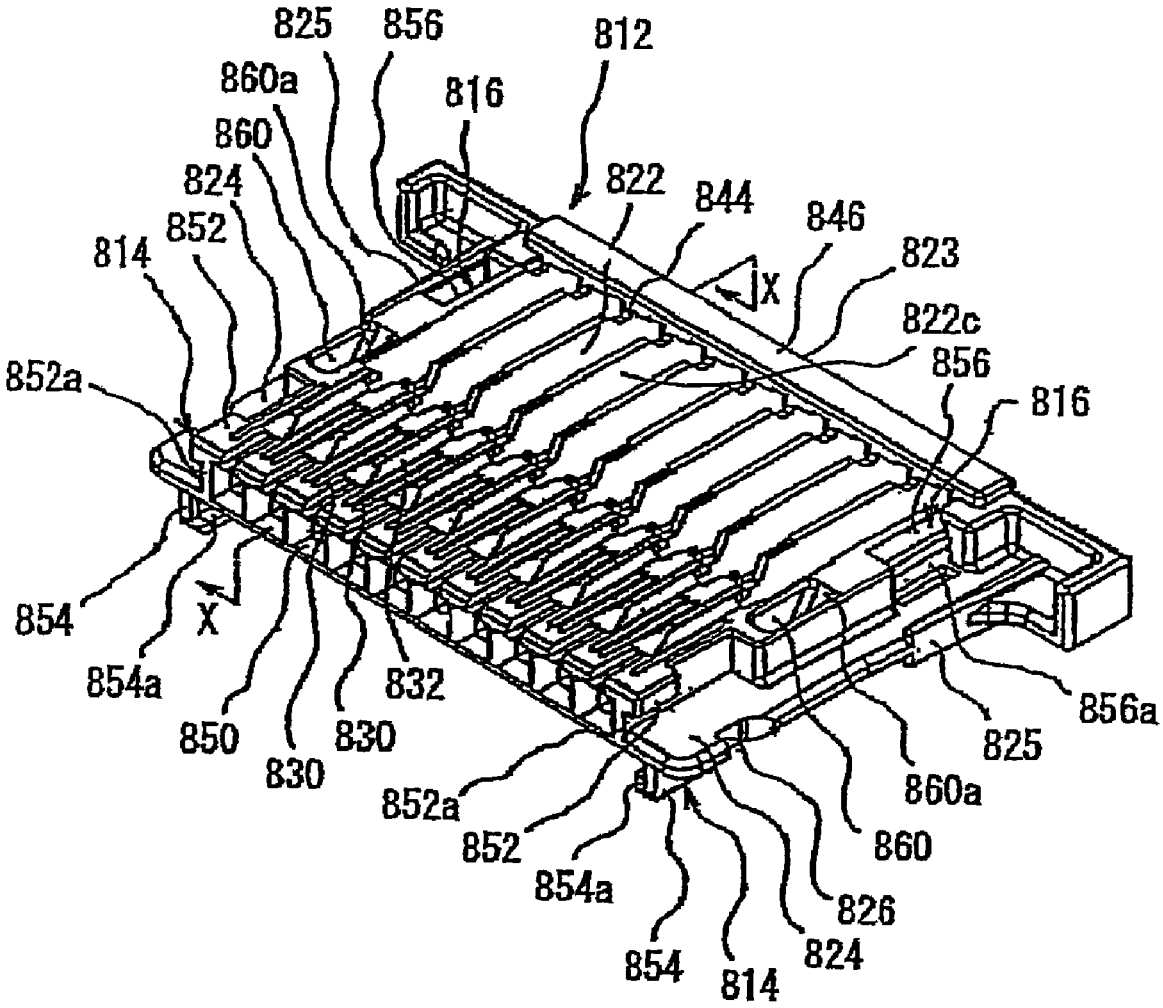
FIG. 42 is a perspective view showing a connector housing of a joint connector according to a fifth embodiment of the present invention.
Figure 43A:
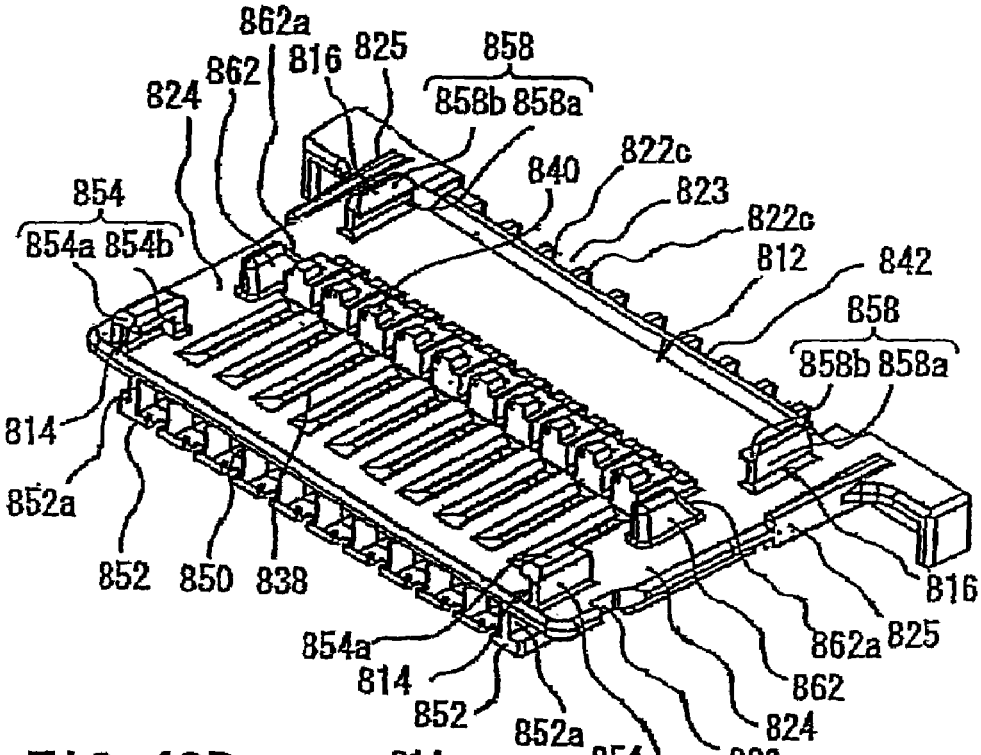
FIG. 43A is a perspective view of the connector housing of FIG. 42, viewed from its reverse side.
Figure 43B:
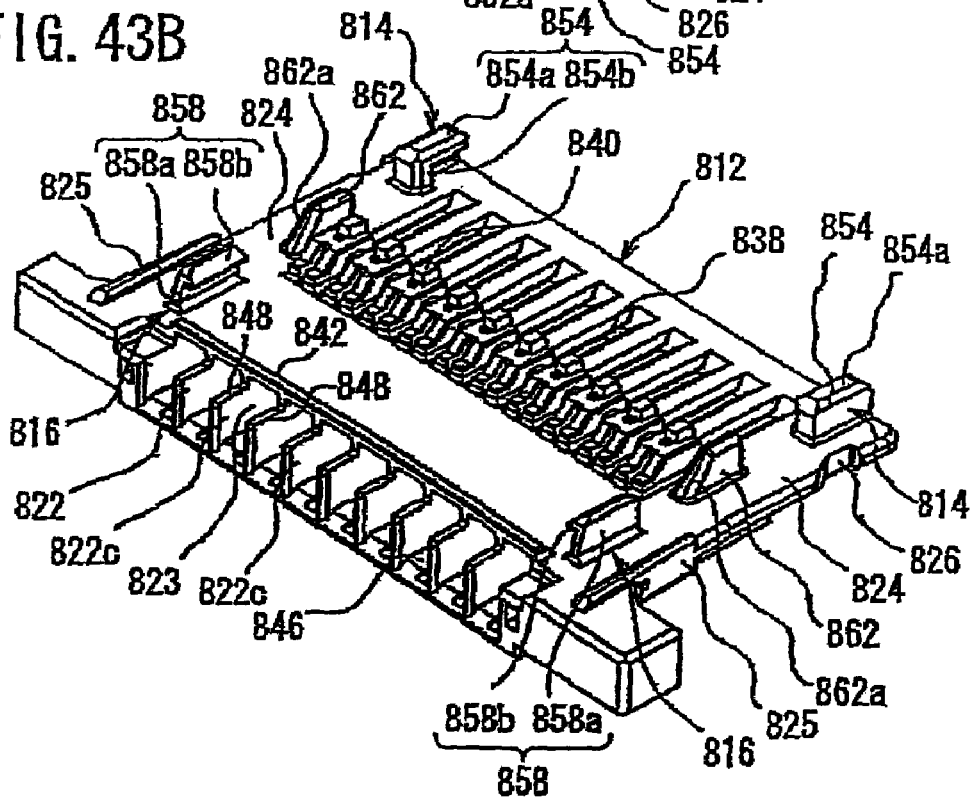
FIG. 43B is a perspective view of the connector housing of FIG. 43A, viewed from its back.
Figure 44:
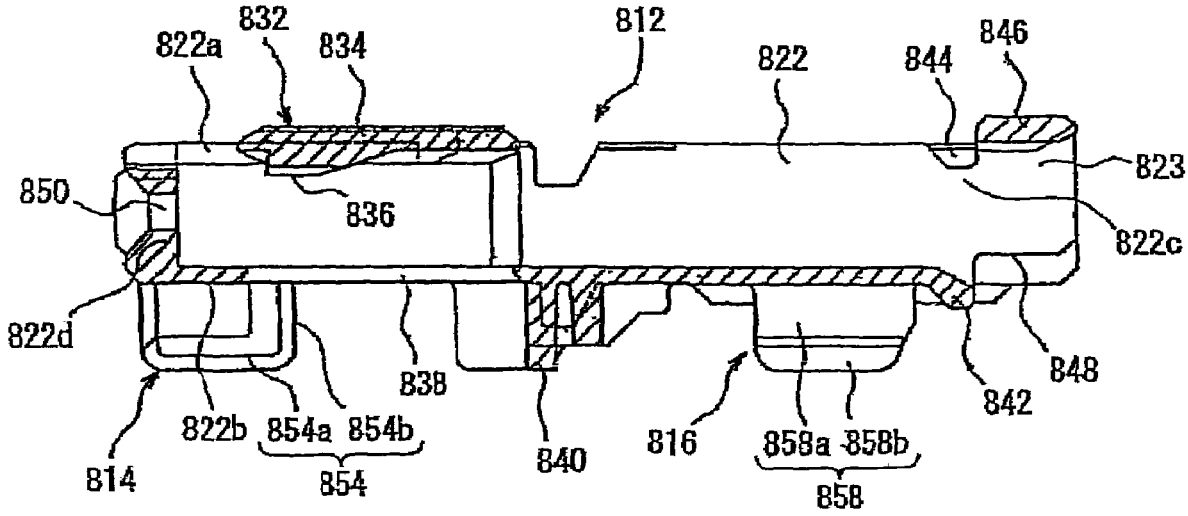
FIG. 44 is a cross-sectional view taken along line X-X in FIG. 42.

FIG. 42 is a perspective view showing a connector housing 812 constituting a joint connector 810 (see FIG. 51) according to the fifth embodiment of the present invention. FIG. 43A is a perspective view of the connector housing 812 of FIG. 42, viewed from its reverse side, and FIG. 43B is a perspective view of the connector housing 812 of FIG. 43A, viewed from its back. FIG. 44 is a cross-sectional view taken along line X-X in FIG. 42.

The joint connector 810 according to the fifth embodiment of the present invention is a stacked joint connector provided with a plurality of connector housings 812 and connector housing-locking means 814 and 816 for stacking and combining these connector housings 812 into a plurality of stages in a vertical direction.

Figure 45:
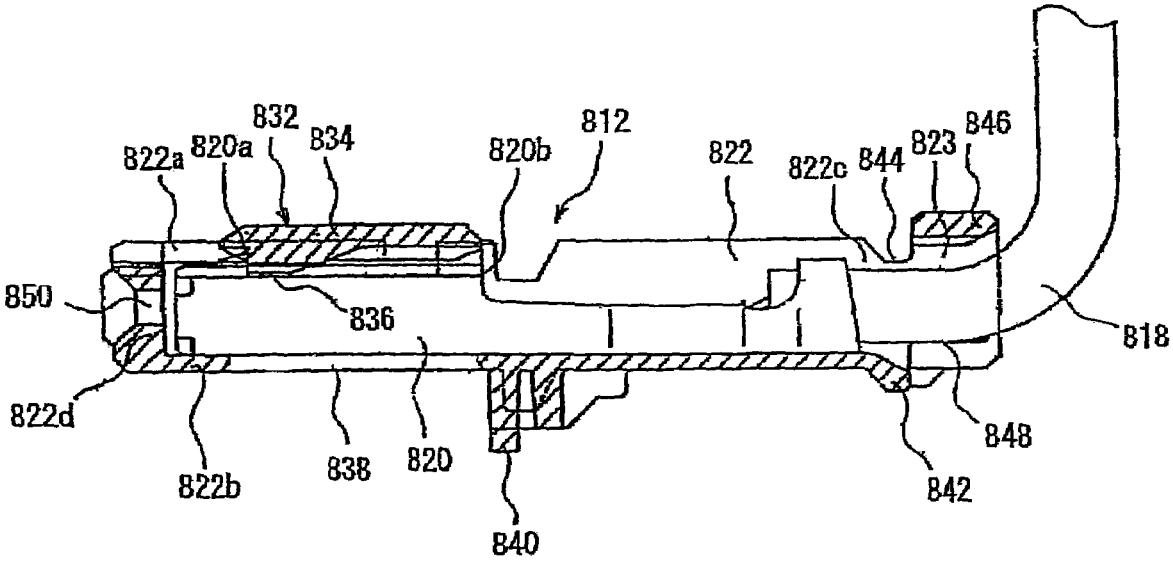
FIG. 45 is a cross-sectional view showing the way in which tensile force in an upward direction acts on an electric wire whose connecting terminal is properly accommodated in a terminal accommodating compartment of the connector housing shown in FIGS. 42 through 44.
Figure 46:
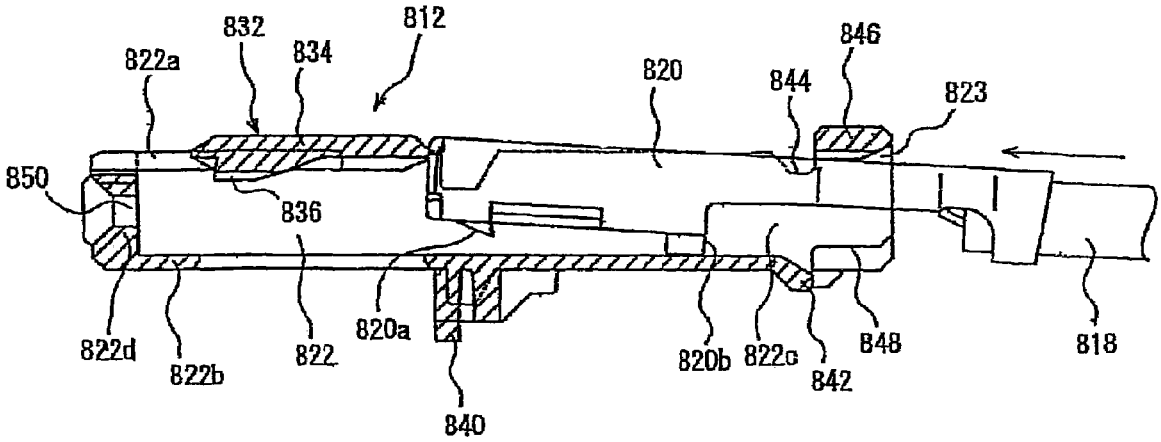
FIG. 46 is a cross-sectional view showing the way in which a connecting terminal is inserted upside down into a terminal accommodating compartment of the connector housing shown in FIGS. 42 through 44.

The connector housing 812 is provided with, as specifically shown in FIGS. 42 and 43, a plurality of terminal-accommodating compartments 822 (10 compartments in the example shown in the figures) juxtaposed in a single layer in a lateral direction, which are for accommodating a plurality of female connecting terminals 820 (10 terminals in the example shown in the figure) connected to electric wires 818 constituting a wire harness or the like by crimping or the like (see FIGS. 45 and 46 etc.). The housing is formed into a thick-walled rectangular plate-like block by a plastic molding process. Both side portions thereof are provided with flange portions 824 (including such flange portions 824 formed of both of the side portions themselves) for smoothly inserting and guiding the joint connector 810 into a mating connector 811 (see FIG. 51) in a protruding manner. Each of the flange portions 824 is provided with a lock groove 826 for locking the joint connector 810 with the mating connector 811 to prevent their disengagement.

Figure 51:
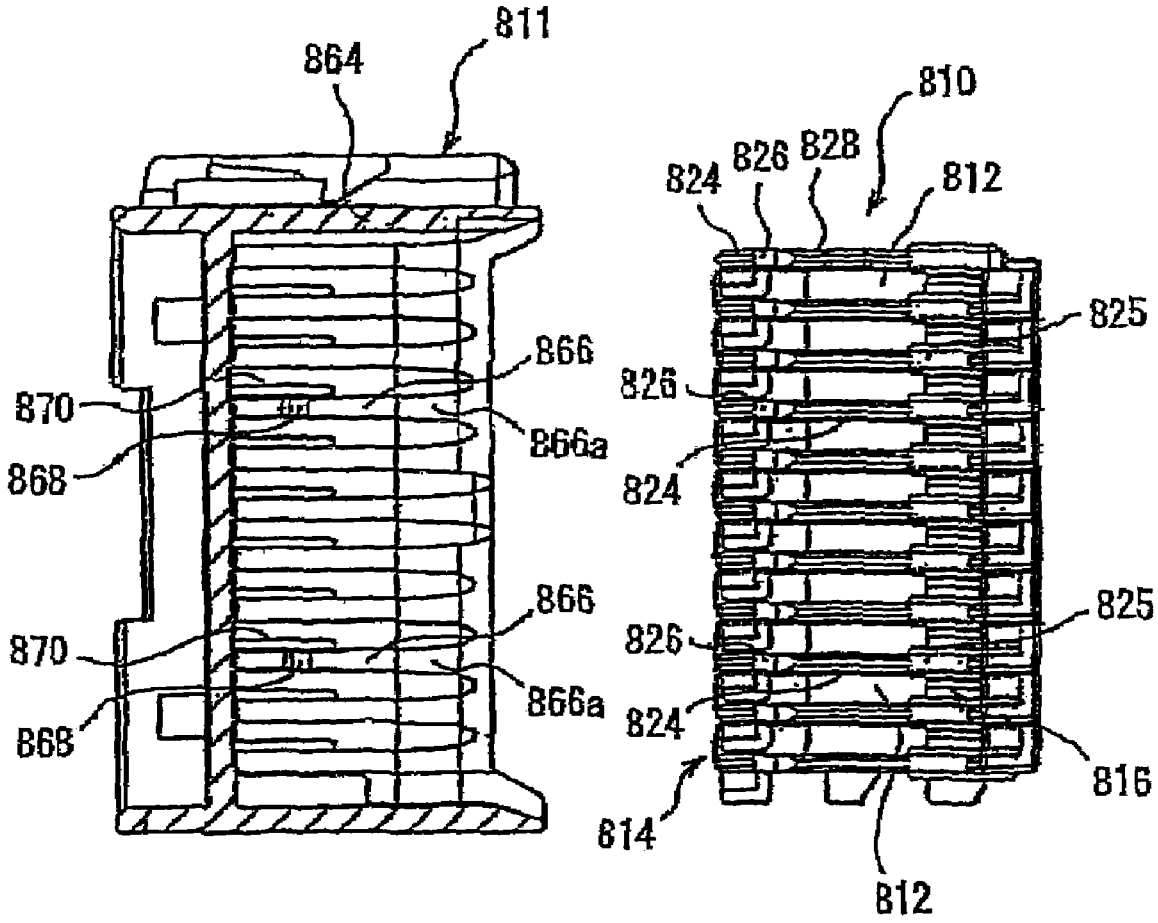
FIG. 51 is a partial side cross-sectional view showing the way in which a joint connector assembled by repeating stacking and combining the connector housings shown in FIG. 50 is aligned with a mating connector so that their centerlines are matched, to fit with the mating connector.
Figure 52A:
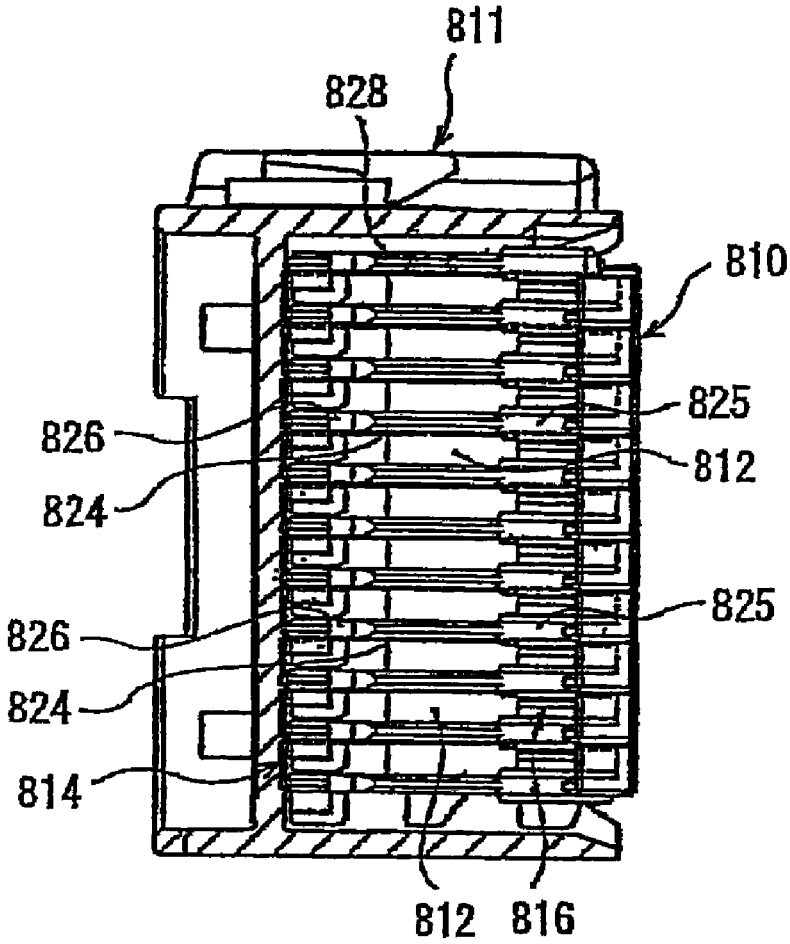
FIG. 52A is a partial side cross-sectional view showing the way in which the joint connector is fitted and connected with the mating connector from the state shown in FIG. 50.

At the rear of the flange portion 824, an interlocking tab 825 projecting in a vertical direction is formed so that, when the joint connector 810 is fitted to a later-described mating connector 811 (see FIGS. 51 and 52), it engages with a groove width-widened portion 866*a* formed at the entrance side of a guide groove 866 in a connector case 864 of the connector 811, whereby the rear portion of the connector housing 812 of the joint connector 810 do not become wobbly. The joint connector 810 is assembled, as shown in FIG. 51, in such a manner that the connector housings 812 having the same structure and size are stacked, for example, into 10 stages in a vertical direction and are combined, and a rectangular plate-like cover 828 having a matching size to the size of the connector housing 812 is attached on the uppermost stage connector housing 812. It should be noted that both side portions of the cover 828 is also provided with flange portions 824 in a protruding manner, and a lock groove 826 is provided thereon.

The connector housing 812 is as follows. The rear of the terminal-accommodating compartments 822 is opened upwardly. On one wall at the front of the terminal-accommodating compartment 822, that is, on an upper wall 822*a*, a lance 832 is provided, which, for example, has a straddle structure in which its base end is supported on the upper wall 822*a* by a pair of slits 830 (see FIG. 42) formed along the longitudinal direction of the terminal-accommodating compartments 822. The lance 832 also has a built-up portion 834 (see FIGS. 44 through 46 etc.) thick-walled and formed on the back side, and an interlocking claw 836, formed on the inner side, for engaging with a tab-like interlock receptor portion 820*a* (see FIG. 45) protruding on the upper portion of the fore-end of the connecting terminal 820. The lance 832 is composed of an elastic interlocking piece made of plastic.

As shown in FIGS. 44 through 46 etc., on the other wall opposite to the terminal-accommodating compartment 822 corresponding to the location of the lance 832, that is, on the lower wall 822*b*, a lance-receiving portion 838 is provided. The lance-receiving portion 838 receives the lance 832's built-up portion 834 that is slightly lifted upwardly by the interlocking claw 836 brought into contact with the interlock receptor portion 820*a* of the connecting terminal 820, when a connecting terminal 820 is inserted into a terminal-accommodating compartments 822 of another adjacent (lower stage) connector housing 812 (see FIG. 45), to permit the lance 832 to dislocate outwardly. The lance-receiving portion 838 is formed of a slit-like thin hole. Since the interlock receptor portion 820*a* of the connecting terminal 820 engages with the interlocking claw 836 of the lance 832, the built-up portion 834 of the lance 832 is lowered, and thus, the connecting terminal 820 is engaged and fixed with the lance 832 so as not to disengage from the terminal-accommodating compartment 822. Although the lance-receiving portion 838 is described as a thin hole in the example shown in the figures, it may be formed of a recessed groove (closed-end hole), not a hole, if a sufficient strength of the lance 832 is maintained and the size of the built-up portion 834 can be reduced. In addition, the configuration and the location of the lance 832 to be provided are not limited to those described above.

As shown in FIGS. 43A, 43B, and 44 through 46, in the connector housing 812, an interlocking protrusion 840 having, for example, an angular shape is protruded on an outside (lower side) of the lower wall 822*b* that is located further rearward of the lance 832 of the terminal-accommodating compartment 822. Since the interlocking protrusion 840 comes into contact and engages with the engaging portion 820*b* of a connecting terminal 820 accommodated in another (lower stage) connector housing 812 stacked on the connector housing 812, it is made possible to prevent disengagement of the connecting terminal 820 from the terminal-accommodating compartment 822 (double interlocking function is achieved together with the disengagement prevention by the lance 832), and to detect an detecting incomplete insertion.

As shown in FIG. 44 through FIG. 46, a terminal-guiding slope portion 842 projecting downwardly is provided on the lower wall 822*b* of the terminal-accommodating compartment 822 and in the vicinity of the terminal insertion hole 823 formed at the rear of the terminal-accommodating compartment 822 of the connector housing 812. Each of the corresponding upper portions of both side walls 822*c* in the vicinity of the terminal insertion hole 823 is provided with an undercut 844 for engaging with the terminal-guiding slope portion 842. Thus, when stacking connector housings 812, an undercut 844 of one of the connector housings 812 is engaged with a terminal-guiding slope portion 842 of another (upper stage) connector housing 812 to be stacked thereon.

By providing such a terminal-guiding slope portion 842 and an undercut 844, a connecting terminal 820 can be easily inserted into the terminal-accommodating compartment 822 of the connector housing 812 by being guided by the terminal-guiding slope portion 842 of the terminal insertion hole 823 without causing an electric wire 818 to be compress-buckled or bent-deformed, even when it is connected to such an electric wire 818 easily bent-deformed or compress-buckled due to its small size and diameter.

In addition, a stopper member 846 formed of a laterally-long piece is provided so as to cover an upper opening of the terminal insertion hole 823 in the connector housing 812 and straddle over the upper portions of both side walls 822*c* of the terminal-accommodating compartments 822 that are above the terminal insertion holes 823. The corresponding lower portions of both side walls 822*c* of the terminal-accommodating compartment 822 is provided with a cut-out 848 for receiving the stopper member 846 so that the cut-out 848 of one of the connector housing 812 is engaged with the stopper member 846 of another (lower stage) connector housing 812 to be stacked when stacking the connector housings 812.

Thus, by providing the stopper member 846 over the opening of the terminal insertion hole 823, as shown in FIG. 45, the electric wire 818 is not lifted in an upward direction even when a tensile force acts on the electric wire 818 in an upward direction after the connecting terminal 820 are inserted and accommodated in the terminal-accommodating compartment 822, and the rear side of the lance 832 and the connecting terminal 820 in the connector housing 812 can be prevented from breakage. Furthermore, the stopper member 846 restricts the inserting direction of the connecting terminal 820 from the terminal insertion hole 823. Therefore, even if the connecting terminal 820 is, as shown in FIG. 46, inserted upside down into the terminal-accommodating compartment 822, the inserting direction shifts diagonally upwardly in the figure by the stopper member 846 and thus the fore-end of the connecting terminal 820 comes into contact with the rear portion of the lance 832, which makes the insertion impossible. Therefore, it becomes possible to detect upside-down insertion of the connecting terminal 820 into the terminal-accommodating compartment 822 quickly to reliably prevent the connecting terminal 820 from being accommodated in the terminal-accommodating compartment 822 upside down. It should be noted that reference numeral 850 denotes a small diameter terminal insertion hole formed on a front wall 822*d* of the terminal-accommodating compartment 822, for inserting connecting terminals 870 of a mating connector (see FIG. 51).

The connector housing-locking means 814 comprise, as shown in FIGS. 42 through 44, interlocking recess portions 852 provided at the front of both side portions in the connector housing 812, for example, on upper portions of the flange portion 824, and corresponding interlocking protrusion portions 854 provided, for example, on lower portions of the flange portions 824. It is configured so that the interlocking recess portions 852 provided for one of (lower stage) connector housings 812 are engaged with interlocking protrusion portions 854 provided for another one of (upper stage) connector housings 812 to be stacked thereon. More specifically, each interlocking recess portion 852 has an angular C-shaped recessed groove 852*a* opened in a lateral direction. The interlocking protrusion portion 854 has a lateral interlocking piece 854*a* extending forward and rearward, for being loosely inserted in the recessed groove 852*a* of the interlocking recess portion 852 and engaging therewith, and a vertical interlocking piece 854*b* capable of contacting the interlocking recess portion 852; and it is formed into a substantially L-shape by the lateral interlocking piece 854*a* and the vertical interlocking piece 854*b*. The fore-end of the lateral interlocking piece 854*a* of the interlocking protrusion portion 854 is disposed facing forward so as to oppose the recessed groove 852*a* of the interlocking recess portion 852.

The connector housing-locking means 816 comprise, as shown in FIG. 42 through FIG. 44, interlocking recess portions 856 provided at the rear of on both side portions of the connector housing 812, for example, on upper portions of the flange portion 824, and corresponding interlocking protrusion portions 858 provided, for example, on lower portions of the flange portions 824. It is configured so that the interlocking recess portions 856 provided for one of (lower stage) connector housings 812 are engaged with the interlocking protrusion portions 858 provided for another one of (upper stage) connector housings 812 to be stacked thereon. More specifically, the interlocking recess portions 856 each has an angular C-shaped recessed groove 856*a* opened in a lateral direction. The interlocking protrusion portions 858 are each composed of a linear interlocking piece 858*a* projecting downwardly from the flange portion 824, and a claw 858*b* formed at its fore-end and facing inward, for engaging with the recessed groove 856*a* of the interlocking recess portion 856.

Play gaps are provided between interlocking surfaces of the interlocking recess portion 852 and the interlocking protrusion portion 854 engaging therewith in the connector housing-locking means 814, and between interlocking surfaces of the interlocking recess portion 856 and the interlocking protrusion portion 858 engaging therewith in the connector housing-locking means 816, to loosely engage them with each other. Thus, a plurality of connector housings 812 are relatively shiftable and loosely combined to form an accordion structure.

Further, as shown in FIGS. 42, 43A, and 43B, rectangular guiding recessed grooves 860 for constraining a relative shift between the stacked connector housings 812 are provided, for example, on upper portions of the flange portions 824 and between the connector housing-locking means 814 and 816 provided at the front and the back of the both side portions of the connector housing 812. Also, the corresponding lower portions of the flange portions 824 are provided with rectangular plate-shaped guide ribs 862 protruding downwardly so as to be fitted to the guiding recessed groove 860. Respective rear portions of the guiding recessed grooves 860 and the guide ribs 862 are formed into inclined surfaces 860*a* and 862*a* widening toward their bottoms. The guiding recessed grooves 860 of one of connector housings 812 are engaged with the guide ribs 862, which are inserted therein, of another one of (upper stage) connector housings 812 to be stacked thereon.

By providing the guiding recessed grooves 860 and the guide ribs 862, relative shifting between the stacked and combined connector housings 812 is more reliably constrained by the guide ribs 862, and in addition, backlash is suppressed by the contact between the inclined surfaces 860*a* and 862*a* of the guiding recessed groove 860 and the guide rib 862. Moreover, when stacking a connector housing 812 from an inclined posture, the guide ribs 862 do not hit the inner periphery of the guiding recessed grooves 860, and they can be smoothly fitted; thus, workability in stacking the connector housings 812 can be improved.

Figure 47A:
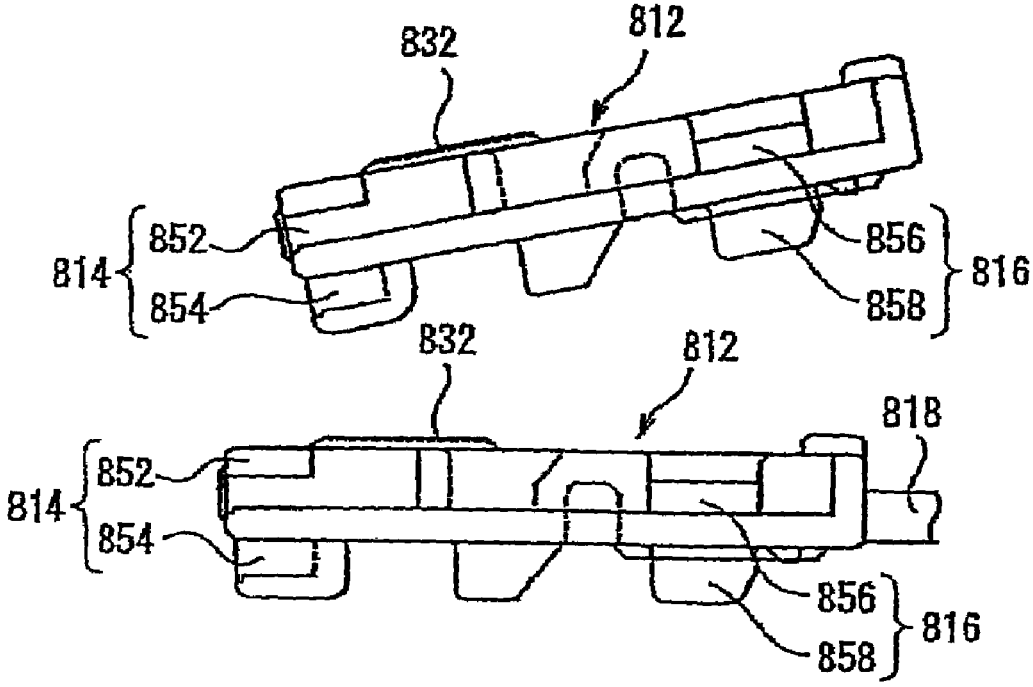
FIG. 47A is a side view showing the way in which, when combining connector housings by stacking, one of the connector housings is arranged to be in an inclined state relative to the other one of the connector housings so that its front is lowered diagonally downward.
Figure 47B:
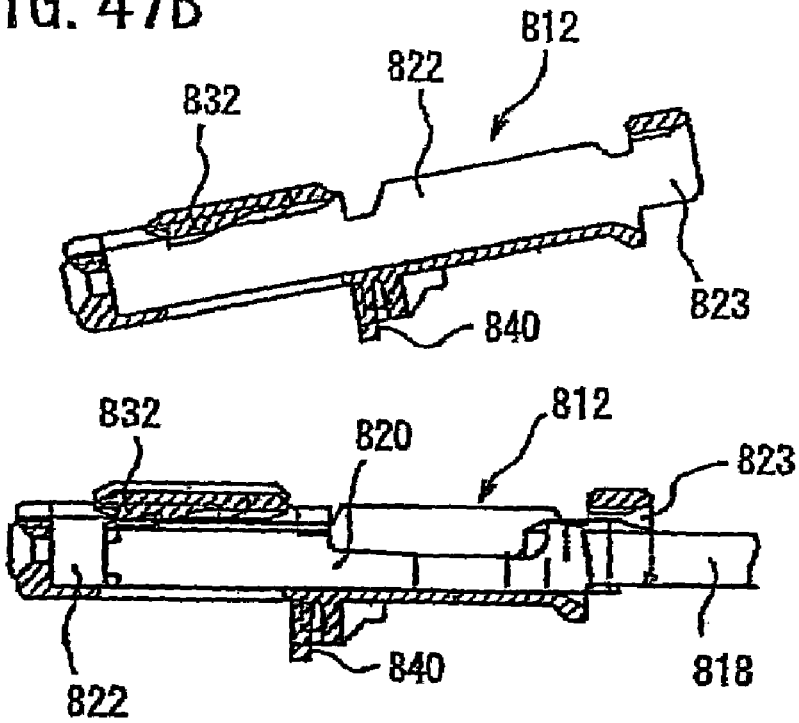
FIG. 47B is a cross-sectional view of FIG. 47A.

When the connector housings 812 are stacked into a plurality of stages, for example, into 10 stages and combined by the connector housing-locking means 814 and 816 to assemble the joint connector 810, the connecting terminals 820 connected to the electric wires 818 are inserted and accommodated in advance from the terminal insertion holes 823 into the terminal-accommodating compartments 822 of the connector housing 812 that is disposed at the lowermost stage. In the present embodiment, the connecting terminals 820 are not inserted deeply to a predetermined location in the terminal-accommodating compartments 822 and are accommodated in an incompletely inserted state, so a condition in which they are not engaged with the lances 832 is shown. Then, a connector housing 812 to be stacked for the second lowermost stage (upper stage) is arranged in an inclined state while being shifted slightly rearward so that its front side is lowered diagonally downwardly with respect to the lowermost stage (lower stage) connector housing 812 (see FIGS. 47A and 47B).

Figure 48A:
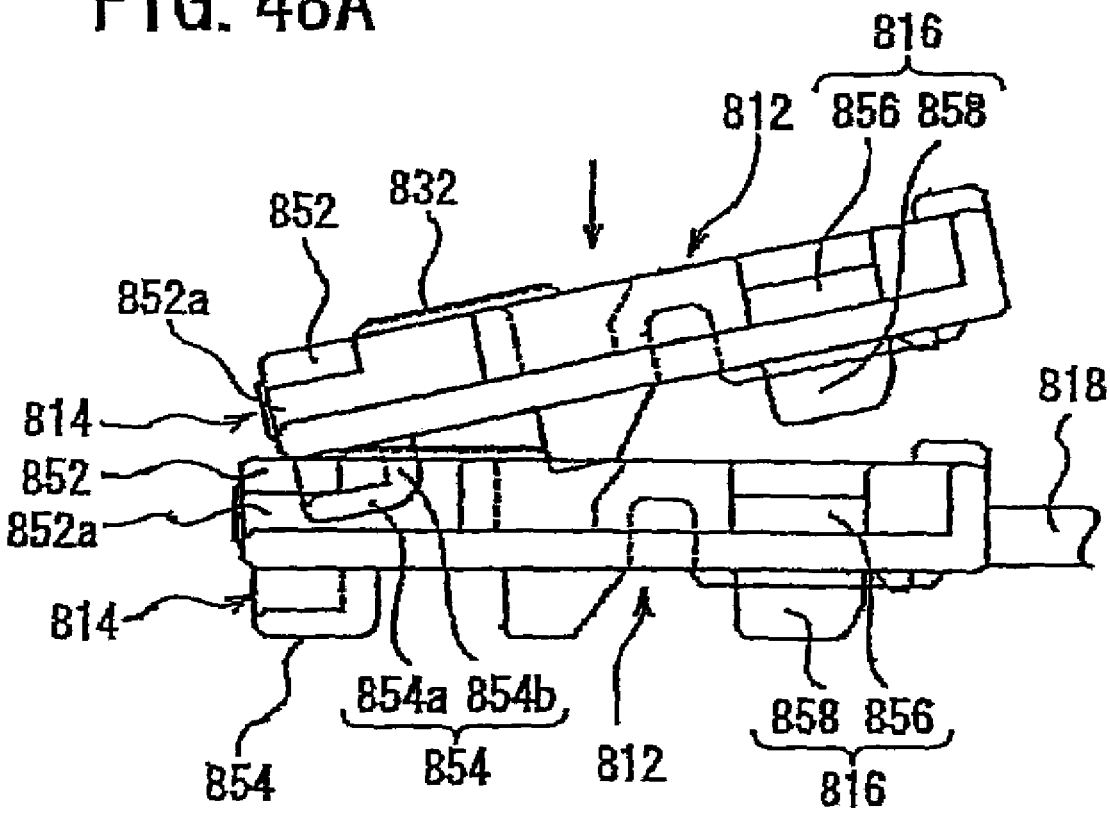
FIG. 48A is a side view showing the way in which, from the state shown in FIG. 47, the other one of the connector housings is brought close to the one of the connector housing side so that a transverse interlocking piece of an interlocking protrusion portion in a connector housing-locking means provided in a front of the other one of the connector housing to be stacked is loosely inserted into an interlocking recess portion in a connector housing-locking means provided in its front of the one of the connector housing.
Figure 48B:
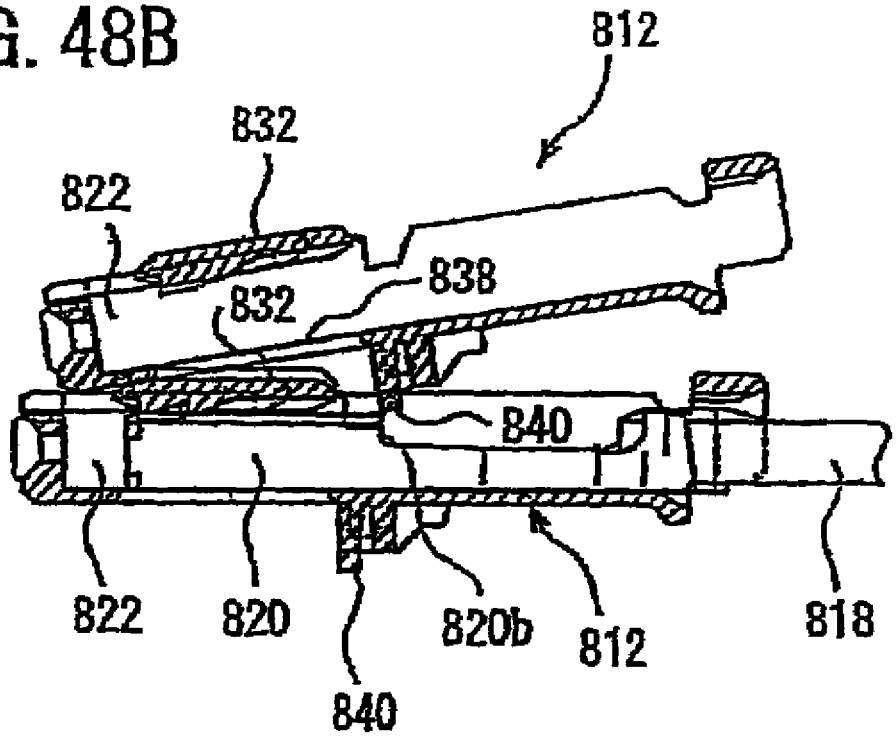
FIG. 48B is a cross-sectional view of FIG. 48A.

Next, in this state, the upper stage connector housing 812 is lowered while being maintained to be in the inclined state and brought closer to the lower stage connector housing 812, so that the lateral interlocking piece 854*a* of the interlocking protrusion portion 854 in the connector housing-locking means 814 provided on the front side of the upper stage connector housing 812 to be stacked is loosely inserted into the recessed groove 852*a* of the interlocking recess portion 852 in the connector housing-locking means 814 provided on the front side of the lower stage connector housing 812, to loosely engage the interlocking recess portion 852 and the interlocking protrusion portion 854 with each other in the connector housing-locking means 814 (see FIGS. 48A, and 48B).

Figure 49A:
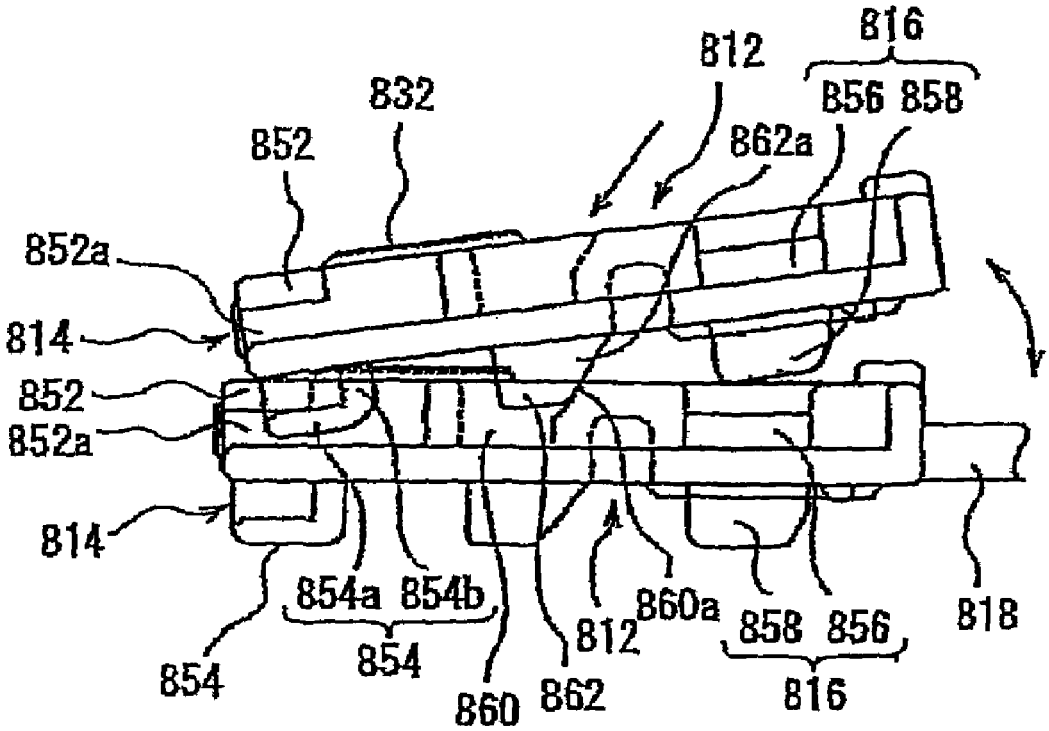
FIG. 49A is a side view showing the way in which, from the state shown in FIG. 48, the other one of the connector housings is rotated to be in parallel to the one of the connector housings while being shifted forward so that an interlocking protrusion provided protruding on the other one of the connector housings is engaged in an engaging portion of the connecting terminal accommodated in the terminal accommodating compartment of the one of the connector housing in an incompletely inserted state to push the connecting terminal in forward.
Figure 49B:
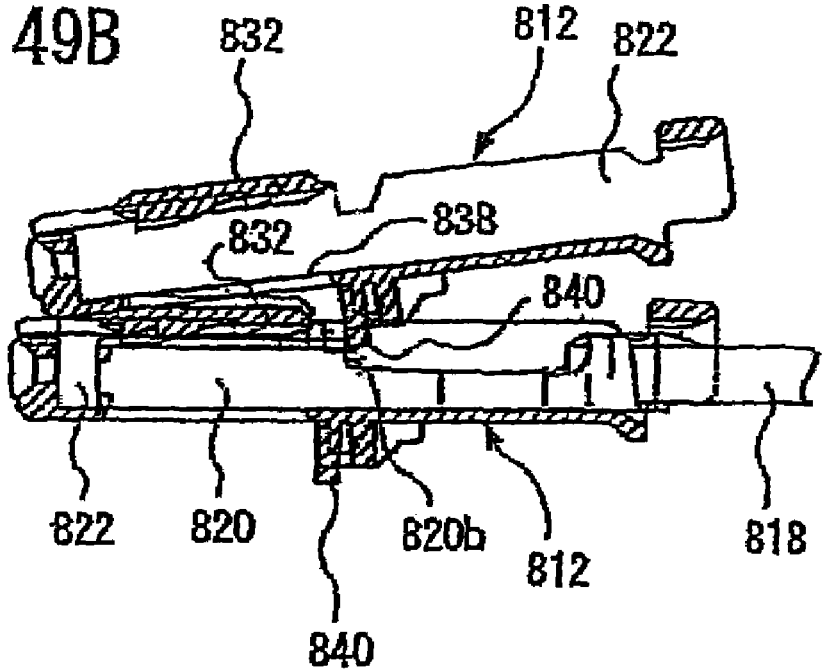
FIG. 49B is a cross-sectional view of FIG. 49A.

Subsequently, the upper stage connector housing 812 is shifted forward and at the same time is rotated so as to be parallel to the lower stage connector housing 812 (clockwise in FIG. 49), using the connector housing-locking means 814 as a supporting point. In that process, the interlocking protrusion 840 protruding on the upper stage connector housing 812 is brought into contact and engaged with the engaging portion 820*b* of the connecting terminal 820 accommodated in the terminal-accommodating compartment 822 in an incompletely inserted state, and by this interlocking protrusion 840, the connecting terminal 820 is pushed deeply into the terminal-accommodating compartment 822, accompanying the shift of the upper stage connector housing 812. Meanwhile, a portion (fore-end portion) of the guide rib 862 provided for the upper stage connector housing 812 is inserted into the guiding recessed groove 860 provided for the lower stage connector housing 812, and at the rear, the interlocking recess portion 856 of the connector housing-locking means 816 and the interlocking protrusion portion 858 are brought into a semi-engaged state (see FIGS. 49A, and 49B).

Figure 50A:
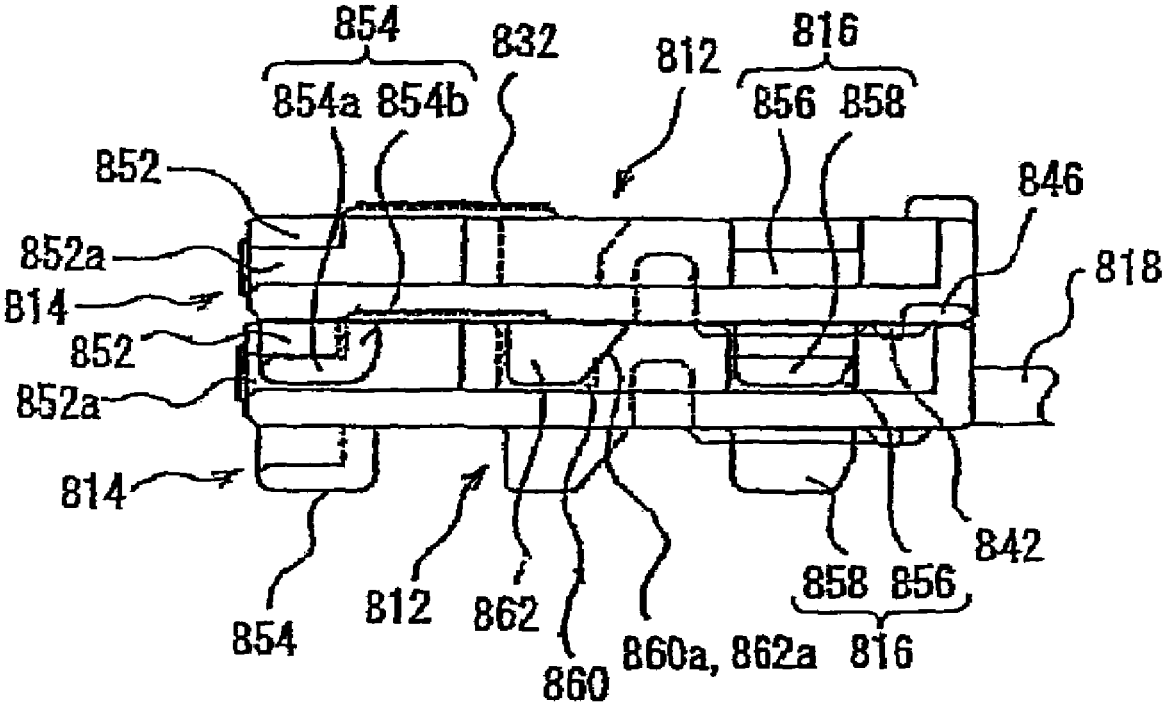
FIG. 50A is a side view showing the way in which the other one of the connector housings is shifted forward further from the state shown in FIG. 48 until a vertical interlocking piece of the interlocking protrusion portion makes contact with a recessed groove of an interlocking recess portion of the connector housing-locking means in the front, to stack on the one of the connector housings, so that the interlocking recess portion of the connector housing-locking means is engaged with the interlocking protrusion portion at its front and back to combine the two adjacent connector housings.
Figure 50B:
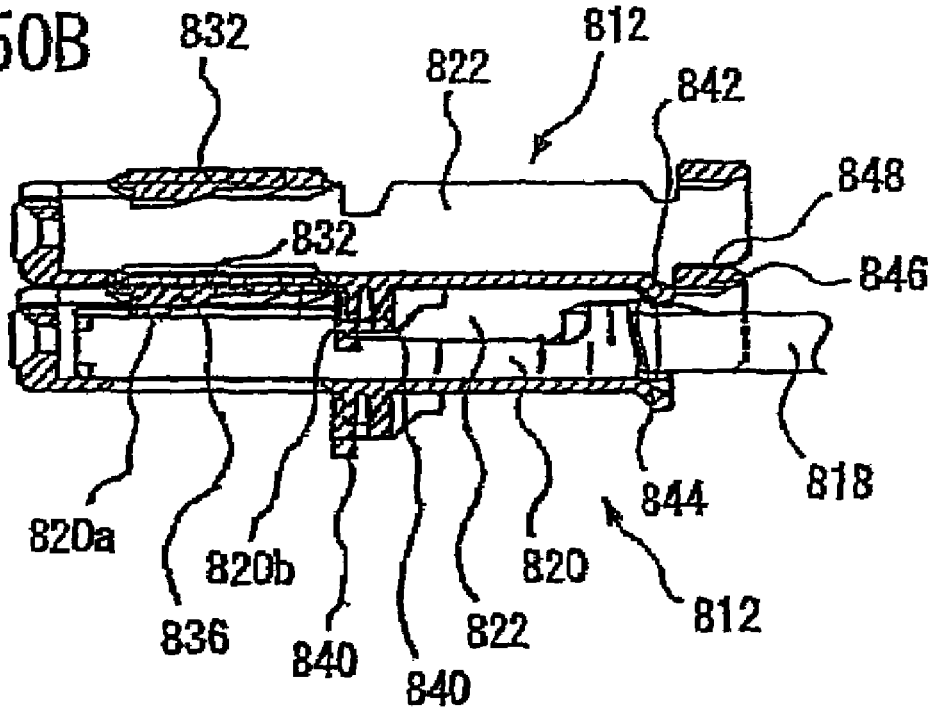
FIG. 50B is a cross-sectional view of FIG. 50A.

Next, from the state described above, the upper stage connector housing 812 is further shifted forward until the vertical interlocking piece 854*b* of the interlocking protrusion portion 854 comes into contact with the recessed groove 852*a* of the interlocking recess portion 852 in the connector housing-locking means 814 at the front, so as to be stacked on the lower stage connector housing 812. At the front, the interlocking recess portion 852 is engaged with the interlocking protrusion portion 854 in the connector housing-locking means 814 at the front, while at the rear, the interlocking recess portion 856 is engaged with the interlocking protrusion portion 858 in the connector housing-locking means 816, whereby the adjacent upper and lower stage connector housings 812 are combined with each other. With the completion of stacking the connector housings 812, the connecting terminal 820 is inserted to a predetermined designed location in the terminal-accommodating compartment 822 and accommodated therein, and the interlock receptor portion 820*a* of the connecting terminals 820 engages with the interlocking claw 836 of the lance 832, fixing the connecting terminal 820 so as not to be disengaged from the terminal-accommodating compartment 822. At the same time, the terminal-guiding slope portion 842 engages with the undercut 844, the stopper member 846 engages with the cut-out 848, and the guide rib 862 engages with the guiding recessed groove 860 (see FIGS. 50A and 50B).

When the stacking operation finishes for the second lowermost stage (upper stage) connector housing 812 against the lowermost stage connector housing 812 in the manner described above, another set of connecting terminals 820 are inserted into the terminal-accommodating compartments 822 of the upper stage connector housing 812, and thereafter, the third lowermost connector housing 812 is stacked on the upper stage connector housing 812 and is combined by connector housing-locking means 814 and 816 in a similar manner. Subsequently, similar operations are repeated and the connector housings 812 are stacked and combined into 10 vertical stages to assemble the joint connector 810 as shown in FIG. 51.

It should be noted that in the foregoing embodiment, each time one layer of connector housing 812 is stacked, connecting terminals 820 are inserted in the terminal-accommodating compartments 822 of the connector housing 812 stacked on the upper stage; however, it is possible to accommodate connecting terminals 820 in advance in the terminal-accommodating compartments 822 of the upper stage connector housing 812 before stacking an upper stage connector housing 812 on a lower stage connector housing 812, and to stack the upper and lower stage connector housings 812 each other in which connecting terminals 820 have been accommodated, in assembling the joint connector 810. This way of assembling is preferable, since the stacking operation of the connector housings 812 becomes easy and work efficiency improves, and moreover, especially when it is necessary to insert connecting terminals 820 connected to such electric wires 818 having a small diameter and being easily bent into the terminal-accommodating compartments 822 of a connector housing 812, the terminals can be inserted while being guided by the terminal-guiding slope portions 842 provided for the terminal insertion holes 823, which reduces cumbersome work necessary for inserting the connecting terminal 820.

In the foregoing embodiment, the interlocking recess portion 852 of the connector housing-locking means 814 provided at the front on both side portions of the connector housing 812 is provided on an upper portion of the housing 812, and the corresponding lower portion is provided with the interlocking protrusion portion 854; however, it is possible to provide the interlocking recess portion 852 on an lower portion of the housing 812 and to provide the corresponding upper portion of the housing 812 with the interlocking protrusion portion 854. In this case, the lateral interlocking piece 854*a* of the interlocking protrusion portion 854 is disposed facing rearward so as to oppose the recessed groove 852*a* of the interlocking recess portion 852. When stacking the connector housings 812, the recessed groove 852*a* of the interlocking recess portion 852 of the connector housing-locking means 814 in the upper stage connector housing 812 that is disposed in an inclined state in which its front is lowered diagonally downwardly is relatively loosely inserted into the lateral interlocking piece 854*a* of the interlocking protrusion portion 854 of the connector housing-locking means 814 in the lower stage connector housing 812. The upper stage connector housing 812 is shifted forward and is rotated so as to be parallel to the lower stage connector housing 812, using the connector housing-locking means 814 as a supporting point. Thus, the housings are stacked in a similar way.

Thus, the interlocking recess portion 852 of the connector housing-locking means 814 provided at the front of both side portions of the connector housing 812 has a recessed groove 852*a* opened in a lateral direction, and the interlocking protrusion portion 854 has a lateral interlocking piece 854*a* extending forward and rearward, for being loosely inserted in the recessed groove 852*a* of the interlocking recess portion 852 and engaging therewith, and a vertical interlocking piece 854*b* capable of contacting the interlocking recess portion 852, the interlocking protrusion portion being formed into a substantially L-shape by the lateral interlocking piece 854*a* and the vertical interlocking piece 854*b*. When stacking the connector housings 812 into a plurality of stages and combining them by the connector housing-locking means 812 and 814 to assemble the joint connector 810, with respect to one of the connector housings 812, the other one of the connector housings 812 to be stacked is disposed in an inclined state such that its front is lowered diagonally downwardly while being shifted slightly rearward. In a posture of such an inclined state, the other one of the connector housings 812 is brought closer to the one of the connector housings 812, and the recessed groove 852*a* of the interlocking recess portion 852 or the lateral interlocking piece 854*a* of the interlocking protrusion portion 854 in the connector housing-locking means 814 that is provided at the front of the one of the connector housings 812 is relatively loosely inserted into the lateral interlocking piece 854*a* of the interlocking protrusion portion 854 or the recessed groove 852*a* of the interlocking recess portion 852 of the connector housing-locking means 814 in the connector housing-locking means 814 that is provided at the front of the other one of the connector housings 812. Then, the other one of the connector housings 812 is shifted forward and is rotated so as to be parallel to the one of the connector housings 812, using the connector housing-locking means 814 at the front as a supporting point, and to be overlapped with the one of the connector housings 812.

In that process, the interlocking protrusion 840 protruding on the other one of the connector housings 812 is engaged with the engaging portion 820*b* of the connecting terminal 820 accommodated in the terminal-accommodating compartment 822 of the one of the connector housings 812 in an incompletely inserted state. By this interlocking protrusion 840, the connecting terminal 820 can be inserted deeply into the terminal-accommodating compartment 822, accompanying the shifting of the other one of the connector housings 812. As a result, in stacking the connector housings 812, even when connecting terminals 820 are accommodated in terminal-accommodating compartments 822 in an incompletely inserted state, those connecting terminals 820 can be quickly straightened in a desired normal inserted state to accommodate them in a predetermined location. Thus, connection performance and reliability in the connector can be improved, and in addition, being small-sized, assembling for various equipment can be carried out efficiently without cumbersome work.

To connect the above-described joint connector 810 with a mating connector 811, as shown in FIG. 51, the joint connector 810 and the mating connector 811 are opposed to each other and disposed so that their centerlines match. Next, the flange portions 824 protruding on both side portions of the connector housings 812 and the cover 828 constituting the joint connector 810 are made to support by a plurality of substantially angular C-shaped guide grooves 866 formed in both inner side walls of the connector case 864 of the mating connector 811, and, while slide-guiding along the guide grooves 866, the joint connector 810 is inserted and fitted into the connector case 864 of the mating connector 811. Then, elastic interlocking claws 868 formed at, for example, the third and eighth stages among the guide grooves 866 of the mating connector 811 are engaged with two corresponding lock grooves 826 provided on the flange portions 824 of the joint connector 810, to fix the joint connector 810 so as not to disengage from the mating connector 811 (see FIG. 52A).

With the fitting of the joint connector 810 to the mating connector 811, a plurality of pin-shaped (male) connecting terminals 870 mounted to the mating connector 811 and protruding in the connector case 864 are inserted into connecting terminals 820 accommodated in the terminal-accommodating compartments of the connector housings 812 in the joint connector 810, establishing electrical contact with the terminals 820. Thus, the joint connector 810 is connected to the mating connector 811.

Figure 52B:
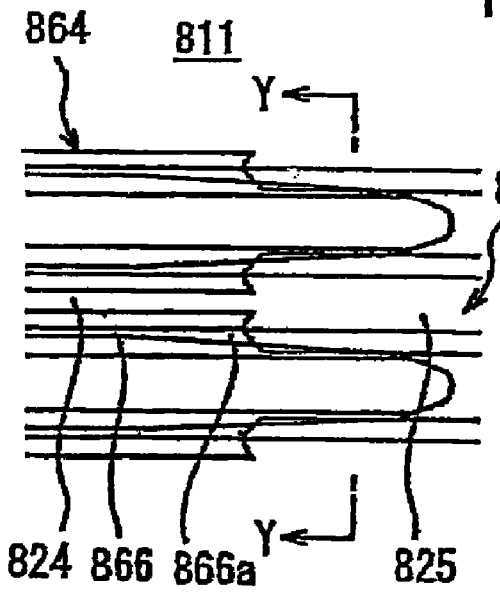
FIG. 52B is an enlarged illustration showing the way in which an interlocking tab of a connector housing in the joint connector is engaged in a groove width-widened portion of a guide groove of a connector case in the mating connector.
Figure 52C:
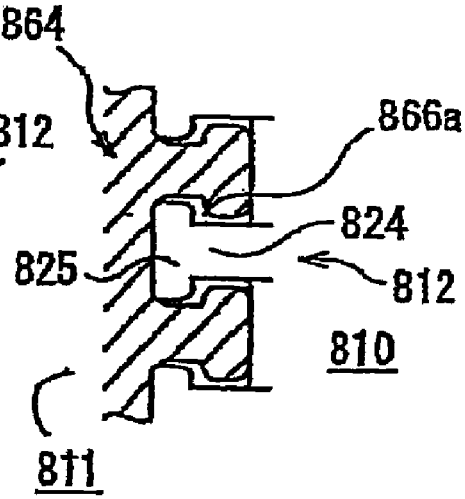
FIG. 52C is a cross-sectional view taken along line Y-Y in FIG. 52B.

It should be noted that, as shown in FIG. 52B and FIG. 52C, an interlocking tab 825 formed at the rear of a flange portion 824 of a connector housing 812 in the coupling joint connector 810 engages with a groove width-widened portion 866*a* formed near the entrance of the guide groove 866 in the connector case 864 of the mating connector 811 when the joint connector 810 is fitted to the mating connector 811, so that the rear portion of the connector housing 812 in the joint connector 810 does not become wobbly. Thus, it is preferable that the interlocking tab 825 is made to engage with the groove width-widened portion 866*a* in this way since the backlash of the connector housings 812 can be prevented in the joint connector 810 fitted to the mating connector 811, and reliability in the connector's connection can be further improved even when the joint connector 810 has an accordion structure in which the connector housings 812 are loosely combined to be shiftable relative to each other.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

The invention claimed is:

1. A joint connector in which an inserting-side connector portion and a receiving-side connector portion are locked with each other by a connector-locking means, comprising:

an inserting-side connector portion having a plurality of connector housings, in each of which a plurality of terminal-accommodating compartments for accommodating female terminals are juxtaposed in a single layer, the connector housings stacked in a plurality of stages and combined; and a receiving-side connector portion having a connector case in which the inserting-side connector portion is inserted, and a plurality of male terminals protruding in the connector case and being connected to the female terminals of the connector housings in the inserting-side connector portion;

wherein the connector-locking means is provided at a lateral side location when viewed from the inserting direction so as to lock a side portion of the connector housing in the inserting-side connector portion and a side wall of the connector case in the receiving-side connector portion.

2. The joint connector according to claim 1, wherein the connector-locking means is provided at both side locations so as to lock both side portions of at least one of the connector housings in the inserting-side connector portion and both side walls of the connector case in the receiving-side connector portion.

3. The joint connector according to claim 1, wherein the connector-locking means comprises an engagement recess portion and an engaging claw portion composed of an elastic piece having at its fore-end a claw for engaging the engagement recess portion, the engagement recess portion being provided on a side portion of at least one of the connector housings in the inserting-side connector portion and the engaging claw portion being provided in a cantilevered fashion on a side wall of the connector case in the receiving-side connector portion.

4. The joint connector according to claim 1, wherein the connector-locking means comprises an engagement recess portion and an engaging claw portion composed of an elastic piece having at its fore-end a claw for engaging with the engagement recess portion and a curved tab diagonally extending outwardly with respect to the claw so as to be in a substantially Y-shape.

* * * * *